US005254422A

United States Patent [19]

Kato et al.

[11] Patent Number: 5,254,422

[45] Date of Patent: * Oct. 19, 1993

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[ * ] Notice: The portion of the term of this patent subsequent to Jan. 5, 2010 has been disclaimed.

[21] Appl. No.: 725,113

[22] Filed: Jul. 3, 1991

[30] Foreign Application Priority Data

Jul. 5, 1990 [JP] Japan ..... 2-176195
Nov. 15, 1990 [JP] Japan ..... 2-307240
Nov. 19, 1990 [JP] Japan ..... 2-311547

[51] Int. Cl.[5] ..... G03G 13/28; G03G 5/00

[52] U.S. Cl. ..... 430/49; 430/96; 430/905

[58] Field of Search ..... 430/49, 96, 905

[56] References Cited

U.S. PATENT DOCUMENTS 4,792,511 12/1988 Kato et al. .
4,828,952 5/1989 Kato et al. .
4,910,112 3/1990 Kato et al. .
4,929,526 5/1990 Kato et al. .
4,960,661 10/1990 Kato et al. .
4,996,121 2/1991 Kato et al. .
5,001,029 3/1991 Kato et al. .
5,017,448 5/1991 Kato et al. .
5,077,165 12/1991 Kato et al. ..... 430/89

FOREIGN PATENT DOCUMENTS 0323854 7/1989 European Pat. Off. .
0325258 7/1989 European Pat. Off. .

*Primary Examiner*—Marion E. McCamish
*Assistant Examiner*—Stephen C. Crossan
*Attorney, Agent, or Firm*—Sughrue, Mion, Zinn, Macpeak & Seas

[57] ABSTRACT

An electrophotographic lithographic printing plate precursor which utilizes an electrophotographic light-sensitive material comprising a conductive support having provided thereon at least one photoconductive layer containing photoconductive zinc oxide and a binder resin, wherein the binder resin contains at least one graft-type copolymer comprising at least (1) a monofunctional monomer containing a functional group which has at least one atom selected from a fluorine atom and a silicon atom and is capable of forming at least one hydrophilic group selected from a sulfo group, a phosphono group, a carboxy group and a hydroxy group through decomposition, and (2) a monofunctional macromonomer which has a weight average molecular weight of from $1\times10^3$ to $2\times10^4$, and has a polymerizable double bond group represented by the general formula (I) described herein bonded to only one terminal of the main chain thereof.

11 Claims, No Drawings

ELECTROPHOTOGRAPHIC LITHOGRAPHIC PRINTING PLATE PRECURSOR

FIELD OF THE INVENTION

The present invention relates to an electrophotographic lithographic printing plate precursor for producing a printing plate through electrophotography and, more particularly, to an improvement in a binder resin constituting a photoconductive layer of the lithographic printing plate precursor.

BACKGROUND OF THE INVENTION

Various kinds of offset printing plate precursors for directly producing printing plates have hitherto been proposed, and some of which have already been put into practical use. The most widely employed precursor is a light-sensitive material having a photoconductive layer comprising photoconductive particles, such as zinc oxide, and a binder resin provided on a conductive support. A highly oleophilic toner image is subsequently formed on the photoconductive layer surface by an ordinary electrophotographic process. The surface of the photoconductive layer having the toner image is then treated with an oil-desensitizing solution, called an etching solution, to selectively render the non-image areas hydrophilic thereby producing an offset printing plate.

In order to obtain satisfactory prints, an offset printing plate precursor or light-sensitive material must faithfully reproduce an original on the surface thereof; the surface of the light-sensitive material should have a high affinity for an oil-desensitizing solution so as to render non-image areas sufficiently hydrophilic and, at the same time, should be water resistant. When used as printing plate, the photoconductive layer having a toner image formed thereon should not come off during printing, and should be well receptive to dampening water so that the non-image areas can remain sufficiently hydrophilic to be free from stains, even after a large number of prints have been reproduced from the plate.

These properties are affected by the proportion of zinc oxide to binder resin in the photoconductive layer as already known. Specifically, when the proportion of zinc oxide particles to binder resin in the photoconductive layer is decreased, the oil-desensitivity of the photoconductive layer surface is enhanced and background stains are decreased. However, the internal cohesive force and mechanical strength of the photoconductive layer itself is lowered resulting in the deterioration of the printing durability. On the contrary, when the proportion of a resin binder is increased, the background stains are increased although the printing durability is heightened. Background stains are related to the oil-desensitivity of the photoconductive layer surface. Not only does the ratio of zinc oxide to binder resin in the photoconductive layer influence the oil-desensitivity, but it has become apparent that the oil-desensitivity also depends greatly on the kind of the binder resin employed.

Known resins for use in photoconductive layers include silicone resins as disclosed in JP-B-34-6670 (the term "JP-B" as used herein means an "examined Japanese patent publication"), styrene-butadiene resins as disclosed in JP-B-35-1950, alkyd resins, maleic acid resins and polyamides as disclosed in JP-B-35-11219, vinyl acetate resins as disclosed in JP-B-41-2425, vinyl acetate copolymers as disclosed in JP-B-41-2426, acryl resins as disclosed in JP-B-35-11216, acrylic acid ester copolymers as disclosed, for example, in JP-B-35-11219, JP-B-36-8510, and JP-B-41-13946. However, electrophotographic light-sensitive materials employing these resins have various problems including (1) low chargeability of the photoconductive layer, (2) poor image reproducibility (in particular, dot reproducibility and resolving power), (3) low photosensitivity, (4) insufficient oil-desensitivity of the photoconductive layer surface resulting in generation of background stains on the prints when offset printing is performed, even when subjected to an oil-desensitizing treatment for producing an offset master, (5) insufficient film strength of the photoconductive layer, resulting in peeling off of the photoconductive layer during offset printing, and a large number of prints can not be obtained, and (6) the image quality is apt to be influenced by the environment at the time of image reproduction (e.g., high temperature and high humidity condition).

With respect to the offset master, the background stain resulting from insufficiency in oil-desensitization is a particularly serious problem. For the purpose of solving this problem, as binder resins for zinc oxide, various binder resins have been developed for improving the oil-desensitivity. Resins having an effect on improvement in oil-desensitivity of the photoconductive layer include those as follows: JP-B-50-31011 discloses the combination of a resin having a weight average molecular weight of from $1.8\times10^4$ to $1.0\times10^5$ and a glass transition point (Tg) of from 10° C. to 80° C., and which is prepared by copolymerizing a (meth)acrylate monomer and another monomer in the presence of fumaric acid, with a copolymer prepared from a (meth)acrylate monomer and a monomer other than fumaric acid; JP-A-53-54027 (the term "JP-A" as used herein means an "unexamined published Japanese patent application") discloses a terpolymer comprising a (meth)acrylic acid ester unit having a substituent which contains a carboxylic acid group apart from the ester linkage by at least 7 atoms; JP-A-54-20735 and JP-A-57-202544 disclose a tetra- or penta-polymer comprising an acrylic acid unit and a hydroxyethyl (meth)acrylate unit; and JP-A-58-68046 discloses a tercopolymer comprising a (meth)acrylic acid ester unit having an alkyl group containing from 6 to 12 carbon atoms as a substituent and a vinyl monomer containing a carboxylic acid group. However, even with the practical use of the above-described resins, which are described to enhance oil-desensitivity, the resulting offset masters are still insufficient in resistance to background stains and printing durability.

On the other hand, resins of the type which contain functional groups capable of producing hydrophilic groups through decomposition have been investigated on an aptitude for the resin binder. For example, the resins containing functional groups capable of producing hydroxy groups by decomposition are disclosed in JP-A-62-195684, JP-A-62-210475 and JP-A-62-258476, those containing functional groups capable of producing carboxy groups through decomposition are disclosed in JP-A-62-212669, JP-A-1-63977 and JP-A-62-286064, and those containing functional groups capable of producing hydroxy groups or carboxy groups through decomposition and having crosslinking structure therebetween which restrains the solubility thereof in water and impart water swellability thereto, whereby the prevention of background stains and the printing durability are furthermore improved as disclosed in JP-A-1-191157, JP-A-1-197765, JP-A-1-191860, JP-A-1-185667, JP-A-1-179052 and JP-A-1-191158.

However, when these resins are practically employed as the binder resin of lithographic printing plate precursor in an amount sufficient to increase the hydrophilic property of the non-image areas and to prevent background stains, the electrophotographic characteristics (particularly, dark charge retention property and photosensitivity) are fluctuated and good duplicated images can not be stably obtained sometimes in a case wherein the environmental conditions at the image formation are changed to high temperature and high humidity or to low temperature and low humidity. As a result, the printing plate precursor provides prints of poor image or having background stains.

Further, when a scanning exposure system using a semiconductor laser beam is applied to digital direct type electrophotographic lithographic printing plate precursor, the exposure time becomes longer and also there is a restriction on the exposure intensity as compared to a conventional overall simultaneous exposure system using a visible light, and hence a higher performance has been required for the electrostatic characteristics, in particular, the dark charge retention property and photosensitivity.

However, when the above-described lithographic printing plate precursors containing known resins are employed in the scanning exposure system described above, the electrophotographic, characteristics degrade, and the occurrence of background fog, cutting of fine lines and spread of letters are observed in the duplicated image obtained. As a result, when they are employed as printing plates, the image quality of prints obtained becomes poor, and the effect of preventing background stains owing to the increase in hydrophilic property in the non-image areas due to the binder resin is lost.

SUMMARY OF THE INVENTION

Therefore, an object of the present invention is to provide an electrophotographic lithographic printing plate precursor having excellent electrostatic characteristics (particularly, dark charge retention property and photosensitivity), capable of reproducing a faithful duplicated image to the original, forming neither overall background stains nor dotted background stains on prints, and showing excellent printing durability.

Another object of the present invention is to provide an electrophotographic lithographic printing plate precursor effective for a scanning exposure system using a semiconductor laser beam.

Other objects of the present invention will become apparent from the following description and examples.

It has been found that the above described objects of the present invention can be accomplished by an electrophotographic lithographic printing plate precursor which utilizes an electrophotographic light-sensitive material comprising a conductive support having provided thereon at least one photoconductive layer containing photoconductive zinc oxide and a binder resin, wherein the binder resin contains at least one graft-type copolymer comprising at least (1) a monofunctional monomer containing a functional group which has at least one atom selected from a fluorine atom and a silicon atom and is capable of forming at least one hydrophilic group selected from a sulfo group, a phosphono group, a carboxy group and a hydroxy group through decomposition, and (2) a monofunctional macromonomer which has a weight average molecular weight of from $1\times10^3$ to $2\times10^4$, and has a polymerizable double bond group represented by the general formula (I) described below bonded to only one terminal of the main chain thereof.

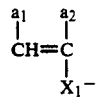

(I)

wherein $X_1$ represents —COO—, —OCO—, $-(CH_2)_nOCO-$, $-(CH_2)_mCOO-$, —O—, $-SO_2-$, —CO—,

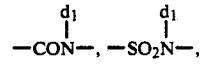

—CONHCOO—, —CONHCONH—, or

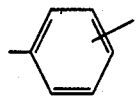

(wherein $d_1$ represents a hydrogen atom or a hydrocarbon group; and n and m each represents an integer of from 1 to 4); and $a_1$ and $a_2$, which may be the same or different, each represents a hydrogen atom, a halogen atom, a cyano group, a hydrocarbon group, —COO—$Z_1$ or —COO—$Z_1$ bonded via a hydrocarbon group (wherein $Z_1$ represents a hydrocarbon group which may be substituted).

DETAILED DESCRIPTION OF THE INVENTION

The present invention is characterized in that the binder resin of the photoconductive layer of the lithographic printing plate precursor comprises the graft-type copolymer comprising at least the monofunctional monomer containing a functional group which has a fluorine atom or a silicon atom and is capable of forming at least one hydrophilic group including a sulfo group, a phosphono group, a carboxy group and a hydroxy group through decomposition and the monofunctional macromonomer. The lithographic printing plate precursor according to the present invention has superior characteristics in that it reproduces duplicated images faithful to the original, in that it does not generate background stains owing to a good hydrophilic property of the non-image areas, in that it has excellent smoothness of the photoconductive layer and excellent electrostatic characteristics, and in that it has good printing durability.

Moreover, the lithographic printing plate precursor of the present invention is not influenced by environmental conditions during the plate-making process, and is excellent in preservability before the plate-making process.

In a lithographic printing plate, it is important to render the surface portions of the non-image areas thereof sufficiently hydrophilic. The above described known resin which forms a hydrophilic group through decomposition is uniformly dispersed throughout in the photoconductive layer. Therefore, a large amount of the hydrophilic group-forming functional groups are present throughout the photoconductive layer in order to obtain the sufficiently hydrophilic surface thereof. As a result, it is believed that the adequate interaction between photoconductive zinc oxide and the binder resin can not be sufficiently maintained, and the electrophotographic characteristics degrade when the environmental conditions are changed or in a case of conducting a scanning exposure system.

On the contrary, the binder resin according to the present invention is characterized by using the graft-type copolymer composed of a polymerizable component containing a functional group capable of forming a hydrophilic group through decomposition which is protected by a protective group containing a fluorine atom and/or a silicon atom (hereinafter sometimes referred to as Segment A) and a polymerizable component corresponding to the monofunctional macromonomer (hereinafter sometimes referred to as Segment B). The resin according to the present invention exhibits the specific behavior in the photoconductive layer different from conventionally known random copolymers. More specifically, when the resin according to the present invention is employed as a binder resin, it is believed that the adequate interaction between Segment B and photoconductive zinc oxide occurs to maintain the excellent electrophotographic characteristics, and on the other hand, a micro-phase-separation structure due to the difference in compatibility between Segment A and Segment B is formed. Moreover, since Segments A which form hydrophilic groups upon decomposition are apt to partially present in the surface portion of the photoconductive layer, the effect for rendering the non-image areas hydrophilic is accelerated, which results in the prevention of background stains on the prints.

Furthermore, when the resin according to the present invention is subjected to the oil-desensitizing treatment to form hydrophilic groups, Segments A which are hydrophilic are oriented to the surface, and on the contrary, Segments B which are relatively oleophilic are oriented to the inner portion of the photoconductive layer to interact with other binder resins and/or zinc oxide. Due to such an anchor effect, the resin is prevented from dissolving into the etching solution and/or dampening water used during printing, and as a result the good hydrophilic property of the non-image areas can be properly maintained to provide a large number of prints having good image quality.

Now, the monofunctional monomer containing the functional group capable of forming a hydrophilic group (hereinafter sometimes referred to as monomer (A)) will be described in detail below.

The functional group containing a fluorine atom and/or a silicon atom and being capable of forming at least one hydrophilic group through decomposition (hereinafter simply referred to as a hydrophilic group-forming functional group sometimes) is described below.

The hydrophilic group-forming functional group according to the present invention forms a hydrophilic group through decomposition, and one or more hydrophilic groups may be formed from one functional group.

In accordance with a preferred embodiment of the present invention, the graft-type copolymer containing the hydrophilic group-forming functional group is a resin containing at least one kind of functional group represented by the general formula (IV), (V), (VI) or (VII) described below in the main chain of the graft-type copolymer.

According to a preferred embodiment of the present invention, the functional group capable of forming —COOH, $-SO_3H$ or $-PO_3H_2$ is represented by the following general formula (IV):

$$-V-O-L_1$$

wherein V represents

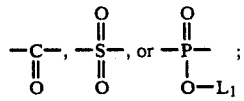

and $L_1$ represents $-CF_3$,

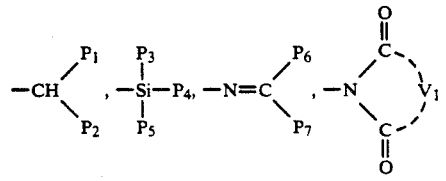

or $-(CH_2)_2SO_2P_8$.

When $L_1$ represents

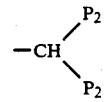

$P_1$ represents a hydrogen atom, —CN, $-CF_3$, $-COR_{11}$ or $-COOR_{11}$ (wherein $R_{11}$ represents an alkyl group having from 1 to 6 carbon atoms which may be substituted (e.g., methyl, ethyl, propyl, butyl, pentyl, or hexyl), an aralkyl group having 7 to 12 carbon atoms which may be substituted (e.g., benzyl, phenethyl, chlorobenzyl, methoxybenzyl, chlorophenethyl, or methylphenethyl), an aromatic group (e.g., a phenyl or naphthyl group which may be substituted such as phenyl, chlorophenyl, dichlorophenyl, methylphenyl, methoxyphenyl, acetylphenyl, acetamidophenyl, methoxycarbonylphenyl, or naphthyl), $-(CH_2)_{n1}(CF_2)_{m1}CF_2H$ (wherein $n_1$ represents an integer of 1 or 2; and $m_1$ represents an integer of from 1 to 8), $-(CH_2)_{n2}C_{m2}H_{2m2+1}$ (wherein $n_2$ represents an integer of from 0 to 2; and $m_2$ represents an integer of from 1 to 8), or

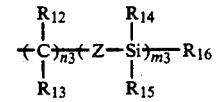

(wherein $n_3$ represents an integer of from 1 to 6; m3 represents an integer of from 1 to 4; Z represents a mere bond or —O—; $R_{12}$ and $R_{13}$, which may be the same or different, each represents a hydrogen atom, or an alkyl group having from 1 to 4 carbon atoms (e.g., methyl, ethyl, propyl, or butyl); $R_{14}$, $R_{15}$ and $R_{16}$, which may be the same or different, each represents a hydrocarbon group having from 1 to 12 carbon atoms which may be substituted or $-OR_{17}$ (wherein $R_{17}$ represents a hydrocarbon group having from 1 to 12 carbon atoms which may be substituted). Specific examples of the hydrocarbon group for $R_{14}$, $R_{15}$, $R_{16}$ or $R_{17}$ include those described for $R_{11}$ above.

$P_2$ represents $-CF_3$, $-COR_{11}$ or $-COOR^{11}$ (wherein $R_{11}$ has the same meaning as defined above).

Further, at least one of $P_1$ and $P_2$ is selected from the fluorine or silicon atom-containing substituents.

When $L_1$ represents

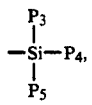

$P_3$, $P_4$, and $P_5$, which may be the same or different, each has the same meaning as $R_{14}$, $R_{15}$ or $R_{16}$.

When $L_1$ represents

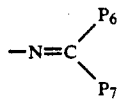

$P_6$ and $P_7$, which may be the same or different, each has the same meaning as $R_{11}$), provided that at least one of $P_6$ and $P_7$ is selected from the fluorine or silicon atom-containing substituents.

When $L_1$ represents $-(CH_2)_2SO_2P_8$, $P_8$ represents $-(CH_2)_{n1}(CF_2)_{m1}-CF_2H$, $-(CH_2)_{n2}-C_{m2}H_{2m2+1}$ or

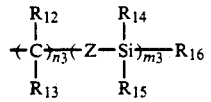

(wherein $n_1$, $m_1$, $n_2$, $m_2$, $n_3$, $m_3$, $R_{12}$, $R_{13}$, $R_{14}$, $R_{15}$ and $R_{16}$ each has the same meaning as defined above).

When $L_1$ represents

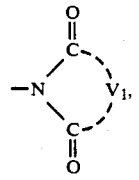

$V_1$ represents an organic moiety necessary to form a cyclic imido group having a substituent containing a fluorine atom and/or a silicon atom. Specific examples of the cyclic imido group include a maleimido group, a glutaconimido group, a succinimido group, and phthalimido group. Specific examples of the substituent containing a fluorine atom and/or a silicon atom include the hydrocarbon groups represented by $P_8$ and $-S-P_9$ (wherein $P_9$ has the same meaning as $P_8$).

According to another preferred embodiment of the present invention, the functional group capable of forming a hydroxy group is represented by the following general formula (V), (VI) or (VII):

$$-O-L_2 \qquad (V)$$

wherein $L_2$ represents

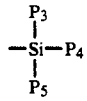

(wherein $P_3$, $P_4$ and $P_5$ each has the same meaning as defined above),

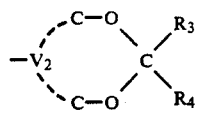

(VI)

wherein $R_3$ and $R_4$, which may be the same or different, each represents a hydrogen atom, or has the same meaning as $R^{11}$ (provided that at least one of $R_3$ and $R_4$ is selected from the fluorine or silicon atom-containing substituents); and $V_2$ represents a carbon-carbon chain in which a hetero atom may be introduced (provided that the number of atoms present between the two oxygen atoms does not exceed 5,

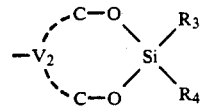

(VII)

wherein $V_2$, $R_3$ and $R_4$ each has the same meaning as defined above.

Specific examples of the functional groups represented by the general formula (IV), (V), (VI) or (VII) described above are set forth below, but the present invention should not be construed as being limited thereto.

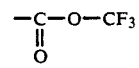

(1)

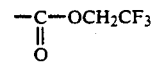

(2)

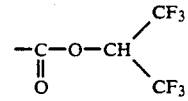

(3)

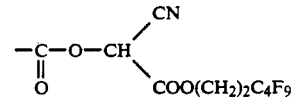

(4)

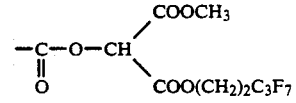

(5)

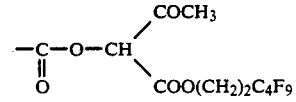

(6)

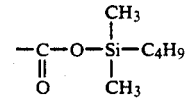

(7)

-continued (8) $-\underset{\underset{O}{\|}}{C}-O-Si(C_3H_7)_3$ (9) $-\underset{\underset{O}{\|}}{C}-O-N=C(CF_3)_2$

(10) $-\underset{\underset{O}{\|}}{C}-O-N=C(CF_3)(C_6H_5)$

(11) $-SO_2-O-CH(COCF_3)(COOC_2H_5)$

(12) $-SO_2-O-N=C(CF_3)_2$

(13) $-SO_2-O-N=C(CF_3)(C_6H_5)$

(14) $-SO_2-O-CF_3$

(15) $-SO_2-O-(CH_2)_2SO_2CF_3$

(16) $-SO_2-O-(CH_2)_2SO_2CH_2CF_3$

(17) $-SO_2-O-(CH_2)_2SO_2(CH_2)_2C_3F_7$

(18) $-SO_2-O-(CH_2)_2SO_2CH(CF_3)_2$

(19) 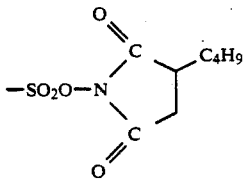

(20) 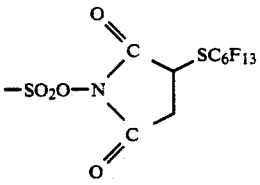

(21) 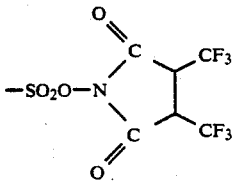

(22) $-\overset{\overset{O}{\|}}{P}(O(CH_2)_2SO_2CF_3)_2$

-continued

(23) $-\overset{\overset{O}{\|}}{P}(OCH(CF_3)_2)_2$

(24) $-O-Si(C_2H_5)_3$

(25) $-O-Si(CH_3)_2-C_3H_7$

(26) $-O-Si(C_2H_5)_2-C_4H_9$

(27) 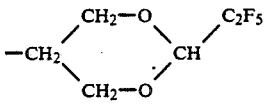

(28) 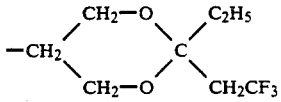

(29) 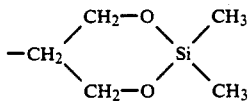

(30) 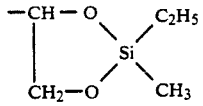

(31) $-\underset{\underset{O}{\|}}{C}-O-CH(COCH_3)(COO(CH_2)_2Si(CH_3)_3)$

(32) $-\overset{\overset{O}{\|}}{P}(OSi(C_3H_7)_3)_2$

(33) $-SO_2O-N=C(CF_3)(CH_2CF_3)$

The polymerizable component containing the functional group of the general formula (IV), (V), (VI) or (VII) to be used, as described above, in preparing the desired resin by a polymerization reaction includes, for example, a component represented by the following general formula (VIII).

(VIII) $CH(c_1)=C(c_2)-X'-Y'-W$ wherein X' represents —O—, —CO—, —COO—, —OCO—, $-N(e_1)CO-$, $-CON(e_2)-$, $-SO_2-$, $-SO_2N(e_3)-$, $-N(e_4)SO_2-$, -continued

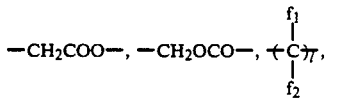

an aryl group, or a heterocyclic group (wherein $e_1$, $e_2$, $e_3$ and $e_4$ each represents a hydrogen atom, a hydrocarbon group, or —Y'—W; $f_1$ and $f_2$, which may be the same or different, each represents a hydrogen atom, a hydrocarbon group, or —Y'—W; and l is an integer of from 0 to 18); Y' represents carbon-carbon bond(s) for connecting the linkage group X' to the functional group W, between which one or more hetero atoms (e.g., oxygen, sulfur, nitrogen) may be present, specific examples including

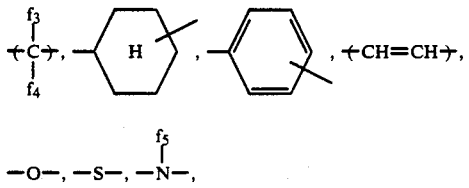

—COO—, —CONH—, $—SO_2—$, $—SO_2NH—$, —NHCOO—, —NHCONH— (wherein $f_3$, $f_4$ and $f_5$ each has the same meaning as $f_1$ or $f_2$ described above), and a combination thereof; W represents a functional group such as one represented by the general formula (IV), (V), (VI) or (VII); and $c_1$ and $c_2$, which may be the same or different, each represents a hydrogen atom, a halogen atom (e.g., chlorine or bromine), a cyano group, a hydrocarbon group (e.g., an alkyl group containing from 1 to 12 carbon atoms which may be substituted such as methyl, ethyl, propyl, butyl, methoxycarbonylmethyl, ethoxycarbonylmethyl, or butoxycarbonylmethyl, an aralkyl group such as benzyl, or phenethyl, or an aryl group such as phenyl, tolyl, xylyl, or chlorophenyl) or $—COOZ_0$ (wherein $Z_0$ represents an alkyl group containing from 1 to 18 carbon atoms, an alkenyl group, an aralkyl group, an alicyclic group or an aryl group, each of which may be substituted with a group containing the functional group W).

Further, in the general formula (VIII), the moiety of —X'—Y'— may not be present. In such a case, W is directly bonded to

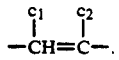

The monofunctional macromonomer (hereinafter sometimes referred to as macromonomer (M)) which is a copolymerizable component of the graft-type copolymer according to the present invention is described hereinafter in greater detail.

The macromonomer (M) is a macromonomer having a weight average molecular weight of from $1\times10^3$ to $2\times10^4$, and having a polymerizable double bond group represented by the general formula (I) bonded to only one terminal of the main chain thereof.

According to one embodiment of the present invention, the macromonomer (M) comprises at least a polymerizable component corresponding to a repeating unit represented by the general formula (IIa) or (IIb) described below.

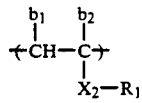

(IIa)

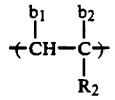

(IIb)

wherein $X_2$ has the same meaning as $X_1$ in the general formula (I); $R_1$ represents an aliphatic group having from 1 to 18 carbon atoms or an aromatic group having from 6 to 12 carbon atoms; $b_1$ and $b_2$, which may be the same or different, each has the same meaning as $a_1$ or $a_2$ in the general formula (I); and $R_2$ represents —CN, $—CONH_2$, or

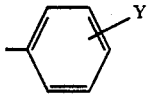

wherein Y represents a hydrogen atom, a halogen atom, a hydrocarbon group, an alkoxy group, or $—COOZ_2$ (wherein $Z_2$ represents an alkyl group, an aralkyl group, or an aryl group). This type of macromonomer is sometimes referred to as macromonomer (MA) hereinafter.

In the above described general formulae (I), (IIa), and (IIb), the hydrocarbon groups represented by or included in $a_1$, $a_2$, $X_1$, $b_1$, $b_2$, $X_2$, $R_1$, and $R_2$ each has the number of carbon atoms described above (as unsubstituted hydrocarbon group) and these hydrocarbon groups may have one or more substituents.

In the general formula (I), $X_1$ represents —COO—, —OCO—, $-(CH_2)_n-OCO-$, $-(CH_2)_m-COO-$, —O—, $—SO_2—$, —CO—, —CONHCOO—, —CONHCONH—,

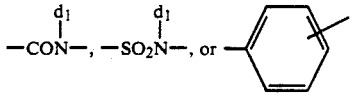

wherein n and m each represents an integer of from 1 to 4; and $d_1$ represents a hydrogen atom or a hydrocarbon group, and preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $X_1$ represents

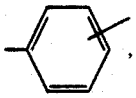

the benzene ring may have a substituent such as, for example, a halogen atom (e.g., chlorine and bromine), an alkyl group (e.g., methyl, ethyl, propyl, butyl, chloromethyl, methoxymethyl) and an alkoxy group (e.g., methoxy, ethoxy, propoxy, and butoxy).

In the general formula (I), $a_1$ and $a_2$, which may be the same or different, each preferably represents a hydrogen atom, a halogen atom (e.g., chlorine and bromine), a cyano group, an alkyl group having from 1 to 4 carbon atoms (e.g., methyl, ethyl, propyl, and butyl), —COO—$Z_1$, or —COO$Z_1$ bonded via a hydrocarbon group (wherein $Z_1$ represents preferably an alkyl group, an alkenyl group, an aralkyl group, an alicyclic group or an aryl group, these groups may be substituted, and specific examples thereof are the same as those described above for $d_1$).

In the general formula (I), —COO—$Z_1$ may be bonded via a hydrocarbon group as above, and examples of such hydrocarbon groups include a methylene group, an ethylene group, and a propylene group.

In the general formula (I), $X_1$ is more preferably —COO—, —OCO—, —$CH_2$OCO—, —$CH_2$COO—, —O—, —CONHCOO—, —CONHCONH-, —CONH—, —$SO_2$NH—, or

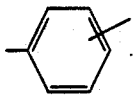

Also, $a_1$ and $a_2$, which may be the same or different, each represents more preferably a hydrogen atom, a methyl group, —COO$Z_1$, or —$CH_2$COO$Z_1$ (wherein $Z_1$ represents more preferably an alkyl group having from 1 to 6 carbon atoms (e.g., methyl, ethyl, propyl, butyl, and hexyl)). Most preferably, one of $a_1$ and $a_2$ represents a hydrogen atom.

That is, specific examples of the polymerizable double bond group represented by the general formula

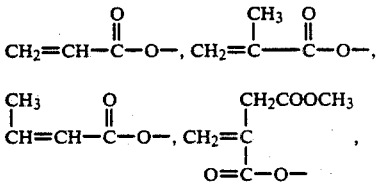

-continued

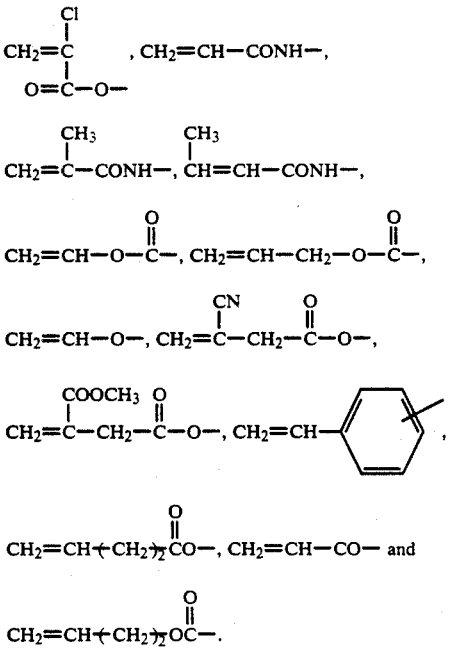

In the general formula (IIa), $X_2$ has the same meaning as $X_1$ in the general formula (I), and $b_1$ and $b_2$, which may be the same or different, each has the same meaning as $a_1$ or $a_2$ in the general formula (I).

$R_1$ represents an aliphatic group having from 1 to 18 carbon atoms or an aromatic group having from 6 to 12 carbon atoms.

Specific examples of the aliphatic group include an alkyl group having from 1 to 18 carbon atoms which may be substituted (e.g., methyl, ethyl, propyl, butyl, pentyl, hexyl, heptyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms which may be substituted (e.g., cyclopentyl, cyclohexyl, and cyclooctyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Also, specific examples of the aromatic group include an aryl group having from 6 to 12 carbon atoms which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In the general formula (IIa), $X_2$ represents preferably —COO—, —OCO—, —$CH_2$COO—, —$CH_2$OCO—, —O—, —CO—, —CONHCOO—, —CONHCONH—, —CONH—, —$SO_2$NH—, or

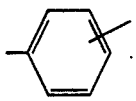

Also, preferred examples of $b_1$ and $b_2$ are same as those described above for $a_1$ and $a_2$ in the general formula (I).

In the general formula (IIb), $R_2$ represents —CN, —$CONH_2$, or

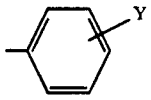

(wherein Y represents a hydrogen atom, a halogen atom (e.g., chlorine and bromine), a hydrocarbon group (e.g., methyl, ethyl, propyl, butyl, chloromethyl, and phenyl), an alkoxy group (e.g., methoxy, ethoxy, propoxy, and butoxy), or —$COO_2$ (wherein $Z_2$ represents an alkyl group having from 1 to 8 carbon atoms, an aralkyl group having from 7 to 12 carbon atoms or an aryl group)).

The macromonomer used in the present invention may have two or more polymerizable components represented by the general formula (IIa) and/or the polymerizable components represented by the general formula (IIb).

Furthermore, when $X_2$ in the general formula (IIa) is —COO—, it is preferred that the proportion of the polymerizable component represented by the general formula (IIa) is at least 30% by weight of the whole polymerizable components in the macromonomer.

In a preferred embodiment of the present invention, the monofunctional macromonomer contains, at random, a polymerizable component containing at least one polar group selected from —COOH, —$PO_3H_2$, —$SO_3H$, —OH,

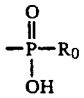

(wherein $R_0$ represents a hydrocarbon group or —$OR_0'$ (wherein $R_0'$ represents a hydrocarbon group)), —CHO and a cyclic acid anhydride-containing group in adition to the polymerizable component represented by the general formula (IIa) or (IIb). This type of macromonomer is sometimes referred to as macromonomer (MB) hereinafter.

As the polar group-containing component, any vinyl compounds having the above described polar group capable of copolymerized with the polymerizable component represented by the general formula (IIa) or (IIb) can be used.

Examples of these vinyl compounds are described, for example, in *Kobunshi Data Handbook* (*Kisohen*), edited by Kobunshi Gakkai, Baifukan (1986).

Specific examples thereof include acrylic acid, an α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and compounds having the acidic group in the substituent of ester derivatives or amido derivatives of these carboxylic acids or sulfonic acids.

In the

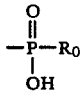

represents a hydrocarbon group or —$OR_0'$ (wherein $R_0'$ represents a hydrocarbon group), and, preferably, $R_0$ and $R_0'$ each represents an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridine-dicarboxylic acid anhydride ring and thiophenedicarboxyic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The —OH group include a hydroxy group of alcohols containing a vinyl group or allyl group (e.g., allyl alcohol), a hydroxy group of (meth)acrylates containing —OH group in an ester substituent thereof, a hydroxy group of (meth)acrylamides containing —OH group in an N-substituent thereof, a hydroxy group of hydroxy-substituted aromatic compounds containing a polymerizable double bond, and a hydroxy group of (meth)acrylic acid esters and amides each having a hydroxyphenyl group as a substituent.

Specific examples of the polymerizable component having the polar group described above are set forth below, but the present invention should not be construed as being limited thereto. In the following formulae, $Q_1$ represents —H, —$CH_3$, Cl, —Br, —CN, —$CH_2COOCH_3$, or —$CH_2COOH$; $Q_2$ represents —H or —$CH_3$; j represents an integer of from 2 to 18; k represents an integer of from 2 to 5; h represents an integer of from 1 to 4; and g represents an integer of from 1 to 12.
(B-1)
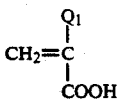
(B-2)
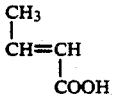
(B-3)
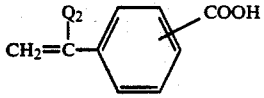
(B-4)
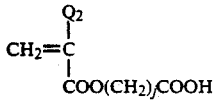
(B-5)
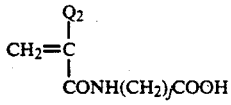
(B-6)
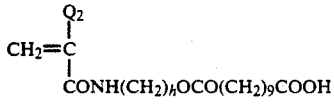
(B-7)
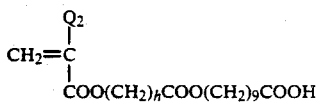
(B-8)
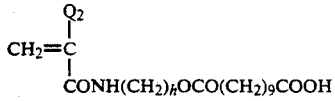
(B-9)
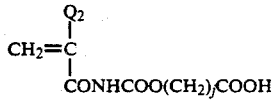
(B-10)
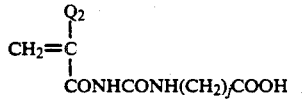
(B-11)
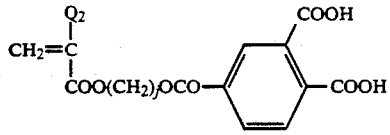
(B-12)
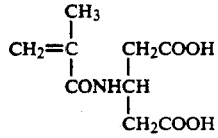
(B-13)
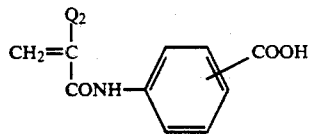
-continued
(B-14)
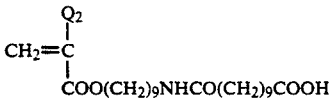
(B-15)
$CH_2=CH-CH_2OCO(CH_2)_9COOH$
(B-16)
$CH_2=CH\text{-}(CH_2)_h\text{-}COOH$
(B-17)
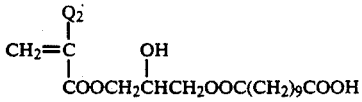
(B-18)
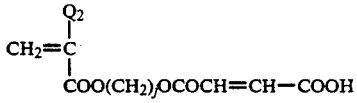
(B-19)
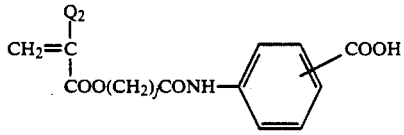
(B-20)
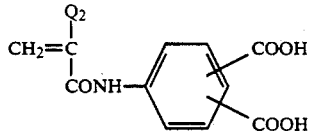
(B-21)
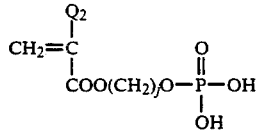
(B-22)
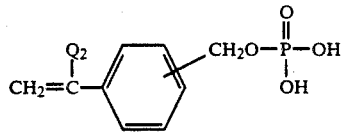
(B-23)
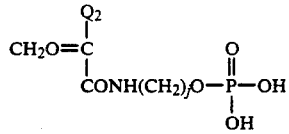
(B-24)
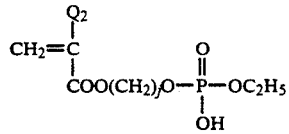
(B-25)
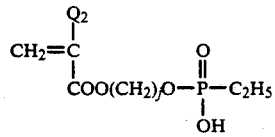
(B-26)
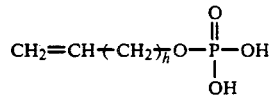

-continued
(B-27)
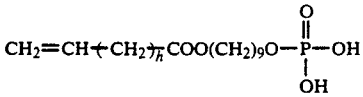
(B-28)
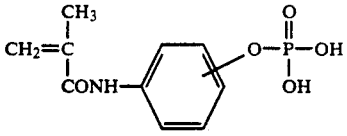
(B-29)
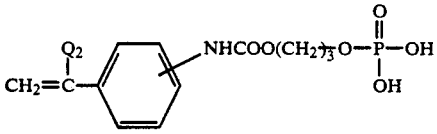
(B-30)
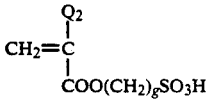
(B-31)
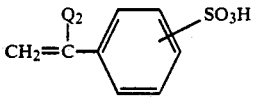
(B-32)
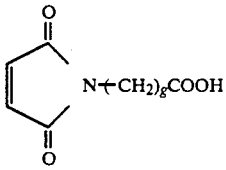
(B-33)
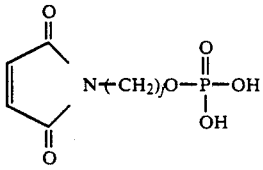
(B-34)
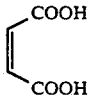
(B-35)
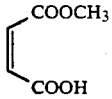
(B-36)
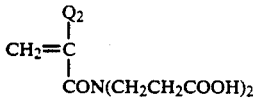
(B-37)
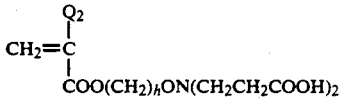
(B-38)
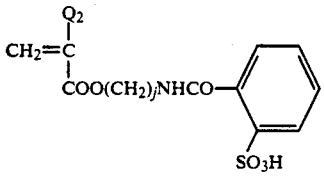
-continued
(B-39)
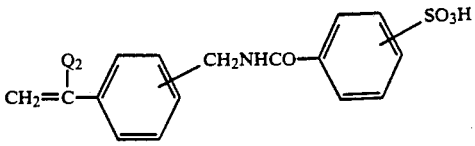
(B-40)
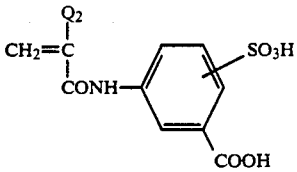
(B-41)
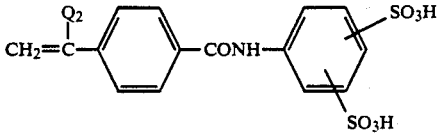
(B-42)
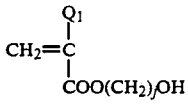
(B-43)
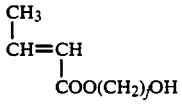
(B-44)
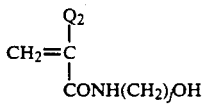
(B-45)
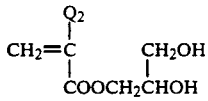
(B-46)
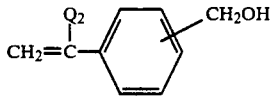
(B-47)
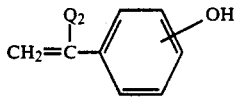
(B-48)
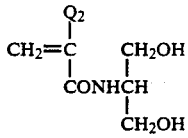
(B-49)
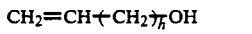
(B-50)
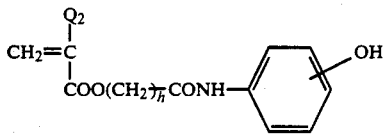
(B-51)
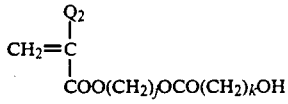

-continued $CH_2{=}CH{\leftarrow}CH_2{\rightarrow}_h OCO(CH_2{\rightarrow}_j OH$ (B-52)

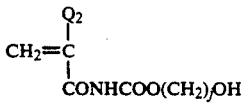
(B-53)

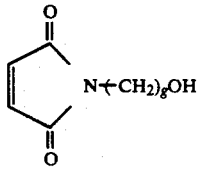
(B-54)

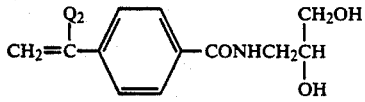
(B-55)

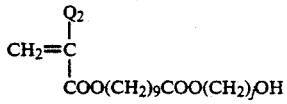
(B-56)

The content of the above described polymerizable component having the polar group contained in the macromonomer (MB) is preferably from 0.5 to 50 parts by weight, and more preferably from 1 to 40 parts by weight per 100 parts by weight of the total polymerizable components.

The macromonomer may further contain other polymerizable component(s) in addition to the polymerizable components represented by the general formula (IIa) and/or (IIb), and the optional polar group-containing component. Suitable examples of monomers corresponding to such copolymerizable components include acrylonitrile, methacrylonitrile, acrylamides, methacrylamides, styrene, styrene, derivatives (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyridine, vinylimidazole, vinylpyrrolidone, vinylthiophene, vinylpyrazole, vinyldioxane, and vinyloxazine).

When the macromonomer contains other monomers described above, the content of the monomer is preferably from 1 to 20 parts by weight per 100 parts by weight of the total polymerizable components in the macromonomer.

In another preferred embodiment of the present invention, the monofunctional macromonomer is composed of an AB block copolymer composed of an A block comprising at least one polymerizable component containing at least one acidic group selected from $-PO_3H_2$, —COOH, $SO_3H$, —OH,

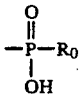

(wherein $R_0'$ represents a hydrocarbon group or $-OR_0'$ (wherein $R_0'$ represents a hydrocarbon group)) and a cyclic acid anhydride-containing group, and a B block containing at least one polymerizable component represented by the general formula (IX) described below and having a polymerizable double bond group bonded to the terminal of the main chain of the B block polymer.

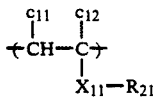
(IX)

wherein $c_{11}$ and $c_{12}$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrocarbon group); $X_{11}$ represents —COO—, —OCO—, $-(CH_2)_{l1}$ OCO—, $-(CH_2)_{l2}$COO— (wherein $l_1$ and $l_2$ each represents an integer of from 1 to 3), —O—, $-SO_2-$, —CO—,

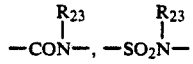

(wherein $R_{23}$ represents a hydrogen atom or a hydrocarbon group), —CONHCOO—, —CONHCONH—, or

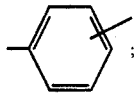
;

and $R_{21}$ represents a hydrocarbon group, provided that, when $X_{11}$ represents

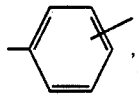
, $R_{21}$ represents a hydrogen atom or a hydrocarbon group. This type of macromonomer is sometimes referred to as macromonomer (MC) hereinafter.

The acidic group contained in the component which constitutes the A block of the macromonomer (MC) includes $-PO-_2$, —COOH, $-SO_3H$, —OH,

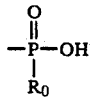

(wherein $R_0$ represents a hydrocarbon group or $-OR_0'$ (wherein $R_0'$ represents a hydrocarbon group)), and a cyclic acid anhydride-containing group, and the preferred acidic groups are —COOH, $-SO_3H$, —OH, and

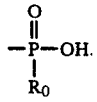
.

The —OH,

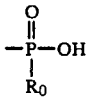

and cyclic acid anhydride-containing group each has the same meaning as described in the macromonomer (MB) above.

Specific examples of the polymerizable components having the acidic group are illustrated below, but the present invention should not be construed as being limited thereto.

In the following formulae, $P_1$ represents H or $CH_3$; $P_2$ represents H, $CH_3$, or $CH_2COOCH_3$; $R_{12}$ represents an alkyl group having from 1 to 4 carbon atoms; $R_{13}$ represents an alkyl group having from 1 to 6 carbon atoms, a benzyl group, or a phenyl group; c represents an integer of from 1 to 3; d represents an integer of from 2 to 11; e represents an integer of from 1 to 11; f represents an integer of from 2 to 4; and g represents an integer of from 2 to 10.

i-1)

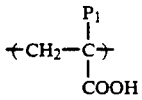

i-2)

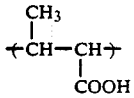

i-3)

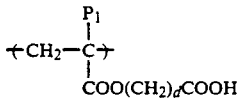

i-4)

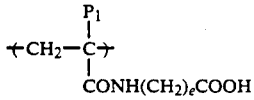

i-5)

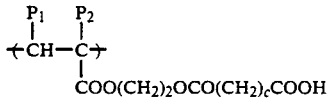

i-6)

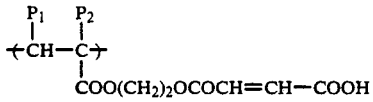

i-7)

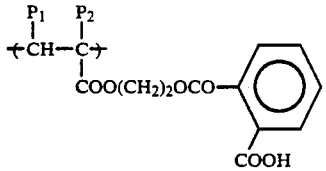

i-8)

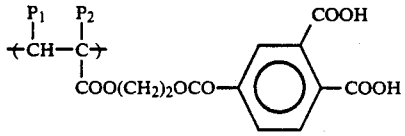

i-9)

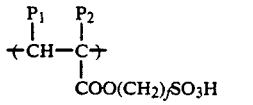

-continued i-10)

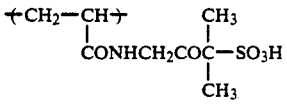

i-11)

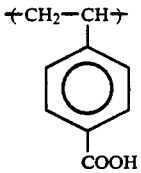

i-12)

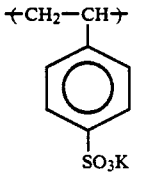

i-13)

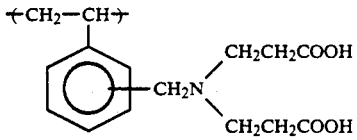

i-14)

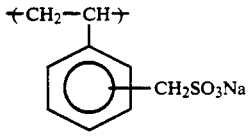

i-15)

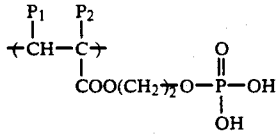

i-16)

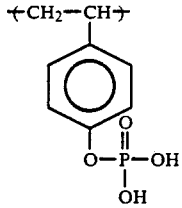

i-17)

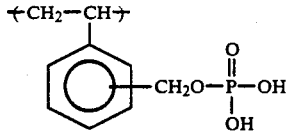

i-18)

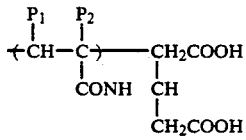

i-19)

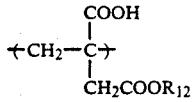

i-20)

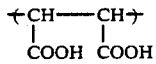

-continued i-21)

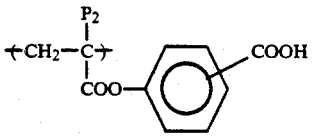

i-22)

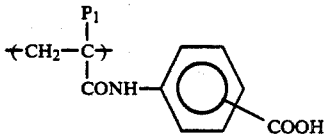

i-23)

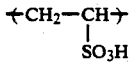

i-24)

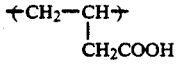

i-25)

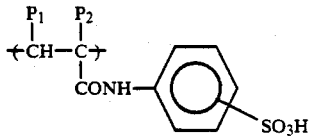

i-26)

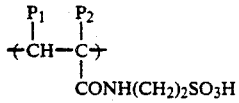

i-27)

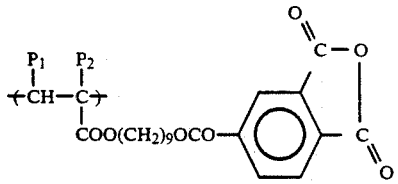

i-28)

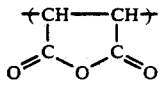

i-29)

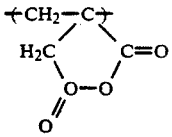

i-30)

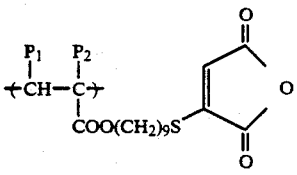

i-31)

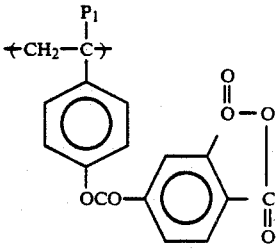

-continued i-32)

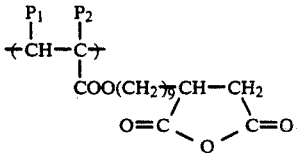

i-33)

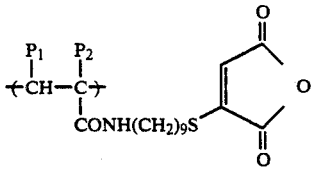

i-34)

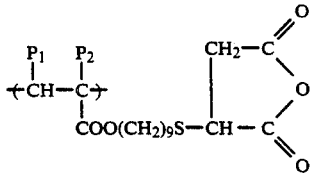

i-35)

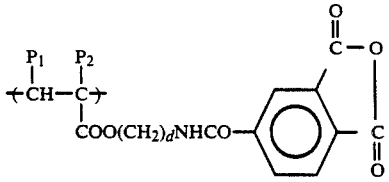

i-36)

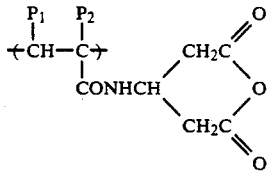

i-37)

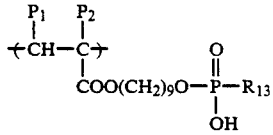

i-38)

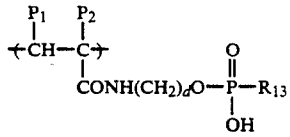

Two or more kinds of the above-described polymerizable components each containing the specific acidic group can be included in the A block. In such a case, two or more kinds of these acidic group-containing polymerizable components may be present in the form of a random copolymer or a block copolymer.

Also, other components having no acidic group may be contained in the A block, and examples of such components include the components represented by the genaral formula (IX) described in detail below. The content of the component having no acidic group in the A block is preferably from 0 to 50% by weight, and more preferably from 0 to 20% by weight. It is most preferred that such a component is not contained in the A block.

Now, the polymerizable component constituting the B block in the monofunctional macromonomer of the graft type copolymer used in the present invention will be explained in more detail below.

The components constituting the B block in the macromonomer (MC) include at least a repeating unit represented by the general formula (IX) described above.

In the general formula (IX), $X_{11}$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—, $$-\overset{R_{23}}{\overset{|}{C}}ON-,\ -SO_2\overset{R_{23}}{\overset{|}{N}}-,$$

—CONHCOO—, —CONHCONH—, or

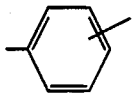

(wherein $R_{23}$ represents a hydrogen atom or a hydrocarbon group).

Preferred examples of the hydrocarbon group represented by $R_{23}$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (IX), $R_{21}$ represents a hydrocarbon group, and preferred examples thereof include those described for $R_{23}$. When $X_{11}$ represents

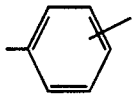

in the general formula (IX), $R_{21}$ represents a hydrogen atom or a hydrocarbon group.

When $X_{11}$ represents

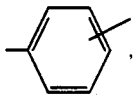

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (IX), $c_{11}$ and $c_{12}$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), $-COO-R_{24}$ or $-COO-R_{24}$ bonded via a hydrocarbon group, wherein $R_{24}$ represents a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_{23}$ above. The hydrocarbon group via which $-COO-R_{24}$ is bonded includes, for example, a methylene group, an ethylene group, and a propylene group.

More preferably, in the general formula (IX), $X_{11}$ represents —COO—, —OCO—, $-CH_2OCO-$, $-CH_2COO-$, —O—, —CONH—, $-SO_2HN-$ or

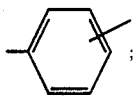

and $c_{11}$ and $c_{12}$, which may be the same or different, each represents a hydrogen atom, a methyl group, $-COOR_{24}$, or $-CH_2COOR_{24}$, wherein $R_{24}$ represents an alkyl group having from 1 to 6 carbon atoms (e.g., methyl, ethyl, propyl, butyl, and hexyl). Most preferably, either one of $c_{11}$ and $c_{12}$ represents a hydrogen atom.

The B block which is constituted separately from the A block which is composed of the polymerizable component containing the above-described specific acidic group may contain two or more kinds of the repeating units represented by the general formula (IX) described above and may further contain polymerizable components other than these repeating units. When the B block having no acidic group contains two or more kinds of the polymerizable components, the polymerizable components may be contained in the B block in the form of a random copolymer or a block copolymer, but are preferably contained at random therein.

As the polymerizable component other than the repeating units represented by the general formula (IX) which is contained in the B block together with the polymerizable component(s) selected from the repeating units of the general formula (IX), any components copolymerizable with the repeating units of the general formula (IX) can be used.

Suitable examples of monomers corresponding to the repeating unit copolymerizable with the polymerizable component represented by the general formula (IX), as a polymerizable component in the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymerizable components in the B block.

Further, it is preferred that the B block does not contain the polymerizable component containing an acidic group which is a component constituting the A block.

The macromonomer (MA) or (MB) has a chemical structure in which the polymerizable double bond group represented by the general formula (I) is bonded to only one terminal of the main chain of the polymer composed of the repeating unit represented by the general formula (IIa) and/or the repeating unit represented by the general (IIb) and, optionally, the repreating unit having the specific polar group, directly or by an appropriate linkage group.

On the other hand, the macromonomer (MC) has a structure of the AB block copolymer in which a polymerizable double bond group represented by the general formula (I) is bonded to one of the terminals of the B block composed of the polymerizable component represented by the general formula (IX) directly or by an appropriate linkage group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the polymerizable double bond group of the general formula (I) and the component constituting the macromonomer is a mere bond or a linking group selected from

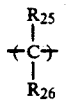

(wherein $R_{25}$ and $R_{26}$ each represents a hydrogen atom, a halogen atom (e.g., fluorine, chlorine, and bromine), a cyano group, a hydroxyl group, or an alkyl group (e.g., methyl, ethyl, and propyl),

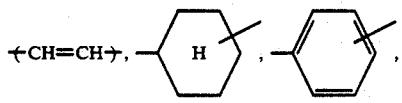

—O—, —S—,

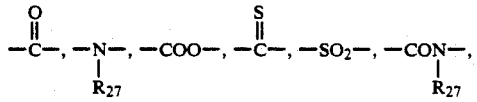

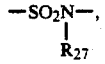

—NHCOO—, —NHCONH— and

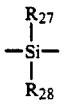

(wherein $R_{27}$ and $R_{28}$ each represents a hydrogen atom or a hydrocarbon group having the same meaning as defined for $R_{21}$ in the general formula (I) described above), and an appropriate combination thereof.

Furthermore, the macromonomer (M) preferably contains from 1 to 20% by weight of a polymerizable component having a heat- and/or photo-curable functional group in addition to the polymerizable components as described above, in view of achieving higher mechanical strength.

The term "heat- and/or photo-curable functional group" as used herein means a functional group capable of inducing curing reaction of a resin on application of at least one of heat and light.

Specific examples of the photo-curable functional group include those used in conventional light-sensitive resins known as photocurable resins as described, for example, in Hideo Inui and Gentaro Nagamatsu, *Kankosei Kobunshi,* Kodansha (1977), Takahiro Tsunoda, *Shin-Kankosei Jushi,* Insatsu Gakkai Shuppanbu (1981), G. E. Green and B. P. Strak, *J. Macro. Sci. Reas. Macro. Chem.,* C 21 (2), pp. 187 to 273 (1981–82), and C. G. Rattey, *Photopolymerization of Surface Coatings,* A. Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka,* C.M.C. (1986), Yuji Harasaki, *Saishin Binder Gijutsu Binran,* Chapter II-I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Kei Jushi,* Techno System (1985).

Specific examples of the heat-curable functional group which can used include —OH, —SH, —$NH_2$, —$NHR_a$ (wherein $R_a$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cycloheptyl and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl), and an aryl group which may be substituted (e.g., phenyl, tolyl, xylyl, chlorophenyl, bromophenyl, methoxyphenyl, and naphthyl)),

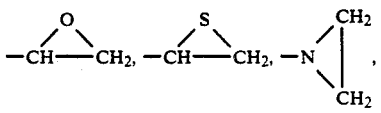

—$CONHCH_2OR_b$ (wherein $R_b$ represents a hydrogen atom or an alkyl group having from 1 to 8 carbon atoms (e.g., methyl, ethyl, propyl, butyl, hexyl, and octyl), $$-N=C=O \text{ and } -\overset{d_9}{\underset{}{C}}=\overset{d_{10}}{C}H$$

(wherein $d_9$ and $d_{10}$ each represents a hydrogen atom, a halogen atom (e.g., chlorine and bromine) or an alkyl group having from 1 to 4 carbon atoms (e.g., methyl and ethyl)).

Other examples of the functional group include polymerizable double bond groups, for example, $CH_2=CH-$, $CH_2=CH-CH_2-$, $$CH_2=CH-\overset{O}{\overset{\|}{C}}-O-,\ CH_2=\overset{CH_3}{\overset{|}{C}}-\underset{\underset{O}{\|}}{C}-O-,$$

$$\overset{CH_3}{\overset{|}{CH}}=CH-\overset{O}{\overset{\|}{C}}-O-,\ CH_2=CH-CONH-,$$

$$CH_2=\overset{CH_3}{\overset{|}{C}}-CONH-,\ \overset{CH_3}{\overset{|}{CH}}=CH-CONH-,$$

$$CH_2=CH-O-\overset{O}{\overset{\|}{C}}-,\ CH_2=\overset{CH_3}{\overset{|}{C}}-O-\overset{O}{\overset{\|}{C}}-,$$

$$CH_2=CH-CH_2-O-\overset{O}{\overset{\|}{C}}-,$$

$CH_2=CH-NHCO-$, $CH_2=CH-CH_2-NHCO-$, $CH_2=CH-SO_2-$, $CH_2=CH-CO-$, $CH_2=CH-O-$, and $CH_2=CH-S-$.

In order to introduce at least one functional group selected from the curable functional groups into the macromonomer according to the present invention, a method comprising introducing the functional group into a polymer by a macromolecular reaction or a method comprising copolymerizing at least one monomer containing at least one of the functional groups with other polymerizable components constituting the macromonomer can be employed.

The above-described macromolecular reaction can be carried out by using conventionally known low molecular synthesis reactions. For the details, reference can be made, for example, to Nippon Kagakukai (ed.), *Shin-Jikken Kagaku Koza*, Vol. 14, "Yuki Kagobutsu no Gosei to Hanno (I) to (V)", Maruzen Co., and Yoshio Iwakura and Keisuke Kurita, *Hannosei Kobunshi*, and literature references cited therein.

The weight average molecular weight of the macromonomer (M) is from $1\times10^3$ to $2\times10^4$, preferably from $3\times10^3$ to $1.5\times10^4$.

If the weight average molecular weight of the monofunctional macromonomer exceeds $2\times10^4$, the copolymerizability with the monofunctional monomer containing the functional group is undesirably lowered. On the other hand, if the molecular weight thereof is too small, the effect for improving the electrophotographic characteristics of the photoconductive layer is reduced, and hence the molecular weight is usually not less than $1\times10^3$.

It is preferred that the monofunctional macromonomer (M) substantially does not contain the hydrophilic group-forming functional group as contained in the monomer (A).

The monofunctional macromonomer which does not contain the polar group- or acidic group-containing component in the main chain used in the present invention can be produced by a conventionally known method such as, for example, a method by an ion polymerization method, wherein a macromonomer is produced by reacting various reagents to the terminal of a living polymer obtained by an anion polymerization or a cation polymerization, a method by a radical polymerization, wherein a macromonomer is produced by reacting various reagents with an oligomer having a reactive group such as a carboxy group, a hydroxy group, or an amino group, at the terminal thereof obtained by a radical polymerization using a polymerization initiator and/or a chain transfer agent each having the reactive group in the molecule, and a method by a polyaddition condensation method of introducing a polymerizable double bond group into an oligomer obtained by a polycondensation reaction or a polyaddition reaction, in the same manner as the above described radical polymerization method.

Specific methods for producing the macromonomer are described, for example, in P. Dreyfuss & R. P. Quirk, *Encycl. Polym. Sci. Eng.*, 7, 551(1987), P. F. Rempp & E. Franta, *Adv. Polym. Sci.*, 58, 1(1984), V. Percec, *Appl. Polym. Sci.*, 285, 95(1984), R. Asami & M. Takaki, *Makromol. Chem. Suppl.*, 12, 163(1985), P. Rempp et al, *Makromol. Chem. Suppl.*, 8, 3(1984), Yusuke Kawakami, *Kagaku Kogyo* (*Chemical Industry*), 38, 56(1987), Yuuya Yamashita, *Kobunshi* (*Macromolecule*), 31, 988(1982), Shio Kobayashi, *Kobunshi* (*Macromolecule*), 30, 625(1981), Toshinobu Higashimura, *Nippon Secchaku Kyokai Shi* (*Journal of Adhesive Society of Japan*), 18, 536(1982), Koichi Ito, *Kobunshi Kako* (*Macromolecule Processing*), 35, 262(1986), and Kishiro Higashi & Takashi Tsuda, *Kino Zairyo* (*Functional Materials*), 1987, No. 10, 5, and the literatures and patents cited therein.

Now, specific examples of the macromonomer, which does not contain the specific polar group- or acidic group-containing component, for use in the present invention are set forth below, but the present invention is not to be constured as being limited thereto.

In the following formulae, $a_1$ represents —H or $-CH_3$; $b_1$ represents —H, $-CH_3$ or $-CH_2COOCH_3$; $b_2$ represents —H or $-CH_3$; $R_1$ represents $-C_nH_{2n+1}$, $-CH_2C_6H_5$, $-C_6H_5$, or

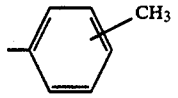

$R_2$ represents $-C_nH_{2n+1}$, $-(CH_2)_mC_6H_5$, or

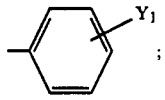

$R_3$ represents $-C_nH_{2n+1}$, $-CH_2C_6H_5$, or $-C_6H_5$; $R_4$ represents $-C_nH_{2n+1}$ or $-CH_2C_6H_5$; $R_5$ represents $-C_nH_{2n+1}$, $-CH_2C_6H_5$, or

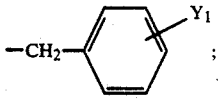

$R_6$ represents $-C_nH_{2n+1}$; $X_1$ represents $-COOCH_3$, $-C_6H_5$, or $-CN$; $X_2$ represents $-OC_nH_{2n+1}$, $-OCOC_{H2n+1}$, $-COOCH_3$, $-C_6H_5$, or $-CN$; $X_3$ represents $-COOCH_3$, $-C_6H_5$,

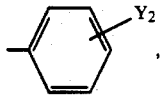

or $-CN$; $X_4$ represents $-Cl$, $-Br$, $-F$, $-OH$ or $-CN$; $X_5$ represents $-OCOC_nH_{2n+1}$, $-CN$, $-CONH_2$, or $-C_6H_5$; $X_6$ represents $-CN$, $CONH_2$, or $-C_6H_5$; $X_7$ represents $-COOCH_3$, $-C_6H_5$, or

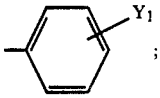

$X_8$ represents $-H$, $-CH_3$, $-Cl$, $-Br$, $-OCH_3$, or $-COOCH_3$; $Y_1$ represents $-CH_3$, $-Cl$, $-Br$, or $-OCH_3$; $Y_2$ represents $-CH_3$, $-Cl$, or $-Br$; n represents an integer of from 1 to 18; m represents an integer of from 1 to 3; p represents an integer of from 2 to 4; and the parenthesized group or the bracketed group shows a repeating unit.

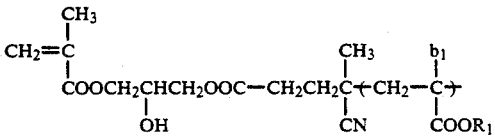

(M-1)

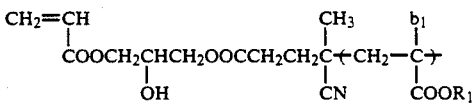

(M-2)

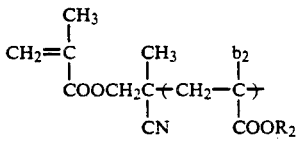

(M-3)

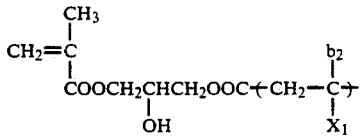

(M-4)

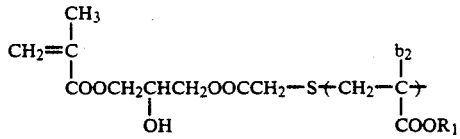

(M-5)

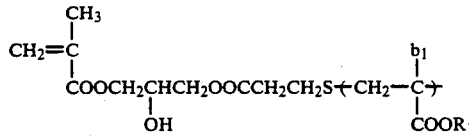

(M-6)

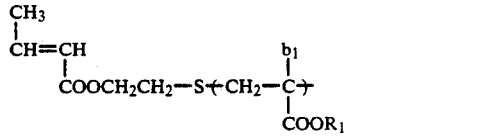

(M-7)

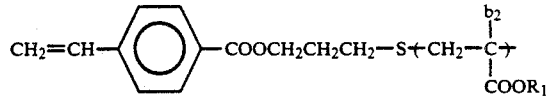

(M-8)

-continued
(M-9)
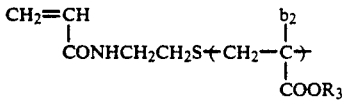
(M-10)
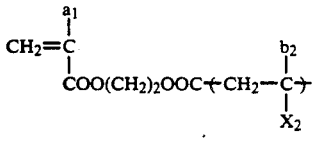
(M-11)
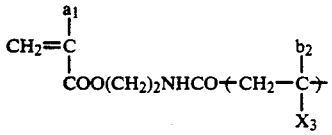
(M-12)
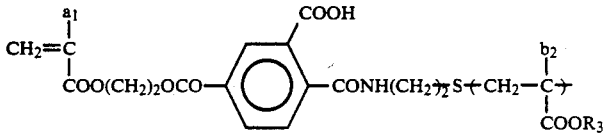
(M-13)
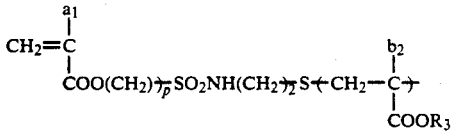
(M-14)
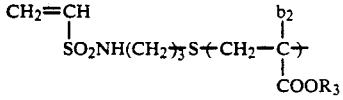
(M-15)
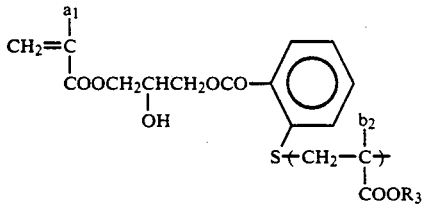
(M-16)
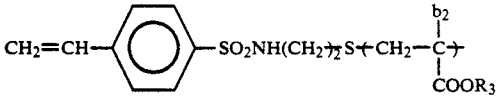
(M-17)
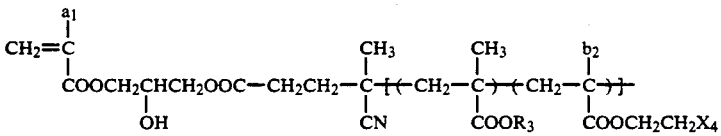
(M-18)
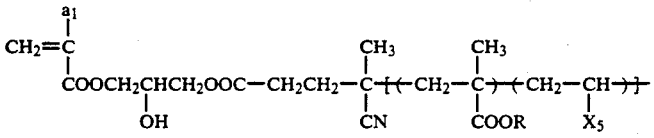
(M-19)
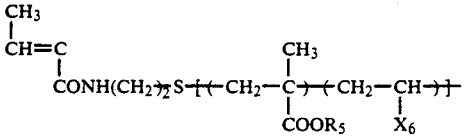

-continued (M-20)

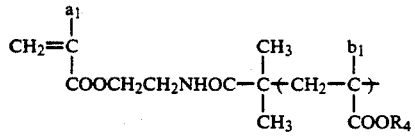

(M-21)

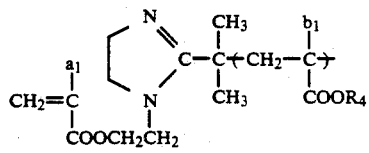

(M-22)

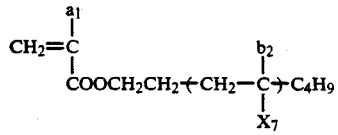

(M-23)

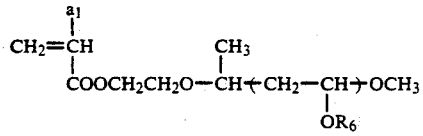

(M-24)

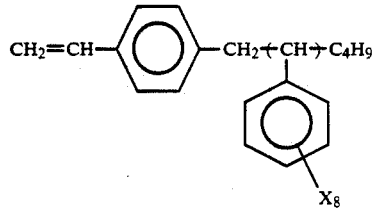

The macromonomer (MB) containing the specific polar group-containing component as a polymerizable component for use in the present invention can be produced by known synthesis methods.

Specifically, the macromonomer can be synthesized by a radical polymerization method of forming the macromonomer by reacting an oligomer having a reactive group bonded to the terminal and various reagents. The oligomer used above can be obtained by a radical polymerization using a polymerization initiator and/or a chain transfer agent each having a reactive group such as a carboxy group, a carboxy halide group, a hydroxy group, an amino group, a halogen atom, or an epoxy group in the molecule thereof.

Specific methods for producing the macromonomer (MB) are described, for example, in P. Dreyfuss & R. P. Quirk, *Encycl. Polym. Sci. Eng.*, 7, 551 (1987), P. F. Rempp & E. Franta, *Adv. Polym Sci.*, 58, 1 (1984), Yusuke Kawakami, *Kagaku Kogyo* (*Chemical Industry*), 38, 56 (1987), Yuya Yamashita, *Kobunshi* (*Macromolecule*), 31, 988 (1982), Shiro Kobayashi, *Kobunshi* (*Macromolecule*), 30, 625 (1981), Koichi Ito, *Kobunshi Kako* (*Macromolecule Processing*), 35, 262 (1986), Kishiro Higashi & Takashi Tsuda, *Kino Zairyo* (*Functional Materials*), 1987, No. 10, 5, and the literatures and patents cited in these references.

However, since the macromonomer (MB) used in the present invention has the above described polar group as the component of the repeating unit, the following matters should be considered in the synthesis thereof.

In one method, the radical polymerization and the introduction of a terminal reactive group are carried out by the above described method using a monomer having the polar group as the form of a protected functional group as described, for example, in the following Reaction Scheme (1).

Reaction Scheme (1)

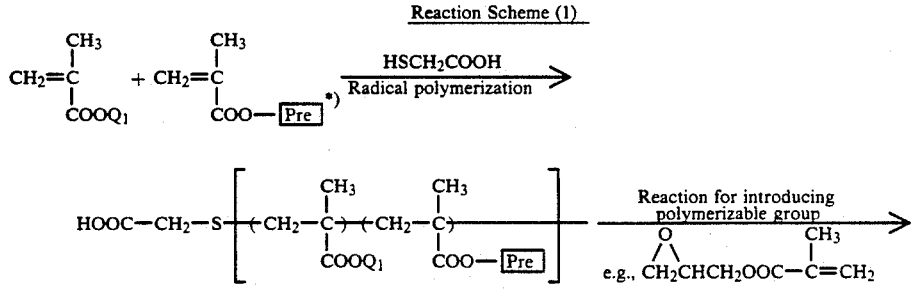

-continued

Reaction Scheme (1)

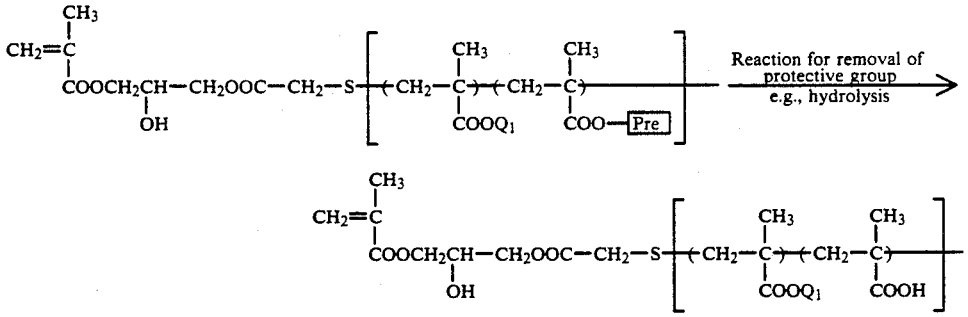

*[Pre] : protective group for —COOH, e.g., $-C(C_6H_5)_3$,

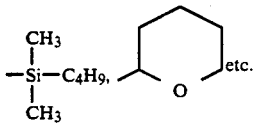

The reaction for introducing the protective group and the reaction for removal of the protective group (e.g., hydrolysis reaction, hydrogenolysis reaction, and oxidation-decomposition reaction) for the polar group ($-SO_3H$, $-PO_3H_2$, —COOH,

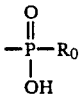

—OH, —CHO, and a cyclic acid anhydride-containing group) which is contained at random in the macromonomer (MB) for use in the present invention can be carried out by any of conventional methods.

The methods which can be used are specifically described, for example, in J. F. W. McOmie, *Protective Groups in Organic Chemistry,* Plenum Press (1973) , T. W. Greene, *Protective Groups in Organic Synthesis,* John Wiley & Sons (1981), Ryohei Oda, *Kobunshi (Macromolecular) Fine Chemical,* Kodansha (1976), Yoshio Iwakura and Keisuke Kurita, *Hannosei Kobunshi (Reactive Macromolecules)*, Kodansha (1977), G. Berner et al, *J. Radiation Curing,* No. 10, 10(1986), JP-A-62-212669, JP-A-62-286064, JP-A-62-210475, JP-A-62-195684, JP-A-62-258476, JP-A-63-260439, JP-A-1-63977 and JP-A-1-70767.

Another method for producing the macromonomer (MB) comprises synthesizing the oligomer in the same manner as described above and then reacting the oligomer with a reagent having a polymerizable double bond group which reacts with only "specific reactive group" bonded to one terminal thereof by utilizing the difference between the reactivity of the "specific reactive group" and the reactivity of the polar group contained in the oligomer as shown in the following Reaction Scheme (2).

Reaction Scheme (2)

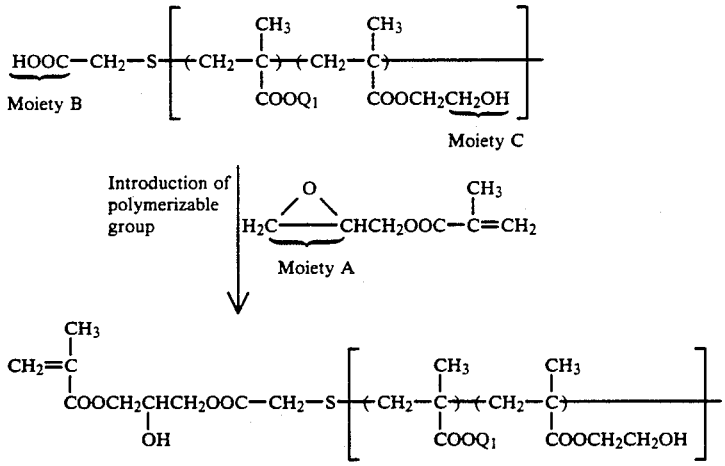

Specific examples of a combination of the specific functional groups (moieties A, B, and C) described in Reaction Scheme (2) are set forth in Table A below but the present invention should not be construed as being limited thereto. It is important to utilize the selectivity of reaction in an ordinary organic chemical reaction and the macromonomer can be formed without protecting the polar group in the oligomer. In Table A, Moiety A is a functional group in the reagent for introducing a polymerizable group, Moiety B is a specific functional group at the terminal of oligomer, and Moiety C is a polar group in the repeating unit in the oligomer.

TABLE A

| Moiety A | Moiety B | Moiety C |
|---|---|---|
| 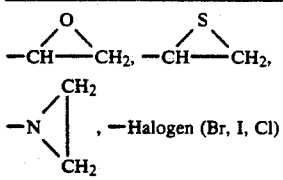 | —COOH, —$NH_2$ | —OH |
| —COCl, Acid Anhydride | —OH, —$NH_2$ | —COOH, —$SO_3H$, —$PO_3H_2$, |
| —$SO_2Cl$, | | 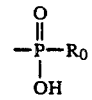 |
| —COOH, —$NHR_{20}$ | -Halogen | —COOH, —$SO_3H$, —$PO_3H_2$, |
| (wherein $R_{20}$ is a hydrogen atom or an alkyl group) | | —OH, 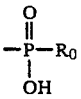 |
| —COOH, —$NHR_{20}$ | 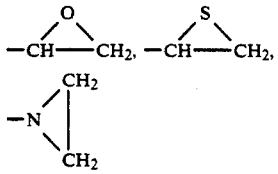 | —OH |
| —OH, —$NHR_{20}$ | —COCl, —$SO_2Cl$ | —COOH, —$SO_3H$, —$PO_3H_2$ |

The chain transfer agent which can be used for producing the oligomer includes, for example, mercapto compounds having a substituent capable of being derived into the polar group later (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodinated alkyl compounds having the above described polar group or substituent (e.g., iodoacetic acid, iodopropionic acid, 2-iodoethanol, 2-iodoethanesulfonic acid, and 3-iodopropanesulfonic acid). Of these compounds, the mercapto compounds are preferred.

Also, as the polymerization initiator having a specific reactive group, which can be used for the production of the oligomer, there are, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl-2-imidazolin-2-yl)propane], 2,2'-azobis[2-(2-imidazolin-2-yl)propane], 2,2'-azobis[2-(3,4,5,6-tetrahydropyrimidin-2-yl)propane], 2,2'-azobis{2-[1-(2-hydroxyethyl)-2-imidazolin-2-yl]propane}, 2,2'-azobis[2-methyl—N-(2-hydroxyethyl)propionamide] and the derivatives thereof.

The chain transfer agent or the polymerization initiator is used in an amount of from 0.1 to 15 parts by weight, and preferably from 0.5 to 10 parts by weight per 100 parts by weight of the total monomers.

Specific examples of the macromonomer (MB) for use in the present invention are set forth below, but the present invention should not be construed as being limited thereto.

In the following formulae, $Q_2$ represents —H or —$CH_3$; $Q_3$ represents —H, —$CH_3$, or —$CH_2COOCH_3$; $R_{41}$ represents —$C_nH_{2n+1}$ (wherein n represents an integer of from 1 to 18),

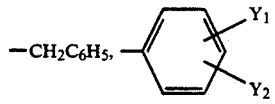

(wherein $Y_1$ and $Y_2$ each represents —H, —Cl, —Br, —$CH_3$, —$COCH_3$, or —$COOCH_3$),

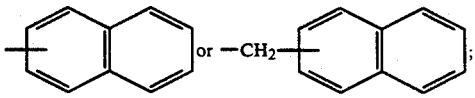

$W_1$ represents —CN, —$OCOCH_3$, —$CONH_2$, or —$C_6H_5$; W2 represents —Cl, —Br, —CN, or —$OCH_3$; $\alpha$ represents an integer of from 2 to 18; $\beta$ represents an integer of from 2 to 12; and $\gamma$ represents an integer of from 2 to 4.

(M-101)
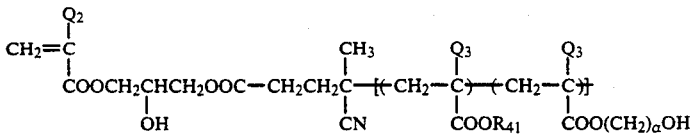
(M-102)
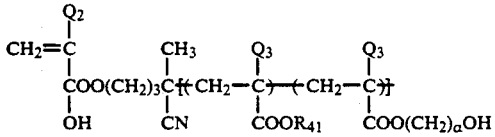
(M-103)
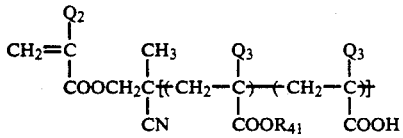
(M-104)
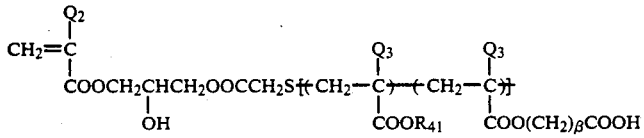
(M-105)
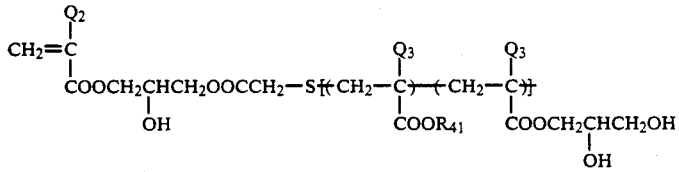
(M-106)
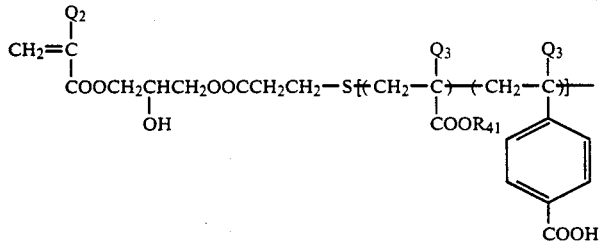
(M-107)
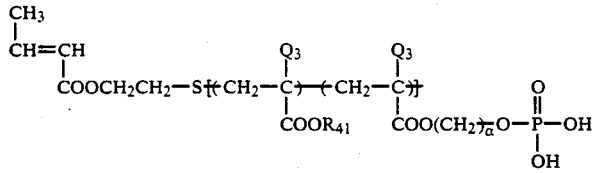
(M-108)
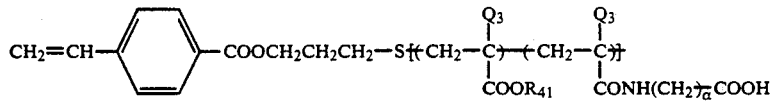
(M-109)
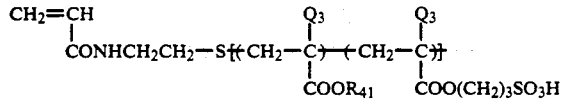
(M-110)
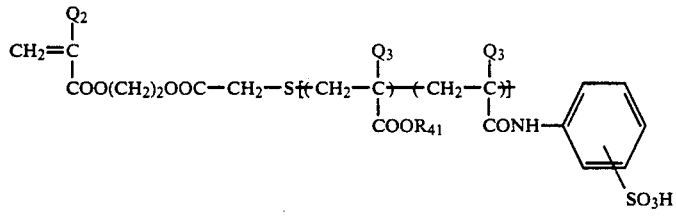

-continued
(M-111)
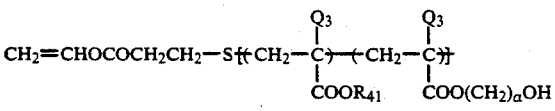
(M-112)
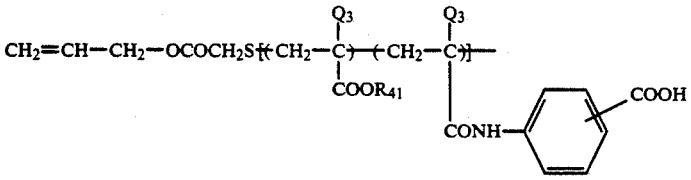
(M-113)
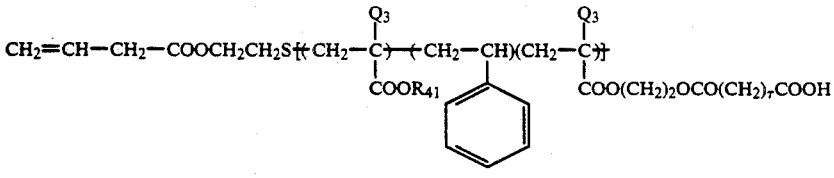
(M-114)
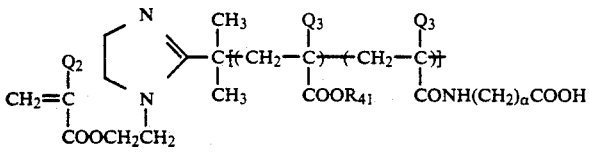
(M-115)
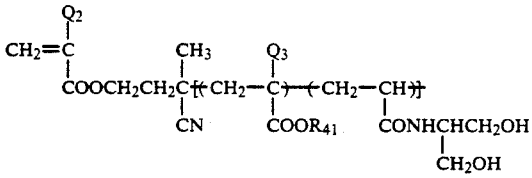
(M-116)
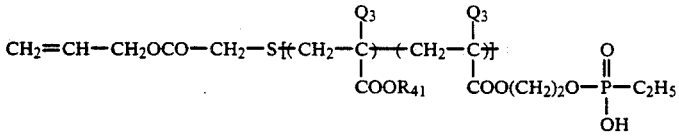
(M-117)
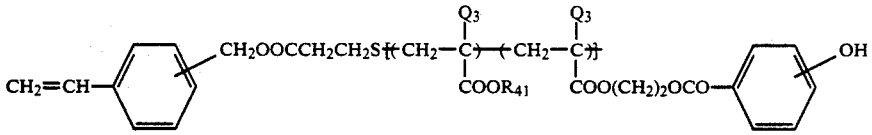
(M-118)
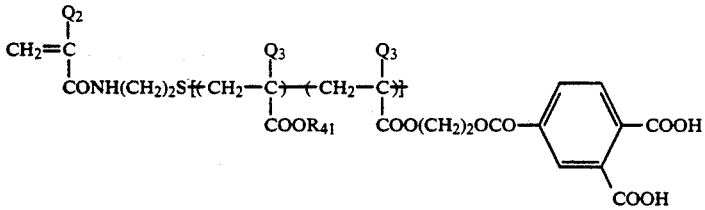
(M-119)
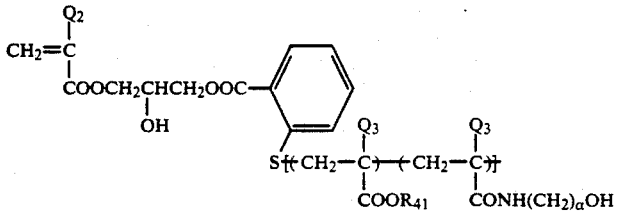

-continued (M-120)

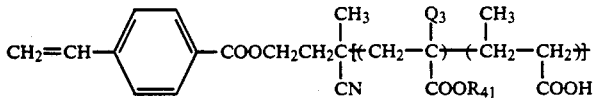

(M-121)

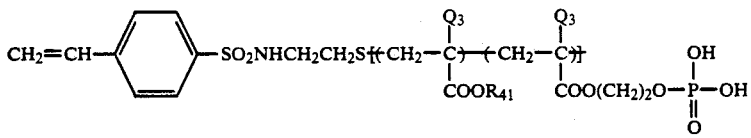

(M-122)

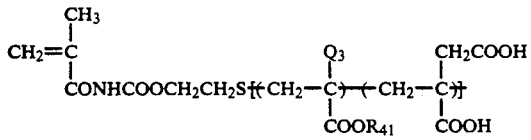

(M-123)

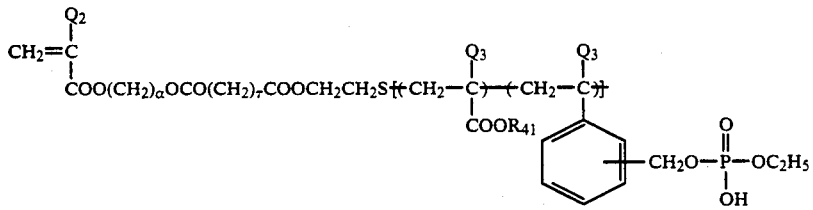

(M-124)

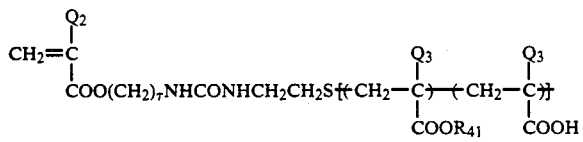

(M-125)

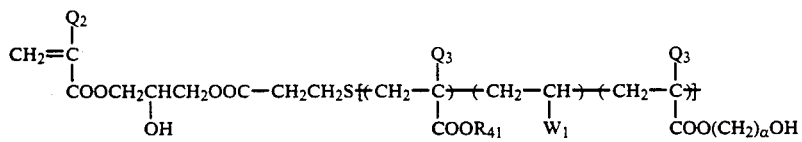

(M-126)

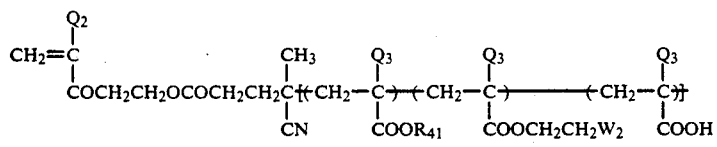

The macromonomer (MC) used in the present invention can be produced by a conventionally known synthesis method. More specifically, it can be produced by a method comprising previously protecting the acidic group of a monomer corresponding to the polymerizable component having the specific acidic group to form a functional group, synthesizing an AB block polymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagents, and then conducting a protection-removing reaction of the functional group which has been formed by protecting the acidic group by a hydrolysis reaction, a hydrogenolysis reaction, an oxidative decomposition reaction, or a photodecomposition reaction to form the acidic group.

An example thereof is shown by the following Reaction Scheme (3):

Reaction Scheme (1)

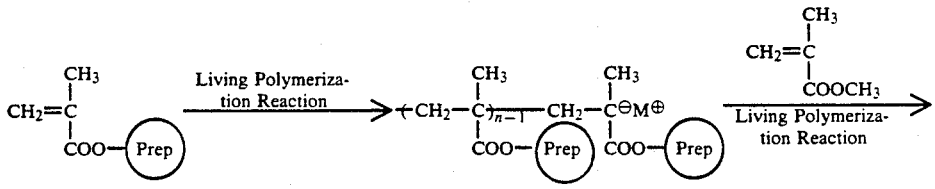

-continued

Reaction Scheme (1)

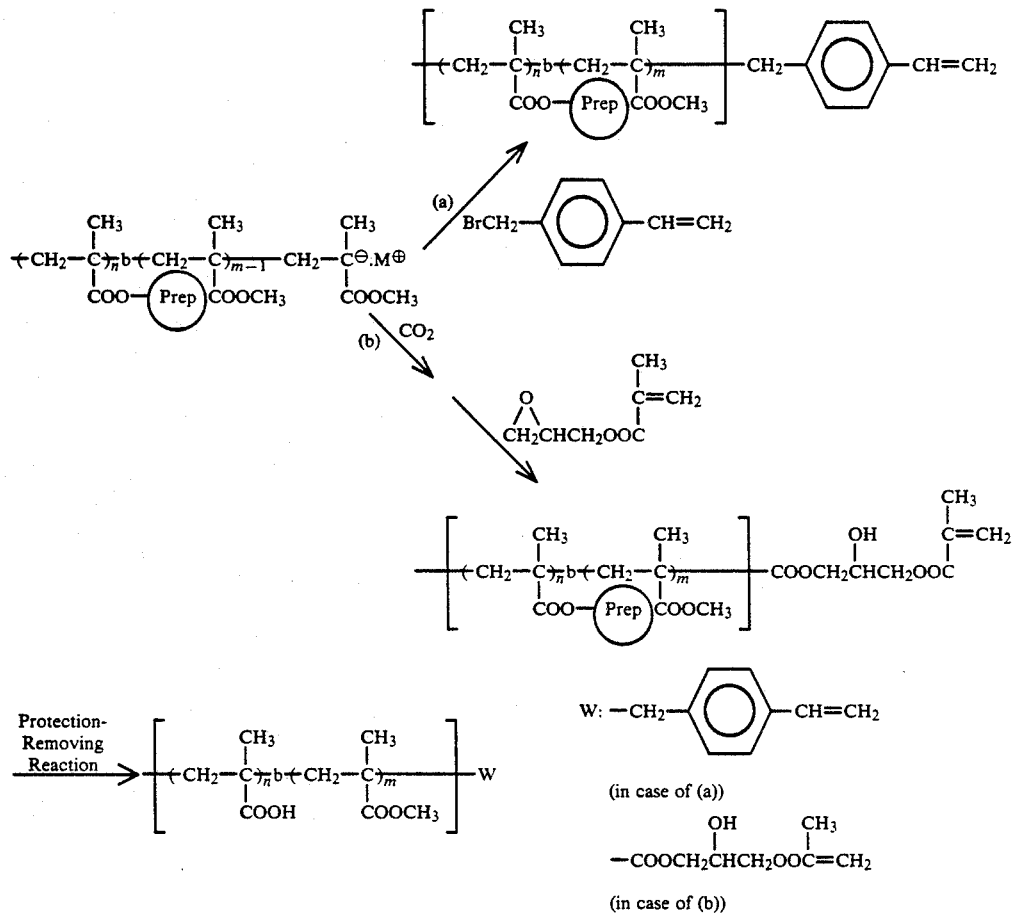

Prep : Protective group for —COOH,

—b—: "—b—" represents that each of the repeating units bonded to —b— is present in the form of a block polymer component (hereinafter the same), n, m: repeating unit The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh, W. R. Hertler et al, *Macromolecules*, 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973), as well as methods as described in the above references.

Furthermore, the AB block copolymer can also be synthesized by a photoinifeter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-64-26619.

The macromonomer (MC) according to the present invention can be obtained by applying the above described synthesis method for macromonomer to the AB block copolymer.

Specific examples of the macromonomer (MC) which can be used in the present invention are set forth below, but the present invention should not be construed as being limited thereto. In the following formulae, $Q_1$, $Q_2$ and $Q_3$ each represents —H, —$CH_3$ or —$CH_2COOCH_3$; $Q_4$ represents —H or —$CH_3$; $R_{31}$ represents —$C_nH_{2n+1}$ (wherein n represents an integer of from 1 to 18),

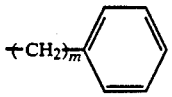

(wherein m represents an integer of from 1 to 3),

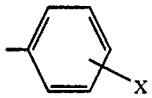

(wherein X represents —H, —Cl, —Br, —$CH_3$, —$OCH_3$ or —$COCH_3$) or

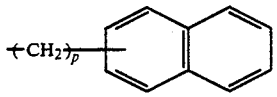

(wherein p represents an integer of from 0 to 3); $R_{32}$ represents —$C_qH_{2q+1}$ (wherein q represents an integer of from 1 to 8) or

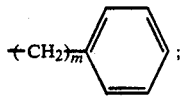

$Y_1$ represents —OH, —COOH, —$SO_3H$,

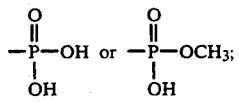

$Y_2$ represents —COOH, —$SO_3H$,

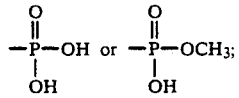

r represents an integer of from 2 to 12; s represents an integer of from 2 to 6; and —b— is as defined above.

(M-201)

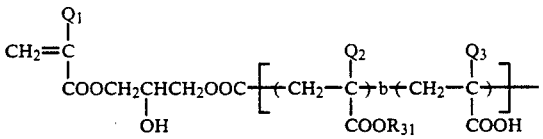

(M-202)

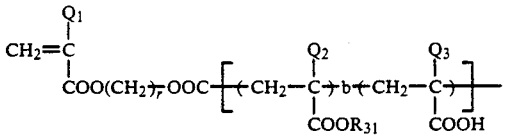

(M-203)

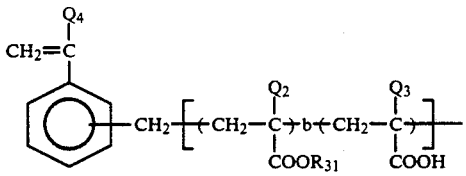

(M-204)

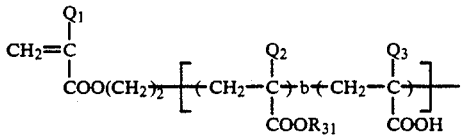

(M-205)

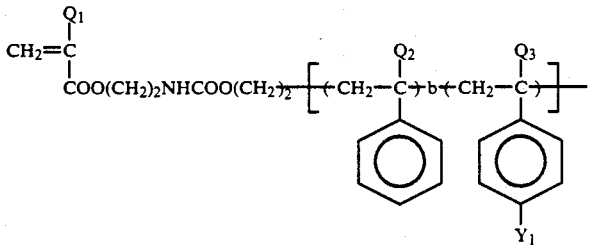

-continued
(M-206)
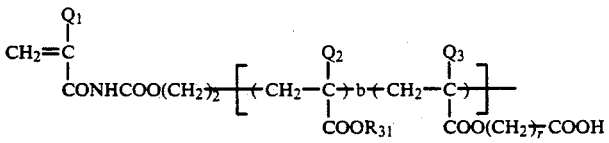
(M-207)
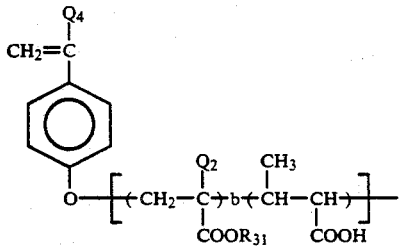
(M-208)
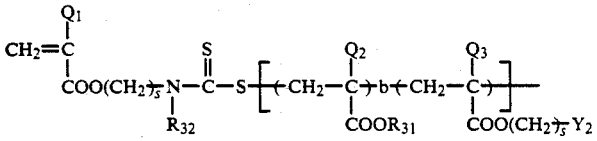
(M-209)
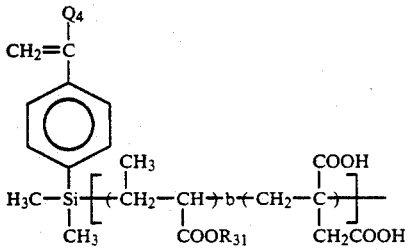
(M-2010)
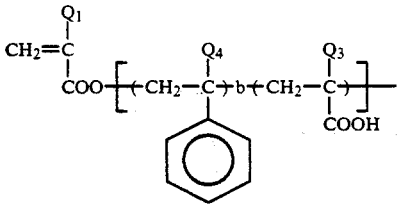
(M-211)
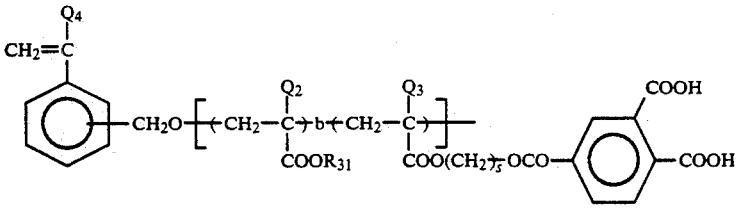
(M-212)
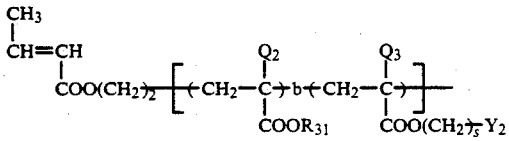
(M-213)
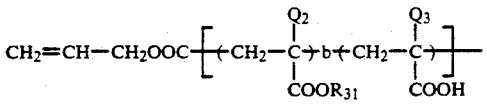

-continued (M-214)

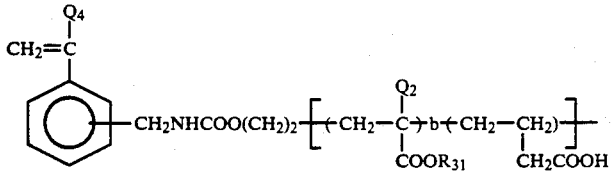

(M-215)

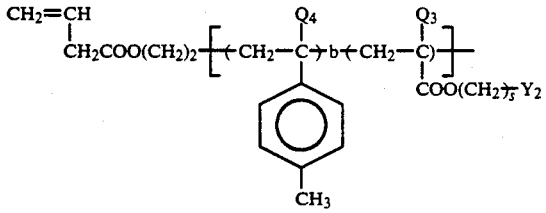

(M-216)

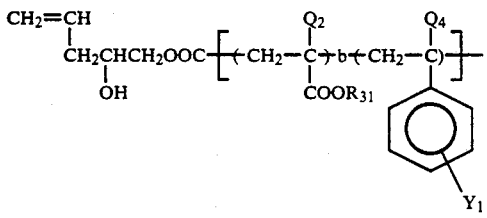

Furthermore, the graft-type copolymer for use in the present invention may contain other monomer(s) as other copolymerizable component(s) together with the above described monofunctional monomer (A) containing a hydrophilic group-forming functional group and the above described monofunctional macromonomer (M).

Examples of such other monomers include α-olefins, acrylonitrile, methacrylonitrile, acrylamides, methacrylamides, styrenes, naphthalene compounds having a vinyl group (e.g., vinylnaphthalene and 1-isopropenylnaphthalene), and heterocyclic compounds having a vinyl group (e.g., vinylpyridine, vinylpyrrolidone, vinylthiophene, vinyltetrahydrofuran, vinyl-1,3-dioxolane, vinylimidazole, vinylthiazole, and vinyloxazoline).

In the graft-type copolymer according to the present invention, the content of the polymerizable component corresponding to the monomer (A) containing a hydrophilic group-forming functional group, is preferably from 30 to 90% by weight, more preferably from 40 to 80% by weight of the total polymerizable components. On the other hand, the content of the polymerizable component corresponding to the macromonomer (M) is preferably from 10 to 70% by weight, more preferably 20 to 60% by weight. Further, the content of polymerizable components other than those of the monomer (A) and the macromonomer (M) is preferably at most 30% by weight.

The weight average molecular weight of the graft-type copolymer is preferably from $1\times10^3$ to $1\times10^6$, more preferably from $5\times10^3$ to $5\times10^5$.

If the content of the monomer (A) is less than 30% by weight or the content of the macromonomer (M) is more than 70% by weight, the effect for improving the water retentivity of an offset printing plate prepared from the electrophotographic lithographic printing plate precursor is reduced. On the other hand, if the content of the monomer (A) is more than 90% by weight or the content of the macromonomer (M) is less than 10% by weight, the effect for improving the water retentivity may not be maintained when a large number of prints have been made.

In the electrophotographic lithographic printing plate precursor according to the present invention, the graft-type copolymer can be used alone or together with one or more of other conventionally known resins, as a binder resin of the photoconductive layer.

Resins used together with the graft-type copolymer according to the present invention include alkyd resins, vinyl acetate resins, polyester resins, styrene-butadiene resins, and acryl resins, and more specifically, those described, for example, in Ryuji Kurita & Jiro Ishiwatari, Kobunshi, 17, 278 (1968), Harumi Miyamoto & Hidehiko Takei, *Imaging*, No. 8, 9 (1973).

Preferred examples of the resins include random copolymers containing a methacrylate as a polymerizable component which are known as binder resins in electrophotographic light-sensitive materials using photoconductive zinc oxide as an inorganic photoconductive substance. Such resins are described, for example, in JP-B-50-2242, JP-B-50-31011, JP-A-50-98324, JP-A-50-98325, JP-B-54-13977, JP-B-59-35013, JP-A-54-20735, and JP-A-57-202544.

Further, binder resins composed of a combination of a random copolymer having a weight average molecular weight of not more than 20,000 and comprising a methacrylate monomer and an acidic group-containing monomer with a resin having a weight average molecular weight of not less than 30,000 or a heat- and/or photocurable compound as described, for example, in JP-A-63-220148, JP-A-63-220149, JP-A-2-34860, JP-A-64-564, JP-A-1-100554, JP-A-1-211766, JP-A-2-40660, JP-A-2-53064, JP-A-2-56558, JP-A-1-102573, JP-A-2-69758, JP-A-2-68561, JP-A-2-68562, and JP-A-2-69759 can be used together with the graft-type copolymer. Also, binder resins composed of a combination of a polymer having a weight average molecular weight of not more than 20,000, comprising a methacrylate component and having an acidic group at one terminal of the main chain thereof with a resin having a weight average molecular weight of not less than 30,000 or a heat- and/or photo-curable compound as described, for example, in JP-A-1-169455, JP-A-1-116643, JP-A-1-280761, JP-A-1-214865, JP-A-2-874, JP-A-2-34859, JP-A-2-96766, JP-A-2-103056, JP-A-2-167551, JP-A-2-135455, JP-A-2-135456 and JP-A-2-135457 can be used together with the graft-type copolymer.

When the graft-type copolymer according to the present invention is used together with other resins as described above, a ratio of them can be appropriately selected. However, the ratio of the graft-type copolymer is preferably from 0.5 to 60% by weight, more preferably from 5 to 50% by weight of the total binder resin used.

In particular, when the graft-type copolymer according to the present invention is used together with other binder resins (particularly, those which satisfy the electrophotographic characteristics responding to a semiconductor laser beam), it has been found that the graft-type copolymer is concentrated in the surface portion of the photoconductive layer. Thus, only a small amount of the graft-type copolymer can provide the sufficient effects.

According to the present invention, therefore, the binder resin is rendered effectively hydrophilic by the oil-desensitizing treatment owing to the concentrative existence of the graft-type copolymer which forms a hydrophilic group upon the oil-desensitization in the surface portion of the photoconductive layer while maintaining the excellent electrophotographic characteristics, and as a result, it is possible to greatly improve the image quality of prints and to prevent background stains.

As described above, it is believed that the graft-type copolymer according to the present invention is composed of a polymerizable component containing a fluorine atom and/or a silicon atom (Segment A) and a polymerizable component corresponding to the macromonomer (M) (Segment B), and tends to move to the surface portion of the photoconductive layer at the preparation of the photoconductive layer since Segment A is remarkably oleophilic whereby it exists concentratively in the surface portion of the photoconductive layer. The graft-type copolymer having Segment A containing the hydrophilic group-forming functional group is subjected to hydrolysis or hydrogenolysis with an oil-desensitizing solution or dampening water used during printing or subjected to photo-decomposition to form a hydrophilic group.

When the graft-type copolymer is used as the binder resin of lithographic printing plate precursor, the hydrophilic property of the non-image areas which are rendered hydrophilic upon the oil-desensitizing treatment is more increased by the concentrative existence of Segment A which contains the hydrophilic group-forming functional group on the surface portion of the photoconductive layer, and thus, the difference between the oleophilic property of the image areas and the hydrophilic property of the non-image areas becomes more distinctive thereby the adhesion of printing ink on the non-image areas during printing is prevented.

While Segment A forms a hydrophilic group through decomposition, for example, by the etching treatment or the action of dampening water supplied to the printing plate during printing, Segment B corresponding to the macromonomer (M) in the graft-type copolymer according to the present invention is relatively oleophilic and strongly interacts with zinc oxide and/or other binder resins present in the photoconductive layer. Therefore, Segment B acts as an anchor to effect the prevention from dissolving out of the graft-type copolymer. Consequently, the hydrophilic property of the non-image areas is maintained even after printing a large number of prints and good printing durability can be achieved.

In a preferred embodiment of the present invention, the photoconductive layer contains a binder resin which exhibits the excellent electrophotographic characteristics in spite of the fluctuation of environmental conditions or which exhibits the excellent electrophotographic characteristics in a system using a scanning exposure process employing a semiconductor laser beam as a light source in order to achieve the excellent electrophotographic characteristics and good reproducibility of the original, and the graft-type copolymer according to the present invention in the amount which does not damage these excellent characteristics in order to achieve the increase in the hydrophilic property or to obtain a large number of clear prints of good quality free from background stains even when printing is conducted under severe conditions, for example, a printing machine of large size is employed or a printing pressure changes.

In the present invention, photoconductive zinc oxide is used as a photoconductive substances, but other inorganic photoconductive substances, for example, titanium oxide, zinc sulfide, cadmium sulfide, cadmium carbonate, zinc selenide, cadmium selenide, tellurium selenide or lead sulfide can be used together with zinc oxide. In such a case, however, the amount of the other inorganic photoconductive substances is not more than 40% by weight, preferably not more than 20% by weight of the photoconductive zinc oxide used. When the amount of the other inorganic photoconductive substances exceeds 40% by weight, the effect for increasing the hydrophilic property in the non-image areas of the lithographic printing plate precursor decreases.

The total amount of the binder resin used for the inorganic photoconductive substance is from 10 to 100 parts by weight, and preferably from 15 to 50 parts by weight, per 100 parts by weight of the photoconductive substance.

In the present invention, various kinds of dyes can be used as spectral sensitizers for the inorganic photoconductive substance, if desired. Examples of these dyes include carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (which may contain metals) described in Harumi Miyamoto and Hidehiko Takei, *Imaging*, 1973, (No. 8), 12, C. J. Young et al, RCA Review, 15, 469 (1954), Kohei Kiyota, *Journal of Electric Communication Society of Japan, J 63 C (No. 2)*, 97 (1980), Yuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium dyes, triphenylmethane dyes, xanthene dyes, and phthalein dyes are described, for example, in JP-B-51-452, JP-A-50-0334, JP-A-50-114227, JP-A-53-39130, JP-A-53-82353, U.S. Pat. Nos. 3,052,540 and 4,054,450 and JP-A-57-16456.

The polymethine dyes such as oxonol dyes, merocyanine dyes, cyanine dyes, and rhodacyanine dyes which can be used include those described, for example, in F.

M. Hamer, *The Cyanine Dyes and Related Compounds*, and, more specifically, the dyes described, for example, in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814 and JP-B-55-18892.

Furthermore, polymethine dyes capable of spectrally sensitizing in the wavelength region of from near infrared to infrared longer than 700 nm are those described, for example, in JP-A-47-840, JP-A-47-44180, JP-B-51-41061 JP-A-49-5034, JP-A-49-45122, JP-A-57-6245, JP-A-56-35141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is excellent in that, even when various sensitizing dyes are used for the photoconductive layer, the performance thereof is not liable to vary by such sensitizing dyes.

Further, if desired, the photoconductive layers may further contain various additives commonly employed in electrophotographic light-sensitive layer, such as chemical sensitizers. Examples of such additives include electron-acceptive compounds (e.g., halogen, benzoquinone, chloranil, acid anhydrides, and organic carboxylic acids) as described, for example, in *Imaging*, 1973, (No. 8}, page 12, and polyarylalkane compounds, hindered phenol compounds, and p-phenylenediamine compounds as described in Hiroshi Kokado et al, *Recent Photoconductive Materials and Development and Practical Use of Light-sensitive Materials*, Chapters 4 to 6, Nippon Kagaku Joho K.K. (1986).

There is no particular restriction on the amount of these additives, but the amount thereof is usually from 0.0001 to 2.0 parts by weight per 100 parts by weight of the photoconductive substance.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

As the charge transporting materials for the double layer type light-sensitive material, there are polyvinylcarbazole, oxazole dyes, pyrazoline dyes, and triphenylmethane dyes. The thickness of the charge transporting layer is from 5 μm to 40 μm, and preferably from 10 μm to 30 μm.

Resins which can be used for the charge transporting layer typically include thermoplastic and thermosetting resins such as polystyrene resins, polyester resins, cellulose resins, polyether resins, vinyl chloride resins, vinyl acetate resins, vinyl chloridevinyl acetate copolymer resins, polyacryl resins, polyolefin resins, urethane resins, epoxy resins, melamine resins, and silicone resins.

The photoconductive layer according to the present invention can be provided on a conventional support. In general, the support for the electrophotographic light-sensitive material is preferably electroconductive. As the electroconductive support, there are base materials such as metals, paper, and plastic sheets rendered electroconductive by the impregnation of a low resistant substance, the base materials the back surface of which (the surface opposite to the surface of providing a photoconductive layer) is rendered electroconductive and having coated with one or more layer for preventing the occurrence of curling of the support, the above-described support having formed on the surface a water-resistant adhesive layer, the above-described support having formed on the surface at least one precoat, and a support formed by laminating on paper a plastic film rendered electroconductive by vapor depositing thereon aluminum.

More specifically, the electroconductive base materials or conductivity-imparting materials as described, for example, in Yukio Sakamoto, *Denshi Shashin* (*Electrophotography*), 14 (No. 1), 2–11 (1975), Hiroyuki Moriga, *Introduction for Chemistry of Specific Paper*, Kobunshi Kankokai, 1975, and M. F. Hoover, *J. Macromol. Sci. Chem.*, A-4 (6), 1327–1417 (1970) can be used.

The production of a lithographic printing plate from the electrophotographic lithographic printing plate precursor of the present invention can be carried out in a conventional manner. More specifically, the duplicated images are formed on the electrophotographic lithographic printing plate precursor according to the present invention and then the non-image areas are subjected to an oil-desensitizing treatment to prepare a lithographic printing plate. In the oil-desensitizing treatment, both of an oil-densitizing reaction of zinc oxide (hereinafter referred to as Reaction A) and an oil-desensitizing reaction of the resin (hereinafter referred to as Reaction B) proceed. The oil-desensitizing treatment can be carried out by any of (a) a method comprising effecting Reaction A and thereafter Reaction B, (b) a method comprising effecting Reaction B and thereafter Reaction A, and (c) a method comprising effecting simultaneously Reactions A and B.

In the method for the oil-desensitizing treatment of zinc oxide, there can be used any of known processing solutions, for example, those containing, as a main oil-desensitizing component, a ferrocyanide compound as described, for example, in JP-A-62-239158, JP-A-62-292492, JP-A-63-99993, JP-A-63-99994, JP-B-40-7334, JP-B-45-33683, JP-A-57-107889, JP-B-46-21244, JP-B-44-9045, JP-B-47-32681, JP-B-55-9315 and JP-A-52-101102; those containing a phytic acid compound as described, for example, JP-B-43-28408, JP-B-45-24609, JP-A-51-103501, JP-A-54-10003, JP-A-53-83805, JP-A-53-83806, JP-A-53-127002, JP-A-54-44901, JP-A-56-2189, JP-A-57-2796, JP-A-57-20394 and JP-A-59-207290; those containing a water-soluble polymer capable of forming a metal chelate as described, for example, in JP-B-38-9665, JP-B-39-22263, JP-B-40-763, JP-B-43-28404, JP-B-47-29642, JP-A-52-126302, JP-A-52-134501, JP-A-53-49506, JP-A-53-59502 and JP-A-53-104302; those containing a metal complex compound as described, for example, in JP-A-53-104301, JP-B-55-15313 and JP-B-54-41924; and those containing an inorganic or organic acid compound as described, for example, in JP-B-39-13702, JP-B-40-10308, JP-B-46-26124, JP-A-51-118501 and JP-A-56-111695.

On the other hand, the oil-desensitizing treatment (i.e., generation of hydrophilic property) of the resin according to the present invention containing the functional groups capable of forming hydrophilic groups through decomposition can be accomplished by a method of treating with a processing solution to hydrolyze or a method of irradiating with light to decompose.

The processing solution is composed of an aqueous solution containing a pH controlling agent which can adjust a pH of the processing solution to the desired value. The pH of the processing solution can be widely varied depending on the kind of the hydrophilic group-forming functional groups present in the binder resin and ranges form 1 to 13.

In addition to the above described pH controlling agent, the processing solution may contain other compounds, for example, a water-soluble organic solvent in a proportion of from 1 to 50 parts by weight to 100 parts by weight of water. Suitable examples of the organic solvents include an alcohol (for example, methanol, ethanol, propanol, propargyl alcohol, benzyl alcohol, or phenethyl alcohol), a ketone (for example, acetone, methyl ethyl ketone, or acetophenone), an ether (for example, dioxane, trioxane tetrahydrofuran, ethylene glycol, propylene glycol, ethylene glycol monomethyl ether, propylene glycol monomethyl ether, or tetrahydropyran), an amide (for example, dimethylformamide, or dimethylacetamide), an ester (for example, methyl acetate, ethyl acetate, or ethyl formate). The organic solvents can be used individually or as a mixture of two or more thereof.

Furthermore, a surfactant can be incorporated into the processing solution in a proportion of from 0.1 to 20 parts by weight to 100 parts by weight of water. Suitable examples of the surfactants include anionic, cationic and nonionic surfactants well known in the art, for example, those described in Hiroshi Horiguchi "New Surfactants (Shin-Kaimen Kasseizai)" Sankyo Shuppan KK (1975), and Ryohei Oda and Kazuhiro Teramura "Synthesize of Surfactants and Applications Thereof (Kaimen Kasseizai no Gosei to Sono Oyo)" Maki Shoten (1980).

The scope of the present invention should not be construed as being limited to the above described specific compounds.

With respect to the conditions of the treatment, a processing temperature is preferably from 15° to 60° C. and a processing time is preferably from 10 seconds to 5 minutes.

In a case wherein the specific functional group present in the resin according to the present invention is decomposed upon irradiation by light, it is preferred to insert a step of irradiation by a chemically active ray after the formation of toner image at plate making. More specifically, after electrophotographic development, the irradiation is conducted either simultaneously with fixing of the toner image, or after fixing of toner image according to a conventionally known fixing method using, for example, heat, pressure or solvent.

The term "chemically active ray" used in the present invention can be any of visible ray, ultraviolet ray, far ultraviolet ray, electron beam, X-ray, $\gamma$-ray and $\alpha$-ray. Among them ultraviolet ray is preferred, and ray having a wavelength of from 310 nm to 500 nm is more preferred. A high-pressure or super high-pressure mercury lamp is usually employed. The treatment of irradiation is ordinarily conducted at a distance of from 5 cm to 50 cm and for a period of from 10 seconds to 10 minutes.

In accordance with the present invention, the electrophotographic lithographic printing plate precursor which is excellent in electrostatic characteristics (particularly, dark charge retention property and photosensitivity), is capable of reproducing a faithful duplicated image to the original, forms neither overall background stains nor dotted background stains of prints, and has excellent printing durability can be obtained. Further, the printing plate precursor is suitable for use in a scanning exposure system using a semiconductor laser beam.

The present invention will now be illustrated in greater detail with reference to the following examples, but it should be understood that the present invention is not to be construed as being limited thereto.

SYNTHESIS EXAMPLE MA-1

Synthesis of Macromonomer (MA-1)

A mixed solution of 95 g of methyl methacrylate, 5 g of thioglycolic acid, and 200 g of toluene was heated to 75° C. with stirring under nitrogen gas stream. To the mixture was added 1.0 g of 2,2'-azobisisobutyronitrile (hereinafter simply referred to as AIBN) to conduct a reaction for 8 hours. To the reaction mixture were then added 8 g of glycidyl methacrylate, 1.0 g of N,N-dimethyldodecylamine, and 0.5 g of tertbutylhydroquinone, followed by stirring at 100° C. for 12 hours. After cooling, the reaction mixture was reprecipitated from 2 l of methanol to obtain 82 g of Macromonomer (MA-1) having a weight average molecular weight (hereinafter simply referred to as Mw) of $8.3\times10^3$ as a white powder.

SYNTHESIS EXAMPLE MA-2

Synthesis of Macromonomer (MA-2)

A mixed solution of 95 g of methyl methacrylate, 5 g of thioglycolic acid, and 200 g of toluene was heated to 70° C. with stirring under nitrogen gas stream. To the mixture was added 1.5 g of AIBN to conduct a reaction for 8 hours. To the reaction mixture were added 7.5 g of glycidyl methacrylate, 1.0 g of N,N-dimethyldodecylamine, and 0.8 g of tert-butylhydroquinone, followed by stirring at 100° C. for 12 hours. After cooling, the reaction mixture was reprecipitated from 2 l of methanol to obtain 85 g of Macromonomer (MA-2) having an Mw of $4.5\times10^3$ as a colorless clear viscous substance.

SYNTHESIS EXAMPLE MA-3

Synthesis of Macromonomer (MA-3)

A mixed solution of 94 g of butyl methacrylate, 6 g of 2-meracptoethanol, and 200 g of toluene was heated to 70° C. under nitrogen gas stream. To the mixture was added 1.2 g of AIBN to conduct a reaction for 8 hours.

The reaction mixture was cooled to 20° C. in a water bath, 10.2 g of triethylamine was added thereto, and 14.5 g of methacrylic acid chloride was added thereto dropwise with stirring at a temperature of 25° C. or less. After the dropwise addition, the stirring was continued for 1 hour. Then, 0.5 g of tert-butylhydroquinone was added, followed by stirring for 4 hours at a temperature of 60° C. After cooling, the reaction mixture was reprecipitated from 2 of methanol to obtain 79 g of Macromonomer (MA-3) having an Mw of $6.3\times10^3$ as a colorless clear viscous substance.

SYNTHESIS EXAMPLE MA-4

Synthesis of Macromonomer (MA-4)

A mixed solution of 95 g of ethyl methacrylate and 200 g of toluene was heated to 70° C. under nitrogen gas stream, and 5 g of 2,2-azobis(cyanoheptanol) was added thereto to conduct a reaction for 8 hours.

After cooling, the reaction mixture was cooled to 20° C. in a water bath, and 1.0 g of triethylamine and 21 g of methacrylic anhydride were added thereto, followed by stirring at that temperature for 1 hour and then at 60° C. for 6 hours.

The resulting reaction mixture was cooled and reprecipitated from 2 l of methanol to obtain 75 g of Macromonomer (MA-4) having an Mw of $8.6\times10^3$ as a colorless clear viscous substance.

SYNTHESIS EXAMPLE MA-5

Synthesis of Macromonomer (MA-5)

A mixed solution of 97 g of propyl methacrylate, 3 g of 3-mercaptopropionic acid, and 200 g of toluene was heated to 70° C. under nitrogen gas stream to prepare a uniform solution. To the solution was added 2.0 g of AIBN to conduct a reaction for 8 hours. After cooling, the reaction mixture was reprecipitated from 2 of methanol, and the solvent was removed by distillation at 50° C. under reduced pressure. The resulting viscous substance was dissolved in 200 g of toluene, and to the solution were added 16 g of glycidyl methacrylate, 1.0 g of N,N-dimethyldodecylamine, and 1.0 g of tertbutylhydroquinone, followed by stirring at 110° C. for 10 hours. The reaction solution was again reprecipitated from 2 of methanol to obtain Macromonomer (MA-5) having an Mw of $6.5\times10^3$ as a light yellow viscous substance.

SYNTHESIS EXAMPLE MA-6

Synthesis of Macromonomer (MA-6)

A mixed solution of 95 g of benzyl methacrylate, 5 g of thioglycolic acid, and 200 g of toluene was heated to 75° C. with stirring under nitrogen gas stream, and 1.5 g of AIBN was added thereto to conduct a reaction for 8 hours. Then, the reaction mixture was cooled to 25° C., and 8 g of 2-hydroxyethyl methacrylate was added thereto. A mixed solution of 10 g of dicyclohexylcarbodiimide (hereinafter simply referred to as DCC), 0.2 g of 4-(N,N-dimethylamino)pyridine and 50 g of methylene chloride was added dropwise thereto with stirring over a period of 30 minutes, followed by reacting for 3 hours. To the reaction mixture was added 5 ml of formic acid, the mixture was stirred for one hour, and the insoluble substance was removed by suction filtration using celite. The filtrate obtained was reprecipitated from 1.5 l of hexane, and the viscous substance thus-deposited was collected by decantation and dissolved in 200 ml of tetrahydrofuran. A small amount of the insoluble substance was removed by suction filtration using celite in the same manner as described above. The filtrate was reprecipitated from one liter of hexane, and the viscous substance thus-deposited was collected by decantation and dried under a reduced pressure to obtain Macromonomer (MA-6) having an Mw of $4.5\times10^3$ as a colorless viscous substance.

SYNTHESIS EXAMPLE MA-7

Synthesis of Macromonomer (MA-7)

A mixed solution of 40 g of methyl methacrylate, 54 g of ethyl acrylate, 6 g of 2-mercaptoethylamine, 150 g of toluene, and 50 g of tetrahydrofuran was heated to 75° C. with stirring under nitrogen gas stream, and 2.0 g of AIBN was added thereto to conduct a reaction for 8 hours. The reaction mixture was cooled to 20° C. in a water bath, and 23 g of methacrylic anhydride was added thereto dropwise in such a manner that the temperature did not exceed 25° C., followed by stirring at that temperature for 1 hour. To the reaction mixture was added 0.5 g of 2,2'-methylenebis(6-tert-butyl-p-cresol) was added, followed by stirring at 40° C. for 3 hours. After cooling, the reaction mixture was reprecipitated from 2 l of methanol to obtain 83 g of Macromonomer (MA-7) having an Mw of $7.5\times10^3$ as a viscous substance.

SYNTHESIS EXAMPLE MA-8

Synthesis of Macromonomer (MA-8)

A mixed solution of 95 g of methyl methacrylate, 150 g of toluene, and 50 g of ethanol was heated to 75° C. under nitrogen gas stream, and 5 g of 4,4'-azobis(4-cyanovaleric acid) (hereinafter simply referred to as ACV) was added thereto to conduct a reaction for 8 hours. Then, 15 g of glycidyl acrylate, 1.0 g of N,N-dimethyldodecylamine, and 1.0 g of 2,2'-methylenebis(6-tert-butyl-p-cresol) were added thereto, followed by stirring at 100° C. for 15 hours. After cooling, the reaction mixture was reprecipitated from 2 l of methanol to obtain 83 g of Macromonomer (MA-8) having an Mw of $5.3\times10^3$ as a clear viscous substance.

SYNTHESIS EXAMPLES MA-9 TO MA-18

Synthesis of Macromonomers (MA-9) to (MA-18)

Macromonomers (MA-9) to (MA-18) were prepared in the same manner as in Synthesis Example MA-3, except for replacing methacrylic acid chloride with each of the acid halides shown in Table A-1 below. An Mw of each macromonomer was in the range of from $5\times10^3$ to $8\times10^3$.

TABLE A-1

| Synthesis Example No. | Macro-monomer (MA) | Acid Halide | Amount Used (g) | Yield (g) |
|---|---|---|---|---|
| MA-9 | (MA-9) | $CH_2{=}CH{-}COCl$ | 13.5 | 75 |
| MA-10 | (MA-10) | $CH_3{-}CH{=}CH{-}COCl$ | 14.5 | 80 |
| MA-11 | (MA-11) | 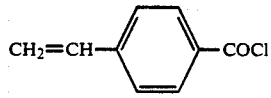 | 15.0 | 83 |
| MA-12 | (MA-12) | $CH_2{=}CH{-}COO(CH_2)_2COCl$ | 15.5 | 73 |

TABLE A-1-continued

| Synthesis Example No. | Macro-monomer (MA) | Acid Halide | Amount Used (g) | Yield (g) |
|---|---|---|---|---|
| MA-13 | (MA-13) | $CH_2=C(CH_3)-COO(CH_2)_2OCO(CH_2)_2COCl$ | 18.0 | 75 |
| MA-14 | (MA-14) | $CH_2=C(CH_3)-CONH(CH_2)_4COCl$ | 18.0 | 80 |
| MA-15 | (MA-15) | $CH_2=CH-COO(CH_2)_2OCO-C_6H_4-COCl$ | 20.0 | 81 |
| MA-16 | (MA-16) | $CH_2=C(CH_3)-COOCH_2CH(Br)CH_2OCO(CH_2)_3COCl$ | 20.0 | 78 |
| MA-17 | (MA-17) | $CH_2=CH-CH_2-OCO(CH_2)_2COCl$ | 16.0 | 72 |
| MA-18 | (MA-18) | $CH_2=C(CH_2COOCH_3)-COCl$ | 17.5 | 75 |

SYNTHESIS EXAMPLES MA-19 TO MA-27

Synthesis of Macromonomers (MA-19) to (MA-27)

Macromonomers (MA-19) to (MA-27) were prepared in the same manner as in Synthesis Example MA-6, except for replacing benzyl methacrylate with each of the monomers shown in Table A-2 below. An Mw of each macromonomer was in a range of from $4\times10^3$ to $5.5\times10^3$.

TABLE A-2

| Synthesis Example No. | Macro-monomer (MA) | Monomer (Amount: g) |
|---|---|---|
| MA-19 | (MA-19) | Ethyl methacrylate (95) |
| MA-20 | (MA-20) | Methyl methacrylate (60)<br>Butyl methacrylate (35) |
| MA-21 | (MA-21) | Butyl methacrylate (85)<br>Methyl acrylate (10) |
| MA-22 | (MA-22) | Ethyl methacrylate (75)<br>Styrene (20) |
| MA-23 | (MA-23) | Methyl methacrylate (80)<br>Methyl acrylate (15) |
| MA-24 | (MA-24) | Ethyl acrylate (75)<br>Acrylonitrile (20) |
| MA-25 | (MA-25) | Propyl methacrylate (87)<br>N,N-Dimethylaminoethyl methacrylate (8) |
| MA-26 | (MA-26) | Butyl methacrylate (90)<br>N-Vinylpyrrolidone (5) |
| MA-27 | (MA-27) | Methyl methacrylate (89)<br>Dodecyl methacrylate (6) |

SYNTHESIS EXAMPLE MB-1

Synthesis of Macromonomer (MB-1)

A mixed solution of 90 g of ethyl methacrylate, 10 g of 2-hydroxyethyl methacrylate, 5 g of thioglycolic acid and 200 g of toluene was heated to 75° C. with stirring under nitrogen gas stream and, after adding thereto 1.0 g of AIBN, the reaction was carried out for 8 hours. Then, to the reaction mixture were added 8 g of glycidyl methacrylate, 1.0 g of N,N-dimethyldodecylamine and 0.5 g of tert-butylhydroquninone, and the resulting mixture was stirred for 12 hours at 100° C. After cooling, the reaction mixture was reprecipitated from 2 liters of n-hexane to obtain 82 g of the desired macromonomer as a white powder. The weight average molecular weight of the macromonomer obtained was $3.8\times10^3$.

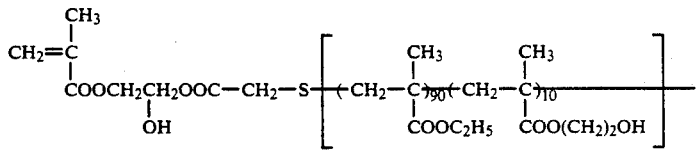

(MB-1)

SYNTHESIS EXAMPLE MB-2

Synthesis of Macromonomer (MB-2)

A mixed solution of 90 g of butyl methacrylate, 10 g of methacrylic acid, 4 g of 2-mercaptoethanol, and 200 g of tetrahydrofuran was heated to 70° C. under nitrogen gas stream and, after adding thereto 1.2 g of AIBN, the reaction was carried out for 8 hours.

Then, after cooling the reaction mixture in a water bath to 20° C., 10.2 g of triethylamine was added to the reaction mixture and then 14.5 g of methacrylic acid chloride was added dropwise to the mixture with stirring at a temperature below 25° C. Thereafter, the resulting mixture was further stirred for one hour. Then, after adding thereto 0.5 g of tert-butylhydroquinone, the mixture was heated to 60° C. and stirred for 4 hours. After cooling, the reaction mixture was added dropwise to one liter of water with stirring over a period of about 10 minutes, and the mixture was stirred for one hour. Then, the mixture was allowed to stand and water was removed by decantation. The mixture was washed twice with water and, after dissolving it in 100 ml of tetrahydrofuran, the solution was reprecipitated from 2 liter of petroleum ether. The precipitates thus formed were collected by decantation and dried under reduced pressure to obtain 65 g of the desired macromonomer as a viscous product. The weight average molecular product was $5.6\times10^3$.

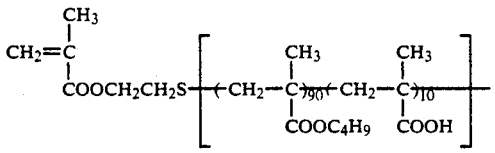

(MB-2)

SYNTHESIS EXAMPLE MB-3

Synthesis of Macromonomer (MB-3)

A mixed solution of 95 g of benzyl methacrylate, 5 g of 2-phosphonoethyl methacrylate, 4 g of 2-aminoethylmercaptan, and 200 g of tetrahydrofuran was heated to 70° C. with stirring under nitrogen gas stream.

Then, after adding 1.5 g of AIBN to the reaction mixture, the reaction was carried out for 4 hours and, after further adding thereto 0.5 g of AIBN, the reaction was carried out for 4 hours. Then, the reaction mixture was cooled to 20° C. and, after adding thereto 10 g of acrylic anhydride, the mixture was stirred for one hour at a temperature of from 20° C. to 25° C. Then, 1.0 g of tert-butylhydroquinone was added to the reaction mixture, and the resulting mixture was stirred for 4 hours at a temperature of from 50° C. to 60° C. After cooling, the reaction mixture was added dropwise to one liter of water with stirring over a period of about 10 minutes followed by stirring for one hour. The mixture was allowed to stand, and water was removed by decantation. The product was washed twice with water, dissolved in 100 ml of tetrahydrofuran and the solution was reprecipitated from 2 liters of petroleum ether. The precipitates formed were collected by decantation and dried under reduced pressure to obtain 70 g of the desired macromonomer as a viscous product. The weight average molecular weight of the product was $7.4\times10^3$.

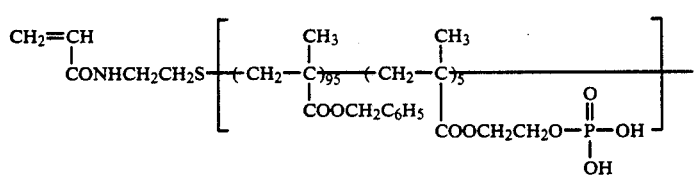

(MB-3)

SYNTHESIS EXAMPLE MB-4

Synthesis of Macromonomer (MB-4)

A mixed solution of 95 g of 2-chlorophenyl methacrylate, 5 g of Monomer (I) having the structure shown below, 4 g of thioglycolic acid and 200 g of toluene was heated to 70° C. under nitrogen gas stream.

Monomer (I):

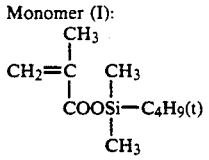

Then, 1.5 g of AIBN was added to the reaction mixture, and the reaction was carried out for 5 hours. After further adding thereto 0.5 g of AIBN, the reaction was carried out for 4 hours. Then, after adding thereto 12.4 g of glycidyl methacrylate, 1.0 g of N,N-dimethyldodecylamine, and 1.5 g of tert-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran, and the mixture was stirred for one hour at a temperature of from 30° C. to 35° C. The reaction mixture obtained was reprecipitated from 2 liters of a mixture of water and ethanol ($\frac{1}{8}$ by volume ratio), and the precipitates thus formed were collected by decantation and dissolved in 200 ml of tetrahydrofuran. The solution was reprecipitated from 2 liters of n-hexane to obtain 58 g of the desired macromonomer as a powder. The weight average molecular weight thereof was $7.6\times10^3$.

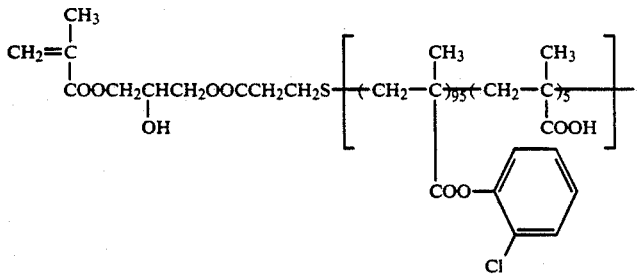

(MB-4)

SYNTHESIS EXAMPLE MB-5

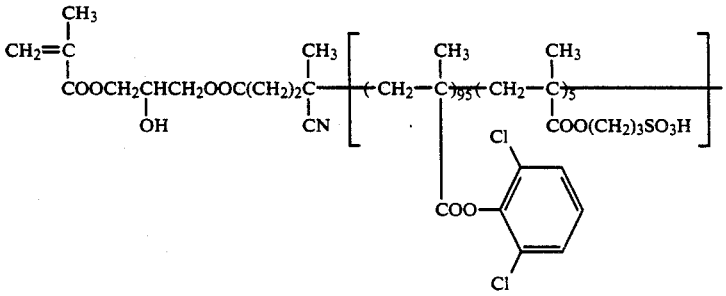

(MB-5)

Synthesis of Macromonomer (MB-5)

A mixed solution of 95 g of 2,6-dichlorophenyl methacrylate, 5 g of 3-(2'-nitrobenzyloxysulfonyl)propyl methacrylate, 150 g of toluene and 50 g of isopropyl alcohol was heated to 80° C. under nitrogen gas stream. Then, after adding 5.0 g of ACV to the reaction mixture, the reaction was carried out for 5 hours and, after further adding thereto 1.0 g of ACV, the reaction was carried out for 4 hours. After cooling, the reaction mixture was reprecipitated from 2 liters of methanol and the powder thus formed was collected and dried under reduced pressure.

A mixture of 50 g of the powder obtained in the above step, 14 g of glycidyl methacrylate, 0.6 g of N,N,-dimethyldodecylamine, 1.0 g of tert-butylhydroquinone, and 100 g of toluene was stirred for 10 hours at 110° C. After cooling to room temperature, the reaction mixture was irradiated with a high-pressure mercury lamp of 80 watts with stirring for one hour. Thereafter, the reaction mixture was reprecipitated from one liter of methanol, and the powder formed was collected by filtration and dried under reduced pressure to obtain 34 g of the desired macromonomer. The weight average molecular weight of the product was $7.3\times10^3$.

SYNTHESIS EXAMPLE MB-6

Synthesis of Macromonomer (MB-6)

A mixed solution of 60 g of methyl methacrylate, 30 g of methyl acrylate, 10 g of Monomer (II) having the structure shown below , 3 g of $\beta$-mercaptopropionic acid and 200 g of tetrahydrofuran was heated to 70° C. under nitrogen gas stream.

Monomer (II):

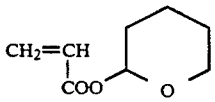

Then, after adding 1.5 g of AIBN to the reaction mixture, the reaction was carried out for 4 hours and, after further adding thereto 0.5 of AIBN, the reaction was carried out for 3 hours. After cooling the reaction mixture to 25° C., 10 g of 2-hydroxyethyl methacrylate was added thereto. Then, a mixed solution of 15 g of DCC, 0.4 g of 4-(N,N-dimethylamino)pyridine and 38 g of methylene chloride was added dropwise to the mixture with stirring over a period of one hour, followed by stirring for 4 hours. To the reaction mixture were added 5 g of a 30% ethanol solution of hydrogen chloride and 5 g of water, the mixture was stirred for one hour. After removing the insoluble substances by filtration, the filtrate was reprecipitated from 1.5 liters of methanol, and the precipitates thus formed were collected and dried. The weight average molecular weight of the product was $7.5\times10^3$.

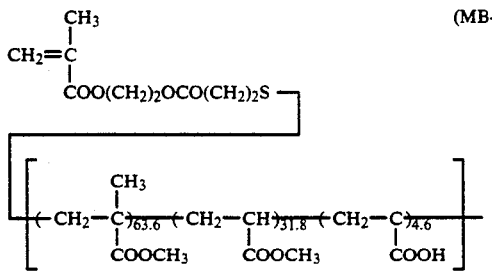

(MB-6)

(weight ratio)

SYNTHESIS EXAMPLE MB-7 TO MB-12

Synthesis of Macromonomer (MB-7) to (MB-12)

Macromonomers (MB-7}to (MB-12) were prepared in the same manner as in Synthesis Example MB-6, except for using each of the monomers shown in Table B-1 below. The weight average molecular weight of each macromonomer was in a range of from $6\times10^3$ to $8\times10^3$.

mixture, and the reaction was conducted for 10 hours. Separately, a mixed solution of 90 g of ethyl methacrylate and 100 g of toluene was sufficiently degassed under nitrogen gas stream and the resulting mixed solution was added to the above described mixture, and then reaction was further conducted for 10 hours. The reaction mixture was adjusted to 0° C., and carbon dioxide gas was passed through the mixture at a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances deposited from the reaction mixture by filtration, 10 ml of an ethanol solution of 30 % by weight hydrogen chloride was added to the filtrate and the mixture was stirred for one hour. Then, the solvent of the reaction mixture was distilled off under reduced pressure until the whole

TABLE B-1

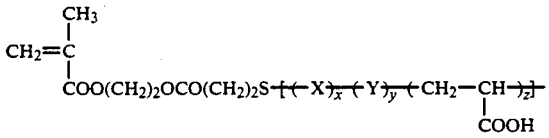

| Synthesis Example No. | Macromonomer (MB) | X— | Y— | x/y/z (weight ratio) |
|---|---|---|---|---|
| MB-7 | (MB-7) | $-CH_2-C(CH_3)(COOCH_3)-$ | $-CH_2-CH(COOC_2H_5)-$ | 80/15/5.0 |
| MB-8 | (MB-8) | $-CH_2-C(CH_3)(COOC_2H_5)-$ | — | 95.5/0/4.5 |
| MB-9 | (MB-9) | $-CH_2-CH(COOCH_3)-$ | — | 94.5/0/5.5 |
| MB-10 | (MB-10) | $-CH_2-C(CH_3)(COOCH_3)-$ | $-CH_2-CH(COOH_2C_6H_5)-$ | 75.4/20/4.6 |
| MB-11 | (MB-11) | $-CH_2-C(CH_3)(COOC_2H_5)-$ | $-CH_2-CH-$ (N, O) | 86/10/4.0 |
| MB-12 | (MB-12) | $-CH_2-C(CH_3)(COOCH_2C_6H_5)-$ | $-CH_2-CH(COOCH_3)-$ | 77/15/8.0 |

SYNTHESIS EXAMPLE MC-1

Synthesis of Macromonomer (MC-1)

A mixed solution of 10 g of triphenylmethyl methacrylate, and 100 g of toluene was sufficiently degassed under nitrogen gas stream and cooled to −20° C. Then, 0.02 g of 1,1-diphenylbutyl lithium was added to the volume was reduced to a half, and the mixture was reprecipitated from one liter of petroleum ether.

The precipitates thus formed were collected and dried under reduced pressure to obtain 56 g of the macromonomer having an Mw of $6.5\times10^3$.

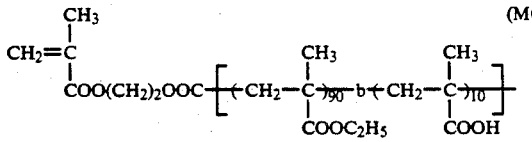
(MC-1)

SYNTHESIS EXAMPLE MC-2

Synthesis of Macromonomer (MC-2)

A mixed solution of 5 g of benzyl methacrylate, 0.01 g of (tetraphenyl porphinate) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 5 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing the insoluble substances from the reaction mixture by filtration, the reaction mixture was reprecipitated from 500 ml of petroleum ether and the precipitates thus formed were collected and dried to obtain 33 g of the macromonomer having an Mw of $7\times10^3$.

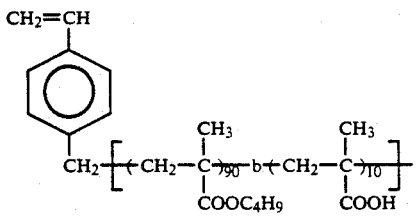
(MC-2)

SYNTHESIS EXAMPLE MC-3

Synthesis of Macromonomer (MC-3)

A mixed solution of 20 g of 4-vinylphenyloxytrimethylsilane and 100 g of toluene was sufficiently degassed under nitrogen gas stream and cooled to 0° C. Then, 0.1 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixed solution was added to the above described mixture, and then reaction was further conducted for 8 hours. After introducing ethylene oxide at a flow rate of 30 ml/min into the reaction mixture for 30 minutes with vigorously stirring, the mixture was cooled to a temperature of 15° C., and 8 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of the macromonomer having an Mw of $7.8\times10^3$.

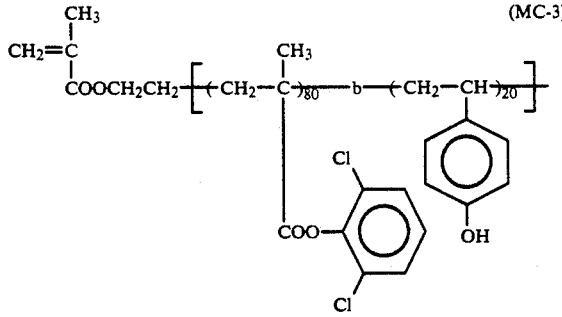
(MC-3)

SYNTHESIS EXAMPLE MC-4

Synthesis of Macromonomer (MC-4)

A mixed solution of 15 g of triphenylmethyl acrylate and 100 g of toluene was sufficiently degassed under nitrogen gas stream and cooled to −20° C. Then, 0.1 g of sec-butyl lithium was added to the mixture, and the reaction was conducted for 10 hours. Separately, a mixed solution of 85 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 8 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of the macromonomer having an Mw of $4.5\times10^3$.

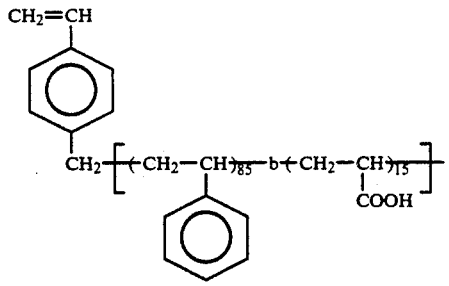
(MC-4)

SYNTHESIS EXAMPLE MC-5

Synthesis of Macromonomer (MC-5)

A mixed solution of 80 g of phenyl methacrylate and 4.8 g of benzyl N-hydroxyethyl-N-ethyldithiocarbamate was placed in a vessel under nitrogen gas stream followed by closing the vessel and heated to 60° C. The mixture was irradiated with light from a high-pressure mercury lamp for 400 W at a distance of 10 cm through a glass filter for 10 hours to conduct photopolymerization.

Then, 20 g of acrylic acid and 180 g of methyl ethyl ketone were added to the mixture and, after replacing the gas in the vessel with nitrogen, the mixture was light-irradiated again for 10 hours.

To the reaction mixture was added dropwise 6 g of 2-isocyanatoethyl methacrylate at 30° C. over a period of one hour and the mixture was stirred for 2 hours. The reaction mixture was reprecipitated from 1.5 liters of hexane and the precipitates thus formed were collected and dried to obtain 68 g of the macromonomer having an Mw of $6.0\times10^3$.

A mixture of 90 g of Intermediate (I) above, 10 g of 2-pyranyl methacrylate and 67 g of tetrahydrofuran was heated to 50° C. under nitrogen gas stream to form a solution. The resulting solution was irradiated to light for 10 hours under the same conditions as above to conduct photopolymerization. The polymer obtained was dissolved by adding 67 g of tetrahydrofuran, reprecipitated from 1.5 liters of methanol, and the precipitates thus formed were collected and dried to obtain

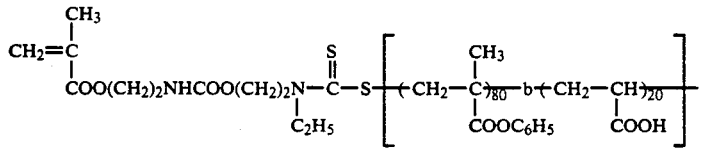

(MC-5)

Intermediate (II).

Intermediate (II)

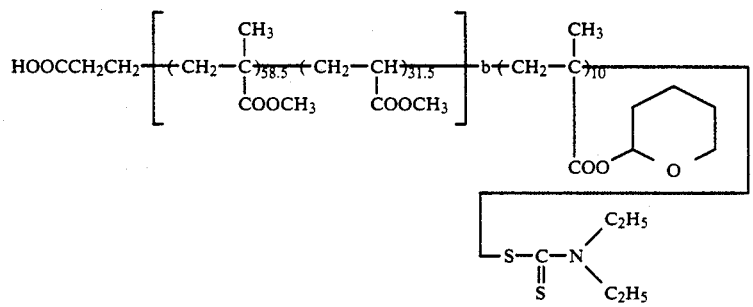

SYNTHESIS EXAMPLE MC-6

Synthesis of Resin (MC-6)

A mixed solution of 65 g of methyl methacrylate, 35 g of methyl acrylate, 6 g of 2-carboxyethyl-N,N-diethyldithiocarbamate and 100 g of toluene was sufficiently degassed under nitrogen gas stream and heated to 40° C. The mixture was irradiated with light from a high-pressure mercury lamp for 400 W at a distance of 10 cm through a glass filter for 8 hours to conduct photopolymerization. The resulting polymer was reprecipitated from 1.5 liters of methanol, and the precipitates thus formed were collected and dried to obtain intermediate (I).

60 g of Intermediate (II) and 10 g of 2-methacrylate were dissolved in 140 g of tetrahydrofuran and the solution was adjusted to 25° C. A mixed solution of 12 g of DCC, 0.2 g of 4-(N,N-dimethylamino)pyridine and 20 g of methylene chloride was added dropwise thereto with stirring over a period of one hour, followed by stirring for 3 hours. Then, a mixed solution of 2 g of p-toluenesulfonic acid, 10 g of ethanol and 5 g of water was added thereto and the mixture was stirred for one hour at 30° C. After removing the insoluble substances from the reaction mixture by filtration, the filtrate was reprecipitated from one liter of methanol, and the precipitates were collected and dried to obtain 42 g of the macromonomer having an Mw of $1\times10^4$.

Intermediate (I)

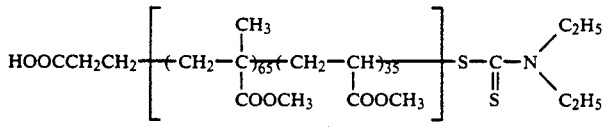

(MC-6)

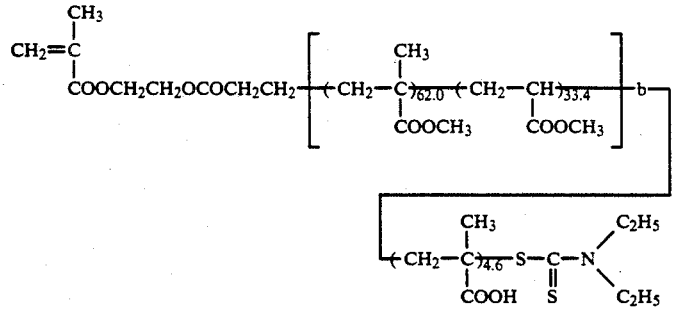

SYNTHESIS EXAMPLE GPA-1

Synthesis of Binder Resin (GPA-1)

A mixed solution of 70 g of Monomer (A-1) shown below, 30 g of Macromonomer (MA-1) and 200 g of toluene was heated to 75° C. under nitrogen gas stream.

Monomer (A-1):

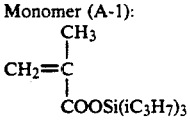

Then, 1.0 g of AIBN was added to the reaction mixture, the reaction was carried out for 4 hours, and further 0.6 g of AIBN was added thereto, the reaction was carried out for 4 hours. An Mw of the resulting polymer was $4.5\times10^4$.

Resin Binder (GPA-1):

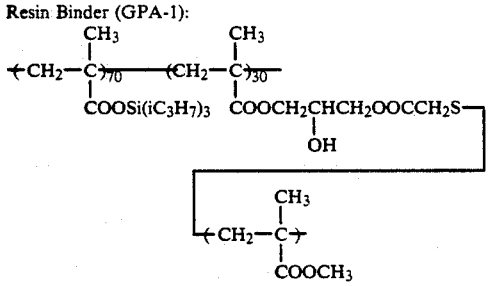

SYNTHESIS EXAMPLE GPA-2

Synthesis of Binder Resin (GPA-2)

A mixed solution of 80 g of Monomer (A-2) shown below, 20 g of Macromonomer (MA-6) and 200 g of tetrahydrofuran was heated to 60° C. under nitrogen gas stream.

Monomer (A-2):

-continued

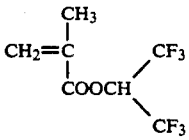

Then, 1.5 g of 2,2'-azobisvaleronitrile (hereinafter simply referred to as ABVN) was added to the reaction mixture, the reaction was carried out for 4 hours, and further 0.8 g of ABVN was added thereto, the reaction was carried out for 4 hours. An Mw of the resulting polymer was $5.0\times10^4$.

Resin Binder (GPA-2):

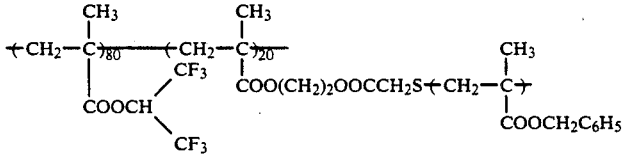

SYNTHESIS EXAMPLE GPA-3

Synthesis of Binder Resin (GPA-3)

A mixed solution of 70 g of Monomer (A-3) shown below, 30 of Macromonomer (MA-23) and 200 g of toluene was prepared and then subjected to the polymerization reaction in the same manner as described in Synthesis Example GPA-1. An Mw of the resulting polymer was $5.3\times10^4$.

Monomer (A-3):

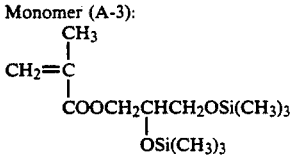

Resin Binder (GPA-3):

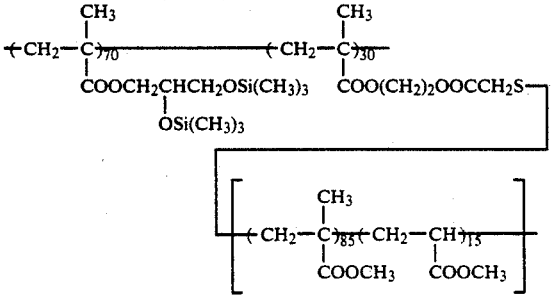

SYNTHESIS EXAMPLES GPA-4 TO GPA-10

Synthesis of Binder Resins (GPA-4) to (GPA-10)

Binder Resins (GPA-4) to GPA-10) were prepared in the same manner as in Synthesis Example GPA-3, except for replacing 70 g of Monomer (A-3) and 30 g of Macromonomer (MA-23) with each of the compounds shown in Table A-3 below. An Mw of each binder resin was in a range of from $4.5\times10^4$ $6\times10^4$.

TABLE A-3

| Synthesis Example No. | Binder Resin | Monomer (A) | | Macromonomer |
|---|---|---|---|---|
| GPA-4 | (GPA-4) | (A-4) | 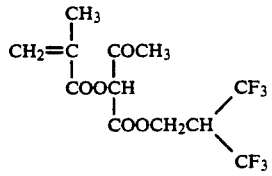 | MA-9 |
| GPA-5 | (GPA-5) | (A-5) | 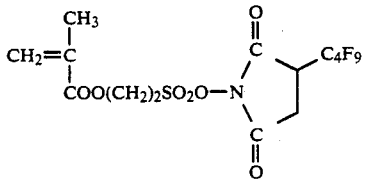 | MA-13 |
| GPA-6 | (GPA-6) | (A-6) | 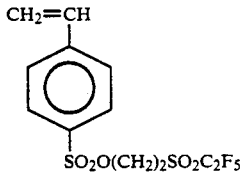 | MA-23 |
| GPA-7 | (GPA-7) | (A-7) | 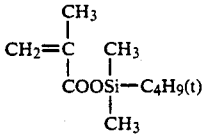 | MA-27 |
| GPA-8 | (GPA-8) | (A-8) | 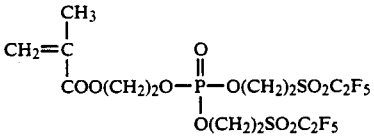 | MA-4 |
| GPA-9 | (GPA-9) | (A-9) | 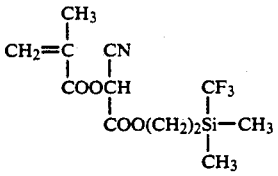 | MA-7 |
| GPA-10 | (GPA-10) | (A-10) | 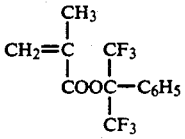 | MA-20 |

SYNTHESIS EXAMPLE GPB-1

Synthesis of Binder Resin (GPB-1)

A mixed solution of 70 g of Monomer (A-1) shown below, 30 g of Macromonomer (MB-1) and 200 g of toluene was heated to 75° C. under nitrogen gas stream.

Monomer (A-1):

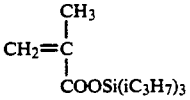

Then, 1.0 g of AIBN was added to the reaction mixture, the reaction was carried out for 4 hours, and further 0.6 g of AIBN was added thereto, the reaction was carried out for 4 hours. An Mw of the resulting polymer was $4.5\times10^4$.

Resin Binder (GPB-1):

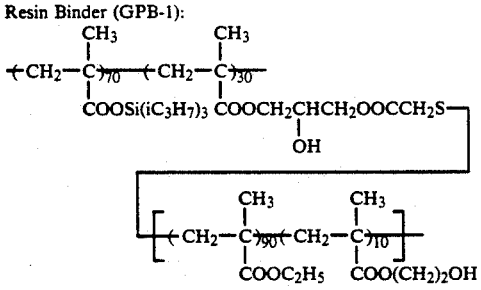

SYNTHESIS EXAMPLE GPB-2

Synthesis of Binder Resin (GPB-2)

A mixed solution of 85 g of Monomer (A-2) shown below, 15 g of Macromonomer (MB-2) and 200 g of tetrahydrofuran was heated to 60° C. under nitrogen gas stream.

Monomer (A-2):

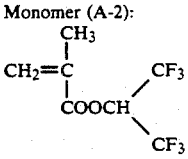

Then, 1.5 g of 2,2'-azobisvaleronitrile (hereinafter simply referred to as ABVN) was added to the reaction mixture, the reaction was carried out for 4 hours, and further 0.8 g of ABVN was added thereto, the reaction was carried out for 4 hours. An Mw of the resulting polymer was $5.0\times10^4$.

Resin Binder (GPB-2):

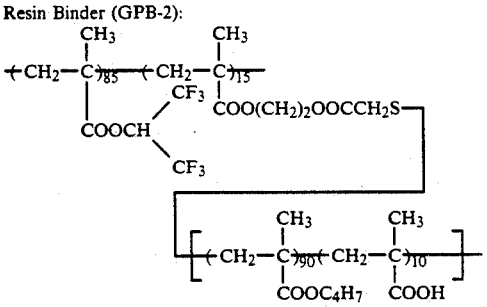

SYNTHESIS EXAMPLE GPB-3

Synthesis of Binder Resin (GPB-3)

A mixed solution of 80 g of Monomer (A-3) shown below, 20 g of Macromonomer (MB-3) and 200 g of toluene was prepared and then subjected to the polymerization reaction in the same manner as described in Synthesis Example GPB-1. An Mw of the resulting polymer was $5.3\times10^4$.

Monomer (A-3):

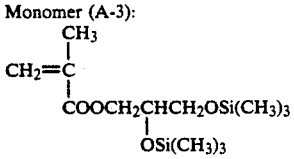

Resin Binder (GPB-3):

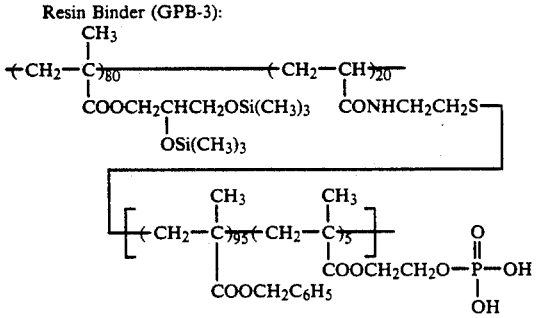

SYNTHESIS EXAMPLES GPB-4 to GPB-10

Synthesis of Binder Resins (GPB-4) to (GPB-10)

Binder Resins (GPB-4) to (GPB-10) were prepared in the same manner as in Synthesis Example GPB-3, except for replacing 80 g of Monomer (A-3) and 20 g of Macromonomer (MB-3) with each of the compounds shown in Table B-2 below. An Mw of each binder resin was in a range of from $4.5\times10^4$ $6\times10^4$.

TABLE B-2

| Synthesis Example No. | Binder Resin | | Monomer (A) | Macromonomer |
|---|---|---|---|---|
| GPB-4 | (GPB-4) | (A-4) | 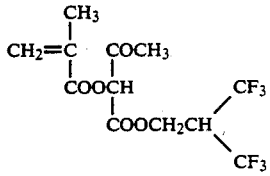 | MB-8 |
| GPB-5 | (GPB-5) | (A-5) | 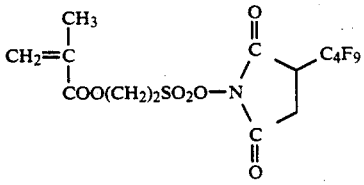 | MB-7 |

TABLE B-2-continued

| Synthesis Example No. | Binder Resin | | Monomer (A) | Macromonomer |
|---|---|---|---|---|
| GPB-6 | (GPB-6) | (A-6) | 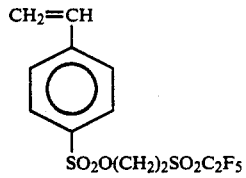 | MB-6 |
| GPB-7 | (GPB-7) | (A-7) | 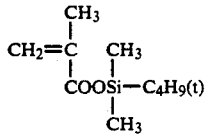 | MB-4 |
| GPB-8 | (GPB-8) | (A-8) | 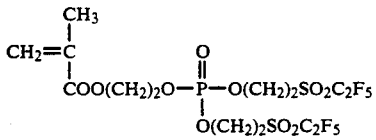 | MB-9 |
| GPB-9 | (GPB-9) | (A-9) | 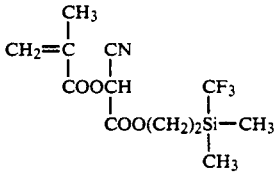 | MB-10 |
| GPB-10 | (GPB-10) | (A-10) | 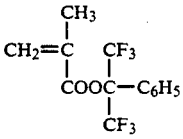 | MB-11 |

SYNTHESIS EXAMPLE GPC-1

Synthesis of Binder Resin (GPC-1)

A mixed solution of 90 g of Monomer (A-1) shown below, 10 g of Macromonomer (MC-1) and 200 g of toluene was heated to 75° C. under nitrogen gas stream.

Monomer (A-1):

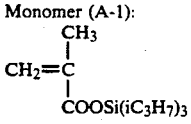

Then, 1.0 g of AIBN was added to the reaction mixture, the reaction was carried out for 4 hours, and further 0.6 g of AIBN was added thereto, the reaction was carried out for 4 hours. An Mw of the resulting polymer was $4.5\times10^4$.

Resin Binder (GPC-1):

-continued

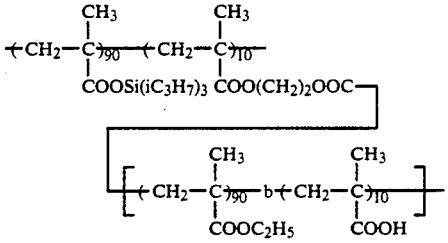

SYNTHESIS EXAMPLE GPC-2

Synthesis of Binder Resin (GPC-2)

A mixed solution of 85 g of Monomer (A-2) shown below, 15 g of Macromonomer (MC-2) and 200 g of tetrahydrofuran was heated to 60° C. under nitrogen gas stream.

Monomer (A-2):

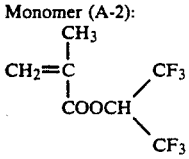

Then, 1.5 g of 2,2'-azobisvaleronitrile (hereinafter simply referred to as ABVN) was added to the reaction mixture, the reaction was carried out for 4 hours, and further 0.8 g of ABVN was added thereto, the reaction was carried out for 4 hours. An Mw of the resulting polymer was $5.0\times10^4$.

Resin Binder (GPC-2):

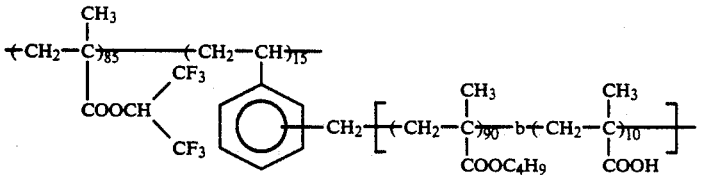

SYNTHESIS EXAMPLE GPC-3

Synthesis of Binder Resin (GPC-3)

A mixed solution of 70 g of Monomer (A-3) shown below, 30 g of Macromonomer (MC-3) and 200 g of toluene was prepared and then subjected to the polymerization reaction in the same manner as described in Synthesis Example GPC-1. An Mw of the resulting polymer was $5.3\times10^4$.

Monomer (A-3):

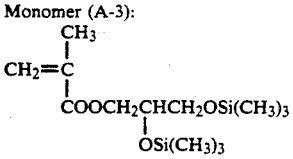

Resin Binder (GPC-3):

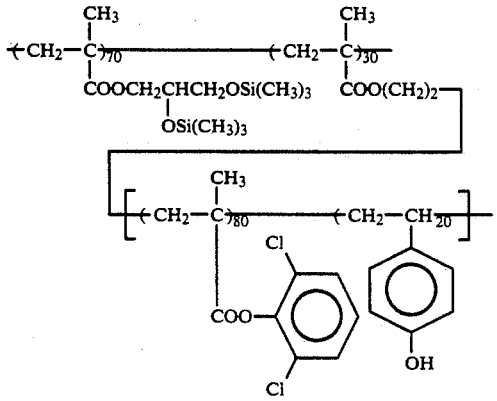

SYNTHESIS EXAMPLES GPC-4 TO GPC-10

Synthesis of Binder Resins (GPC-4) to (GPC-10)

Binder Resins (GPC-4) to (GPC-10) were prepared in the same manner as in Synthesis Example GPC-3, except for replacing 70 g of Monomer (A-3) and 30 g of Macromonomer (MC-3) with each of the compounds shown in Table C-1 below. An Mw of each binder resin was in a range of from $4.5\times10^4$ to $6\times10^4$.

TABLE C-1

| Synthesis Example No. | Binder Resin | | Monomer (A) (90 g) | Macromonomer (10 g) |
|---|---|---|---|---|
| GPC-4 | (GPC-4) | (A-4) | 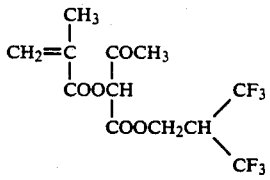 | MC-4 |
| GPC-5 | (GPC-5) | (A-5) | 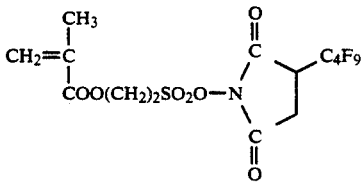 | MC-5 |
| GPC-6 | (GPC-6) | (A-6) | 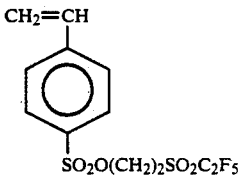 | MC-6 |

TABLE C-1-continued

| Synthesis Example No. | Binder Resin | | Monomer (A) (90 g) | Macromonomer (10 g) |
|---|---|---|---|---|
| GPC-7 | (GPC-7) | (A-7) | 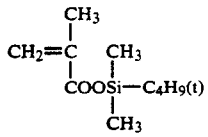 | MC-6 |
| GPC-8 | (GPC-8) | (A-8) | 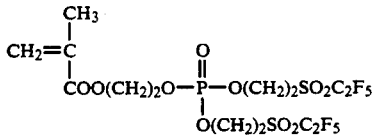 | MC-1 |
| GPC-9 | (GPC-9) | (A-9) | 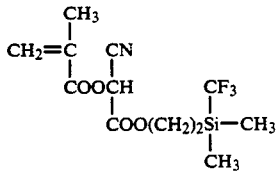 | MC-3 |
| GPC-10 | (GPC-10) | (A-10) | 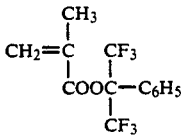 | MC-4 |

EXAMPLE 1

A mixture of 2 g (solid basis, hereinafter the same) of Binder Resin (GPA-1) according to the present invention, 38 g of Binder Resin (B-1) shown below, 200 g of photoconductive zinc oxide, 0.03 g of uranine, 0.06 g of Rose Bengal, 0.02 g of tetrabromophenol blue, 0.20 g of maleic anhydride and 300 g of toluene was dispersed in a ball mill for 3 hours to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was allowed to stand in a dark place at 20° C. and 65% RH (relative humidity) for 24 hours to prepare an electrophotographic light-sensitive material.

Binder Resin (B-1):

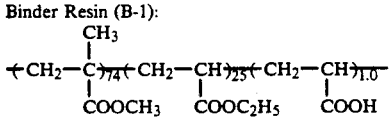

Mw: 5.3 × 10$^4$ (weight ratio)

EXAMPLE 2

An electrophotographic light-sensitive material was prepared in the same manner as described in Example 1 except for using 5.7 g of Binder Resin (B-2) shown below and 32.3 g of Binder Resin (B-3) shown below in place of 38 g of Binder Resin (B-1).

Binder Resin (B-2):

-continued

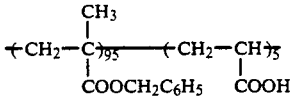

Mw: 6.0 × 10$^3$ (weight ratio)

Binder Resin (B-3):

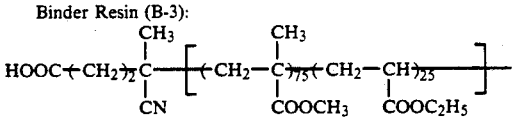

Mw: 6.5 × 10$^4$ (weight ratio)

COMPARATIVE EXAMPLE A

An electrophotographic light-sensitive material was prepared in the same manner as described in Example 1 except that 40 g of Binder Resin (B-1) described above was used as a binder resin in place of 2 g of Binder Resin (GPA-1) and 38 g of Binder Resin (B-1).

COMPARATIVE EXAMPLE B

An electrophotographic light-sensitive material was prepared in the same manner as described in Example 1 except that 2 g of Binder Resin (B-4) shown below was used in place of 2 g of Binder Resin (GPA-1).

Binder Resin (B-4):

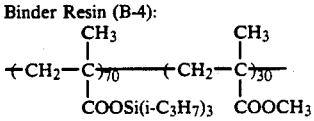

Mw: 4 × 10$^4$ (weight ratio)

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table A-4 below.

TABLE A-4

| | | Example 1 | Example 2 | Comparative Example A | Comparative Example B |
|---|---|---|---|---|---|
| Smoothness of Photo-*1 conductive Layer (sec/cc): | | 350 | 400 | 355 | 350 |
| Electrostatic*2 Characteristics: | | | | | |
| $V_{10}$ (−V): | Condition I | 555 | 580 | 550 | 550 |
| | Condition II | 540 | 570 | 520 | 515 |
| DRR (%): | Condition I | 86 | 95 | 85 | 85 |
| | Condition II | 82 | 91 | 80 | 81 |
| $E_{1/10}$: (lux · sec) | Condition I | 14.0 | 11.0 | 14.5 | 15.0 |
| | Condition II | 16.5 | 13.0 | 17.0 | 18.5 |
| $E_{1/100}$: (lux · sec) | Condition I | 45 | 32 | 47 | 50 |
| | Condition II | 51 | 38 | 58 | 62 |
| Image-Forming Performance*3: | Condition I | Good | Very Good | Good | Good |
| | Condition II | Good | Very Good | Good | Poor (reduced Dmax, cutting of fine lines) |
| Water Retentivity of*4 Light-Sensitivie Material: | | Good | Good | Very Poor (severe background stains) | Very Poor (severe background stains) |
| Background Stains on Print*5: | | No background stains on 5,000th print | No background stains on 6,000 print | Background stains from the start of printing | Background stains from the start of printing |

The evaluations described in Table A-4 above were conducted as follows.

*1Smoothness of photoconductive Layer:
The smoothness (sec/cc) of the light-sensitive material was measured using a Beck's smoothness test machine (manufactured by Kumagaya Riko K.K.) under an air volume condition of 1 cc.

*2Electrostatic Characteristics:
The light-sensitive material was charged with a corona discharge to a voltage of −6 kV for 20 seconds in a dark room at 20° C. and 65% RH using a paper analyzed ("Paper Analyzer SP-428" manufactured by Kawaguchi Denki K.K.). Ten seconds after the corona discharge, the surface potential $V_{10}$ was measured. The sample was allowed to stand in a dark room for an additional 60 seconds, and the potential $V_{70}$ was measured. The dark decay retention rate (DRR; %), i.e., percent retention of potential after dark decay for 60 seconds, was calculated from the following equation:

$$DRR\ (\%) = (V_{70}/V_{10}) \times 100$$

Separately, the surface of the light-sensitive material was charged to −400 V with a corona discharge, then irradiated by visible light of the illuminance of 2.0 lux, and the time required for decay of the surface potential $V_{10}$ to one tenth was measured to obtain an exposure amount $E_{1/10}$ (lux · sec).
Further, in the same manner as described for the measurement of $E_{1/10}$, the time required for decay of the surface potential $V_{10}$ to one-hundredth was measured to obtain an exposure amount $E_{1/100}$ (lux · sec).
The measurements were conducted under conditions of 20° C. and 65% RH (Condition I) or 30° C. and 80% RH (Condition II).

*3Image-Forming Performance
The light-sensitive material and a full-automatic plate making machine (ELP-404V manufactured by Fuji Photo Film Co., Ltd.) were allowed to stand for one day under conditions of 20° C. and 65% RH (Condition I), and the light-sensitive material was subjected to plate making by the full-automatic plate making machine using a developer (ELP-T manufactured by Fuji Photo Film Co., Ltd.) under the same conditions as above to prepare duplicated images. Fog and image quality of the duplicated images thus obtained were visually evaluated.
In the same manner as above except for using high temperature and high humidity conditions of 30° C. and 80% RH (Condition II), the plate making was conducted and the duplicated images were evaluated.

*4Water Retentivity of Ligh-Sensitive Material
The light-sensitive material without subjecting TABLE A-4-continued

| | Example 1 | Example 2 | Comparative Example A | Comparative Example B |
|---|---|---|---|---|
| to plate making was passed once through an etching machine with an aqueous solution obtained by diluting twice an oil-deseusitizing solution (ELP-EX manufactured by Fuji Photo Film Co., Ltd.) with distilled water, and then immersed in an aqueous solution having a pH of 11.0 adjusted using a buffer for 30 seconds. The material thus-treated was mounted on a printing machine (Hamada Star Type 800SX manufactured by Hamada Star K.K.) and printing was conducted. The extent of background stains occurred on the 50th print was visually evaluated. *5Background Stains on Print The light-sensitive material was subjected to plate making in the same manner as described in *3 above, passed once through an etching machine with ELP-EX, and then immersed in an aqueous solution having a pH of 11.0 same as used in *4 above for 30 seconds. Using the offset master thus-obtained printing was conducted by a printing machine (Hamada Star Type 800SX), and a number of prints on which background stains were first visually observed was determined. | | | | |

As can be seen from the results shown in Table A-4 above, the electrostatic characteristics of the light-sensitive materials of the present invention and Comparative Example A were good, and the duplicated images obtained thereon were clear and had good image quality. The light-sensitive material of Example 2 exhibited more preferred results on the electrostatic characteristics and image-forming performance. With the light-sensitive material of Comparative Example B, the degradation of these properties were observed under the severe environmental conditions of 30° C. and 80% RH.

When each of the light-sensitive materials was subjected to the oil-desensitizing treatment, and the degree of hydrophilic property of the non-image areas was evaluated, the severe background stains due to adherence of printing ink were observed on the samples of Comparative Examples A and B. These facts indicated that the hydrophilic property of the non-image areas was insufficient in these samples. Further, when each light-sensitive material was subjected to the plate making, oil-desensitizing treatment and printing, the printing plates formed from the light-sensitive materials according to the present invention provided 5,000 to 6,000 prints of clear images having good quality without the occurrence of background stains. On the contrary, the severe background stains in the non-image areas were observed from the start of printing with the samples of Comparative Examples A and B.

From all these considerations, it is clear that only the electrophotographic lithographic printing plate precursor according to the present invention exhibits good image-forming performance even when the environmental conditions are fluctuated, forms the non-image areas having the sufficient hydrophilic property and does not cause background stains.

EXAMPLES 3 TO 11

By following the same procedure as Example 2 except that 2 g of each of Binder Resins (GPA) shown in Table A-5 below was used in place of 2 g of Binder Resin (GPA-1), each of the electrophotographic light-sensitive materials shown in Table A-5 was produced.

TABLE A-5

| Example No. | Binder Resin (GPA) |
|---|---|
| 3 | GPA-2 |
| 4 | GPA-3 |
| 5 | GPA-4 |
| 6 | GPA-5 |
| 7 | GPA-6 |
| 8 | GPA-7 |
| 9 | GPA-8 |
| 10 | GPA-9 |
| 11 | GPA-10 |

With each of these light-sensitive materials, the electrostatic characteristics and printing property were evaluated in the same procedure as in Example 2.

Each light-sensitive material exhibited almost same results on the electrostatic characteristics and image-forming performance as those in Example 2.

When each light-sensitive material was subjected to the oil-desensitizing treatment and evaluated, good water-retentivity of the light-sensitive material was observed. Further, as a result of plate making and printing, 6,000 prints of good quality were obtained.

EXAMPLE 12

A mixture of 3 g of Binder Resin (GPA-1), 4.6 g of Binder Resin (B-5) shown below, 32.4 g of Binder Resin (B-6) shown below, 200 g of zinc oxide, 0.018 g of Cyanine Dye (A) shown below and 300 g of toluene was dispersed in a ball mill for 3 hours to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (B-5):

-continued

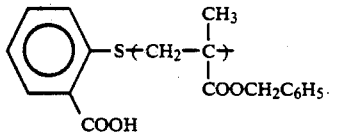

Mw: $6.5 \times 10^3$

Binder Resin (B-6):

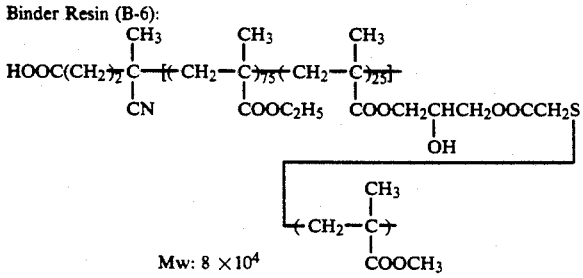

Mw: $8 \times 10^4$

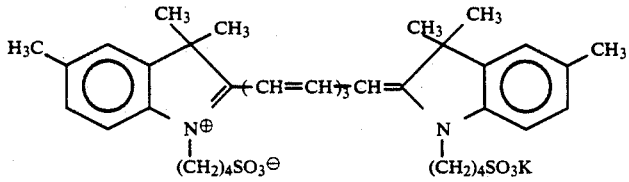

COMPARATIVE EXAMPLE C

An electrophotographic light-sensitive material was prepared in the same manner as described in Example 12 except for using 3 g of Binder Resin (B-4) described above in place of 3 g of Binder Resin (GPA-1).

COMPARATIVE EXAMPLE D

An electrophotographic light-sensitive material was prepared in the same manner as described in Example 12 except for using 24 g of Binder Resin (B-4) described above, 4.6 g of Binder Resin (B-5) described above and 11.4 g of Binder Resin (B-6) described above in place of 3 g of Binder Resin (GPA-1), 4.6 g of Binder Resin (B-5) and 32.4 g of Binder Resin (B-6).

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table A-6 below.

TABLE A-6

| | | Example 12 | Comparative Example C | Comparative Example D |
|---|---|---|---|---|
| Smoothness of Photo-conductive Layer (sec/cc): | | 400 | 400 | 450 |
| Electrostatic*6 Characteristics | | | | |
| $V_{10}$ (−V): | Condition I | 560 | 555 | 500 |
| | Condition II | 550 | 550 | 400 |
| DRR (%): | Condition I | 88 | 85 | 75 |
| | Condition II | 85 | 80 | 65 |
| $E_{1/10}$: | Condition I | 25 | 29 | 45 |
| (erg/cm$^2$) | Condition II | 26 | 33 | 54 |
| $E_{1/100}$: | Condition I | 52 | 60 | 86 |
| (erg/cm$^2$) | Condition II | 53 | 65 | 98 |
| Image-Forming Performance*7 | Condition I | Very Good | Good | No Good |
| | Condition II | Very Good | Good | Poor (background fog, cutting of letters and fine lines) |
| Water-Retentivity of Light-Sensitivie Material: | | Very Good (no background stains) | Poor (background stains) | Good |
| Background Stains on Print: | | No background stains on 6,000th print | Background stains from the start of printing | Background stains and cutting of letters and fine lines from the start of printing |

The electrostatic characteristics and image forming performance described in Table A-6 were evaluated as follows. The other evaluations were conducted in the same manner as described in Example 1.

*6Electrostatic Characteristics:

The light-sensitive material was charged with a

TABLE A-6-continued

| | Example 12 | Comparative Example C | Comparative Example D |
|---|---|---|---|
| corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in a dark room for an additional 180 seconds, and the potential $V_{190}$ was measured. The dark decay retention rate (DRR; %), i.e., precent retention of potential after dark decay for 180 seconds, was calculated from the following equation: $DRR (\%) = (V_{190}/V_{10}) \times 100$ Separately, the surface of the light-sensitive material was charged to −400 V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$). Further, in the same manner as described for the measurement of $E_{1/10}$, the time required for decay of the surface potential $V_{10}$ to one-hundredth was measured to obtain an exposure amount $E_{1/100}$ (erg/cm$^2$). The measurements were conducted under conditions of 20° C. and 65% RH (Condition I) or 30° C. and 80% RH (Condition II). *7Image-Forming Performance: After the light-sensitive material was allowed to stand for one day under Condition I or II, each sample was charged to −5 kV and exposed to light emitted from a gallium-aluminum-arsenic semi-conductor laser (oscillation wavelength: 780 nm; output: 2.0 mW) at an exposure amount of 45 erg/cm$^2$ (on the surface of the photoconductive layer) at a pitch of 25 μm and a scanning speed of 330 m/sec. The thus formed electrostatic latent image was developed with a liquid developer (ELP-T manufactured by Fuji Photo Film Co., Ltd.), followed by fixing. The duplicated image obtained was visually evaluated for fog and image quality. | | | |

As can be seen from the results shown in Table A-6 above, the light-sensitive material of the present invention exhibited the excellent electrostatic characteristics and image forming performance. With the light-sensitive material of Comparative Example C, the electrostatic characteristic of $E_{1/100}$ somewhat decreased. However, the image-forming performance was on an almost practically applicable level depending on the original (for example, the original composed of letters or the original having highly white background). On the other hand, the light-sensitive material of Comparative Example D exhibited the decrease in the electrostatic characteristics, particularly under the severe conditions, and the background stains and cutting of letters and fine lines occurred in the duplicated images formed thereon.

Further, when the light-sensitive material of the present invention was subjected to the plate making, oil-desensitizing treatment and printing, 6,000 prints of good quality were obtained without adherence of printing ink owing to the sufficient hydrophilic property of the non-image areas.

On the contrary, the light-sensitive material of Comparative Example C had insufficient hydrophilic property. Although the light-sensitive material of Comparative Example D exhibited good water-retentivity, only unsatisfactory prints were obtained from the start of printing due to the poor duplicated images formed thereon by plate making.

EXAMPLE 13

A mixture of 4.0 g of Binder Resin (GPA-11) shown below, 6.0 g of Binder Resin (B-7) shown below, 30 g of Binder Resin (B-8) shown below, 200 g of photoconductive zinc oxide, 0.018 g of Cyanine Dye (B) shown below, and 300 g of toluene was dispersed in a ball mill for 3 hours to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (GPA-11):

-continued

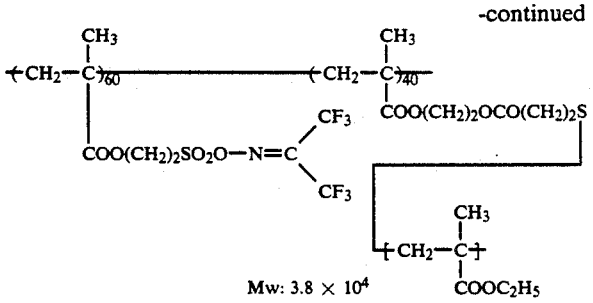

Mw: $3.8 \times 10^4$

Binder Resin (B-7):

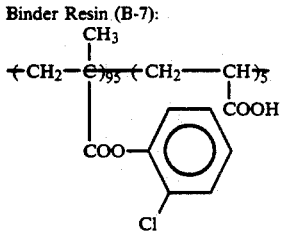

Mw: $6.0 \times 10^3$

Binder Resin (B-8):

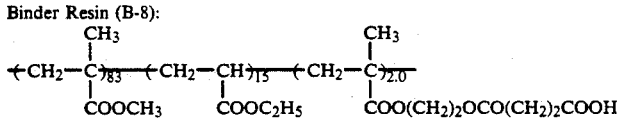

Mw: $5.6 \times 10^4$

Cyanine Dye (B):

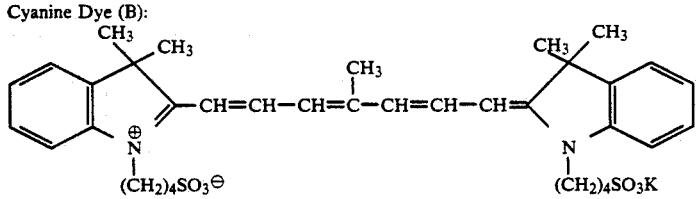

With the resulting light-sensitive material of the present invention, the electrostatic characteristics and image-forming performance were evaluated under the conditions of 30° C. and 80% RH in the same procedure as in Example 12. The results obtained are shown below.

| | |
|---|---|
| $V_{10}$: | −580 V |
| DRR: | 86% |
| $E_{1/10}$: | 22 erg/cm$^2$ |
| $E_{1/100}$: | 38 erg/cm$^2$ |
| Image-Forming Performance: | Very Good |

Further, the light-sensitive material was subjected to plate making, allowed to stand for one minute under a high-pressure mercury lamp of 300 W at a distance of 10 cm for irradiation, and passed once through an etching machine with an aqueous solution obtained by diluting twice an oil-desensitizing solution (ELP-EX) with distilled water to prepare a printing plate. As a result of printing using the resulting printing plate in the same manner in as Example 1, 6,000 prints of clear image having good quality without background stains were obtained.

EXAMPLES 14 TO 19

By following the same procedure as Example 12 except for using 3 g of each of Binder Resins (GPA) shown in Table A-7 below in place of 3 g of Binder Resin (GPA-1), each of the electrophotographic light-sensitive materials shown in Table A-7 was prepared.

TABLE A-7

| Example No. | Binder Resin (GPA) | Electrostatic Characteristics (30° C., 80% RH) $V_{10}$ (−V) | DRR (%) | $E_{1/10}$ (erg/cm$^2$) | $E_{1/100}$ (erg/cm$^2$) | Image-Forming Performance (30° C., 80% RH) | Water-Retentivity of Light-Sensitive Material |
|---|---|---|---|---|---|---|---|
| 14 | GPA-4 | 555 | 85 | 27 | 55 | Very Good | Very Good (no background stains) |
| 15 | GPA-6 | 555 | 86 | 26 | 53 | " | Very Good (no background stains) |
| 16 | GPA-7 | 550 | 86 | 24 | 54 | " | Very Good (no background stains) |
| 17 | GPA-8 | 545 | 85 | 27 | 56 | " | Very Good (no background stains) |
| 18 | GPA-9 | 550 | 86 | 28 | 57 | " | Very Good (no background stains) |
| 19 | GPA-3 | 555 | 87 | 26 | 55 | " | Very Good |

TABLE A-7-continued

| Example No. | Binder Resin (GPA) | Electrostatic Characteristics (30° C., 80% RH) $V_{10}$ (−V) | DRR (%) | $E_{1/10}$ (erg/cm²) | $E_{1/100}$ (erg/cm²) | Image-Forming Performance (30° C., 80% RH) | Water-Retentivity of Light-Sensitive Material |
|---|---|---|---|---|---|---|---|
| | | | | | | | (no background stains) |

As can be seen from the results shown in Table A-7 above, the light-sensitive materials according to the present invention exhibited the excellent electrostatic characteristics even under the high temperature and high humidity conditions of 30° C. and 80% RH, as well as under the normal conditions of 20° C. and 65% RH. The image-forming performance and water retentivity of each light-sensitive material were also good. When each of the light-sensitive material was employed as an offset master plate, 6,000 prints of clear image having good quality without background stains were obtained.

EXAMPLE 20

A mixture of 6 g of Binder Resin (GPA-12) shown below, 34 g of Binder Resin (B-9) shown below, 200 g of photoconductive zinc oxide, 0.03 g of uranine, 0.075 g of Rose Bengale, 0.045 g of bromophenol blue, 0.1 g of phthalic anhydride, and 240 g of toluene was dispersed in a ball mill for 4 hours to prepare a coating composition for a light-sensitive layer. The coating composition was coated on paper, which had been subjected to electrically conductive treatment, by a wire bar at a dry coverage of 20 g/m², and dried for 3 minutes at 100° C. Then, the coated material was allowed to stand in a dark place for 24 hours under the conditions of 20° C. and 65% RH to prepare an electrophotographic light-sensitive material.

Binder Resin (GPA-12):

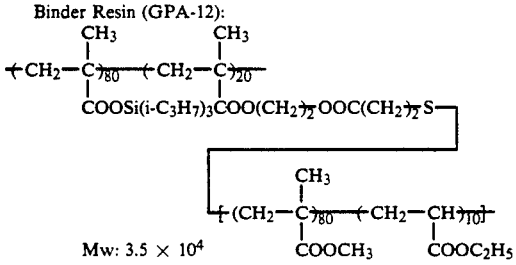

Mw: 3.5 × 10⁴

Binder Resin (B-9):

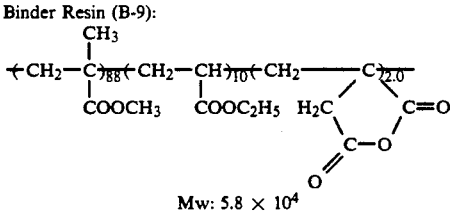

Mw: 5.8 × 10⁴

With the light-sensitive material thus-prepared, the electrostatic characteristics and image-forming performance were evaluated under the conditions of 30° C. and 80% RH in the same procedure as in Example 1. The results obtained are shown below.

| | |
|---|---|
| $V_{10}$: | −560 V |
| DRR: | 92% |
| $E_{1/10}$: | 11.3 lux · sec |
| $E_{1/100}$: | 32 lux · sec |

The duplicated images obtained were clear and free from the occurrence of background stains and cutting of fine lines even under the severe conditions of high temperature and high humidity, as well as under the normal conditions.

Further, the light-sensitive material was subjected to plate making, immersed in a 60% aqueous solution of methyl ethyl ketone containing 0.5 moles of monoethanolamine for one minute, and then passed once through an etching machine with an aqueous solution obtained by dissolving twice an oil-desensitizing solution (ELP-EX) with distilled water to conduct the oil-desensitizing treatment. As a result of printing using the resulting printing plate in the same manner as in Example 1, 6,000 prints of clear image having good quality without background stains were obtained.

EXAMPLE 21

A mixture of 2 g (solid basis, hereinafter the same) of Binder Resin (GPB-1) according to the present invention, 38 g of Binder Resin (B-1) shown below, 200 g of photoconductive zinc oxide, 0.03 g of uranine, 0.06 g of Rose Bengal, 0.02 g of tetrabromophenol blue, 0.20 g of maleic anhydride and 300 g of toluene was dispersed by a homogenizer (manufactured by Nippon Seiki K.K.) at $1\times10^4$ r.p.m. for 10 minutes to prepare a coating composition for a light-sensitive layer. The coating composition was coated on paper, which had been subjected to electrically conductive treatment, by a wire bar at a dry coverage of 20 g/m², followed by drying at 100° C. for 3 minutes. The coated material was allowed to stand in a dark place at 20° C. and 65% RH (relative humidity) for 24 hours to prepare an electrophotographic light-sensitive material.

Binder Resin (B-1):

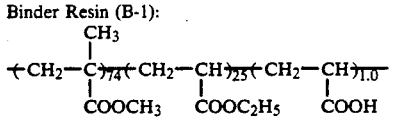

Mw: 5.3 × 10⁴ (weight ratio)

EXAMPLE 22

An electrophotographic light-sensitive material was prepared in the same manner as described in Example 21 except for using 5.7 g of Binder Resin (B-2) shown below and 32.3 g of Binder Resin (B-3) shown below in place of 38 g of Binder Resin (B-1).

Binder Resin (B-2):

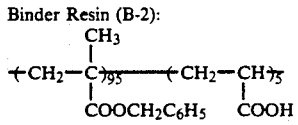

Mw: 6.0 × 10³ (weight ratio)

Binder Resin (B-3):

-continued

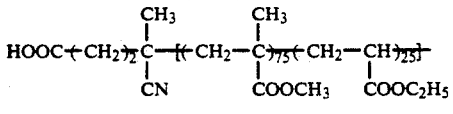

Mw: $6.5 \times 10^4$ (weight ratio)

COMPARATIVE EXAMPLE A-2

An electrophotographic light-sensitive material was prepared in the same manner as described in Example 21 except that 40 g of Binder Resin (B-1) described above was used as a binder resin in place of 2 g of Binder Resin (GPB-1) and 38 g of Binder Resin (B-1).

COMPARATIVE EXAMPLE B-2

An electrophotographic light-sensitive material was prepared in the same manner as described in Example 21 except that 2 g of Binder Resin (B-4) shown below was used in place of 2 g of Binder Resin (GPB-1).

Binder Resin (B-4):

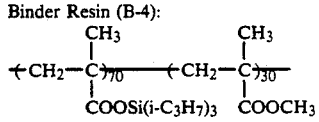

Mw: $4 \times 10^4$ (weight ratio)

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table B-3 below.

TABLE B-3

| | | Example 21 | Example 22 | Comparative Example A-2 | Comparative Example B-2 |
|---|---|---|---|---|---|
| Smoothness of Photo-*1 conductive Layer (sec/cc): | | 450 | 450 | 430 | 460 |
| Electrostatic*2 Characteristics: | | | | | |
| $V_{10}$ (−V): | Condition I | 570 | 590 | 580 | 565 |
| | Condition II | 555 | 585 | 560 | 540 |
| DRR (%): | Condition I | 88 | 93 | 85 | 85 |
| | Condition II | 83 | 90 | 78 | 79 |
| $E_{1/10}$: | Condition I | 13.8 | 11.3 | 14.0 | 14.8 |
| (lux · sec) | Condition II | 15.5 | 13.3 | 17.8 | 19.3 |
| $E_{1/100}$: | Condition I | 43 | 35 | 52 | 58 |
| (lux · sec) | Condition II | 53 | 40 | 63 | 73 |
| Image-Forming Performance*3: | Condition I | Good | Very Good | Good | Good |
| | Condition II | Good | Very Good | Good | Poor (reduced Dmax, cutting of fine lines) |
| Water-Retentivity of*4 Light-Sensitivie Material: | | Good | Good | Very Poor (severe background stains) | Very Poor (severe background stains) |
| Background Stains on Print*5 | | No background stains on 5,000th print | No background stains on 6,000 print | Background stains from the start of printing | Background stains from the start of printing |

The evaluations described in Table B-3 above were conducted as follows.

*1Smoothness of photoconductive Layer:
The smoothness (sec/cc) of the light-sensitive material was measured using a Beck's smoothness test machine (manufactured by Kumagaya Riko K.K.) under an air volume condition of 1 cc.

*2Electrostatic Characteristics:
The light-sensitive material was charged with a corona discharge to a voltage of −6 kV for 20 seconds in a dark room at 20° C. and 65% RH using a paper analyzed ("Paper Analyzer SP-428" manufactured by Kawaguchi Denki K.K.). Ten seconds after the corona discharge, the surface potential $V_{10}$ was measured. The sample was allowed to stand in a dark room for an additional 60 seconds, and the potential $V_{70}$ was measured. The dark decay retention rate (DRR; %), i.e., percent retention of potential after dark decay for 60 seconds, was calculated from the following equation:

$$DRR\ (\%) = (V_{70}/V_{10}) \times 100$$

Separately, the surface of the light-sensitive material was charged to −400 V with a corona discharge, then irradiated by visible light of the illuminance of 2.0 lux, and the time required for decay of the surface potential $V_{10}$ to one tenth was measured to obtain an exposure amount $E_{1/10}$ (lux · sec).
Further, in the same manner as described for the measurement $E_{1/10}$, the time required for decay of the surface potential $V_{10}$ to one-hundredth was measured to obtain an exposure amount $E_{1/100}$ (lux · sec).
The measurements were conducted under conditions of 20° C. and 65% RH (Condition I) or 30° C. and 80% RH TABLE B-3-continued

| | Example 21 | Example 22 | Comparative Example A-2 | Comparative Example B-2 |
|---|---|---|---|---|

(Condition II).
*3Image-Forming Performance
The light-sensitive material and a full-automatic plate making machine (ELP-404V manufactured by Fuji Photo Film Co., Ltd.) were allowed to stand for one day under conditions of 20° C. and 65% RH (Conditon I), and the light-sensitive material was subjected to plate making by the full-automatic plate making machine using a developer (ELP-T manufactured by Fuji Photo Film Co., Ltd.) under the same conditions as above to prepare duplicated images. Fog and image quality of the duplicated images thus obtained were visually evaluated. In the same manner as above except for using high temperature and high humidity conditions of 30° C. and 80% RH (Condition II), the plate making was conducted and the duplicated images were evaluated.
*4Water Retentivity of Light-Sensitive Material
The light-sensitive material without subjecting to plate making was passed once through an etching machine with an aqueous solution obtained by diluting twice an oil-deseusitizing solution (ELP-EX manufactured by Fuji Photo Film Co., Ltd.) with distilled water, and then immersed in an aqueous solution having a pH of 11.0 adjusted using a buffer for 30 seconds. The material thus-treated was mounted on a printing machine (Hamada Star Type 800SX manufactured by Hamada Star K.K.) and printing was conducted. The extent of background stains occurred on the 50th print was visually evaluated.
*5Background Stains on Print
The light-sensitive material was subjected to plate making in the same manner as described in *3 above, passed once through an etching machine with ELP-EX, and then immersed in an aqueous solution having a pH of 11.0 same as used in *4 above for 30 seconds. Using the offset master thus-obtained printing was conducted by a printing machine (Hamada Star Type 800SX), and a number of prints on which background stains were first visually observed was determined.

As can be seen from the results shown in Table B-3 above, the electrostatic characteristics of the light-sensitive materials of the present invention and Comparative Example A-2 were good, and the duplicated images obtained thereon were clear and had good image quality. The light-sensitive material of Example 22 exhibited the more preferred results on the electrostatic characteristics and image-forming performance. With the light-sensitive material of Comparative Example B-2, the degradation of these properties were observed under the severe environmental conditions of 30° C. and 80% RH.

When each of the light-sensitive materials was subjected to the oil-desensitizing treatment, and the degree of hydrophilic property of the non-image areas was evaluated, the severe background stains due to adherence of printing ink were observed on the samples of Comparative Examples A-2 and B-2. These facts indicated that the hydrophilic property of the non-image areas was insufficient in these samples. Further, when each light-sensitive material was subjected to the plate making, oil-desensitizing treatment and printing, the printing plates formed from the light-sensitive materials according to the present invention provided 5,000 to 6,000 prints of clear images having good quality without the occurrence of background stains. On the contrary, the severe background stains in the non-image areas were observed from the start of printing with the samples of Comparative Examples A-2 and B-2.

From all these considerations, it is clear that only the electrophotographic lithographic printing plate precursor according to the present invention exhibits good image-forming performance even when the environmental conditions are fluctuated, forms the non-image areas having the sufficient hydrophilic property and does not cause background stains.

EXAMPLES 23 TO 31

By following the same procedure as Example 22 except that 2 g of each of Binder Resins (GPB) shown in Table B-4 below was used in place of 2 g of Binder Resin (GPB-1), each of the electrophotographic light-sensitive materials shown in Table B-4 was produced.

TABLE B-4

| Example No. | Binder Resin (GPB) |
|---|---|
| 23 | GPB-2 |
| 24 | GPB-3 |
| 25 | GPB-4 |
| 26 | GPB-5 |
| 27 | GPB-6 |
| 28 | GPB-7 |
| 29 | GPB-8 |
| 30 | GPB-9 |
| 31 | GPB-10 |

With each of these light-sensitive materials, the electrostatic characteristics and printing property were evaluated in the same procedure as in Example 22.

Each light-sensitive material exhibited almost same results on the electrostatic characteristics and image-forming performance as those in Example 22.

When each light-sensitive material was subjected to the oil-desensitizing treatment and evaluated, good water-retentivity of the light-sensitive material was observed. Further, as a result of plate making and printing, 6,000 prints of good quality were obtained.

EXAMPLE 32

A mixture of 3 g of Binder Resin (GPB-6), 4.6 g of Binder Resin (B-5) shown below, 32.4 g of Binder Resin (B-6) shown below, 200 g of zinc oxide, 0.018 g of Cyanine Dye (A) shown below and 300 g of toluene was dispersed by a homogenizer at $1\times10^4$ r.p.m. for 10 minutes to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (B-5):

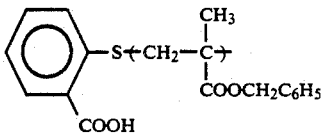

Mw: $6.5\times10^3$

Binder Resin (B-6):

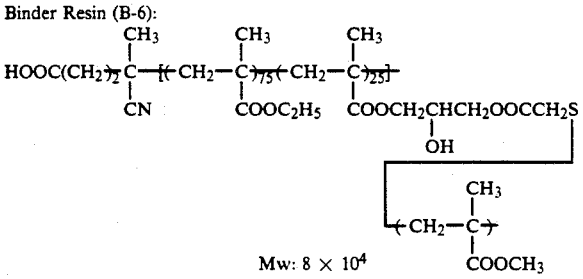

Mw: $8\times10^4$

Cyanine Dye (A):

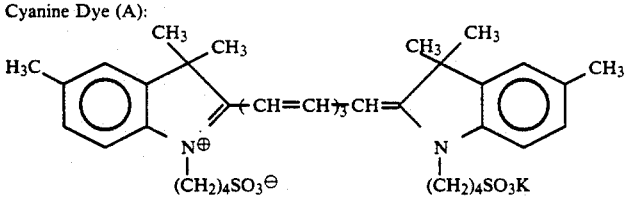

COMPARATIVE EXAMPLE C-2

An electrophotographic light-sensitive material was prepared in the same manner as described in Example 32 except for using 3 g of Binder Resin (B-4) described above in place of 3 g of Binder Resin (GPB-6).

COMPARATIVE EXAMPLE D-2

An electrophotographic light-sensitive material was prepared in the same manner as described in Example 32 except for using 24 g of Binder Resin (B-4) described above, 4.6 g of Binder Resin (B-5) described above and 11.4 g of Binder Resin (B-6) described above in place of 3 g of Binder Resin (GPB-6), 4.6 g of Binder Resin (B-5) and 32.4 g of Binder Resin (B-6).

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table B-5 below.

TABLE B-5

| | | Example 32 | Comparative Example C-2 | Comparative Example D-2 |
|---|---|---|---|---|
| Smoothness of Photo conductive Layer (sec/cc): | | 400 | 400 | 450 |
| Electrostatic Characteristics*6 | | | | |
| $V_{10}$ (−V): | Condition I | 610 | 605 | 500 |
| | Condition II | 595 | 590 | 415 |
| DRR (%): | Condition I | 88 | 84 | 72 |
| | Condition II | 84 | 80 | 63 |
| $E_{1/10}$: | Condition I | 23 | 30 | 63 |
| (erg/cm$^2$) | Condition II | 26 | 34 | 75 |
| $E_{1/100}$: | Condition I | 48 | 65 | 95 |
| (erg/cm$^2$ | Condition II | 51 | 68 | 106 |
| Image-Forming Performance*7 | Condition I | Very Good | Good | No Good |
| | Condition II | Very Good | Good | Poor (background fog, cutting of letters and fine lines) |
| Water-Retentivity of Light-Sensitivie Material: | | Very Good (no background | Poor (background | Good |

TABLE B-5-continued

| | Example 32 | Comparative Example C-2 | Comparative Example D-2 |
|---|---|---|---|
| | stains) | stains) | |
| Background Stains on Print: | No background stains on 6,000th print | Background stains from the start of printing | Background stains and cutting of letters and fine lines from the start of printing |

The electrostatic characteristics and image forming performance described in Table B-5 were evaluated as follows. The other evaluations were conducted in the same manner as described in Example 21.

*6Electrostatic Characteristics:

The light-sensitive material was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in a dark room for an additional 180 seconds, and the potential $V_{190}$ was measured. The dark decay retention rate (DRR; %), i.e., percent retention of potential after dark decay for 180 seconds, was calculated from the following equation:

$$DRR\ (\%) = (V_{190}/V_{10}) \times 100$$

Separately, the surface of the light-sensitive material was charged to −400 V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$). Further, in the same manner as described for the measurement of $E_{1/10}$, the time required for decay of the surface potential $V_{10}$ to one-hundredth was measured to obtain an exposure amount $E_{1/100}$ (erg/cm$^2$). The measurements were conducted under conditions of 20° C. and 65% RH (Condition I) or 30° C. and 80% RH (Condition II).

*7Image-Forming Performance:

After the light-sensitive material was allowed to stand for one day under Condition I or II, each sample was charged to −5 kV and exposed to light emitted from a gallium-aluminum-arsenic semi-conductor laser (oscillation wavelength: 780 nm; output: 2.0 mW) at an exposure amount of 45 erg/cm$^2$ (on the surface of the photoconductive layer) at a pitch of 25 μm and a scanning speed of 330 m/sec. The thus formed electrostatic latent image was developed with a liquid developer (ELP-T manufactured by Fuji Photo Film Co., Ltd.), followed by fixing. The duplicated image obtained was visually evaluated for fog and image quality As can be seen from the results shown in Table B-5 above, the light-sensitive material of the present invention exhibited the excellent electrostatic characteristics and image forming performance. With the light-sensitive material of Comparative Example C-2,the electrostatic characteristic of $E_{1/100}$ somewhat decreased. However, the image-forming performance was on an almost practically applicable level depending on the original (for example, the original composed of letters or the original having highly white background). On the other hand, the light-sensitive material of Comparative Example D-2 exhibited the decrease in the electrostatic characteristics, particularly under the severe conditions, and the background stains and cutting of letters and fine lines occurred in the duplicated images formed thereon.

Further, when the light-sensitive material of the present invention was subjected to the plate making, oil-desensitizing treatment and printing, 6,000 prints of good quality were obtained without adherence of printing ink owing to the sufficient hydrophilic property of the non-image areas.

On the contrary, the light-sensitive material of Comparative Example C-2 had insufficient hydrophilic property. Although the light-sensitive material of Comparative Example D-2 exhibited good water-retentivity, only unsatisfactory prints were obtained from the start of printing due to the poor duplicated images formed thereon by plate making.

EXAMPLE 33

A mixture of 4.0 g of Binder Resin (GPB-11) shown below, 6.0 g of Binder Resin (B-7) shown below, 30 g of Binder Resin (B-8) shown below, 200 g of photoconductive zinc oxide, 0.018 g of Cyanine Dye (B) shown below, and 300 g of toluene was dispersed in a ball mill for 3 hours to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (GPB-11):

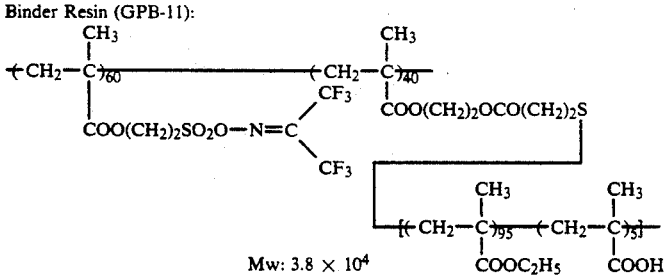

Mw: $3.8 \times 10^4$

Binder Resin (B-7):

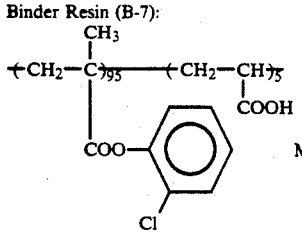

Mw: $6.0 \times 10^3$

Binder Resin (B-8):

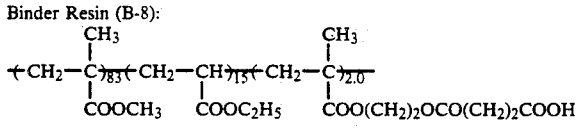

Mw: $5.6 \times 10^4$

Cyanine Dye (B):

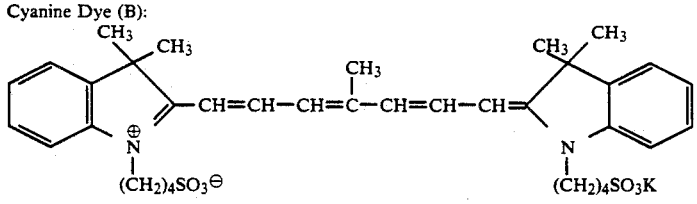

With the resulting light-sensitive material of the present invention, the electrostatic characteristics and image-forming performance were evaluated under the conditions of 30° C. and 80% RH in the same procedure as in Example 32. The results obtained are shown below.

| | |
|---|---|
| $V_{10}$: | −590 V |
| DRR: | 85% |
| $E_{1/10}$: | 25 erg/cm$^2$ |
| $E_{1/100}$: | 40 erg/cm$^2$ |
| Image-Forming Performance: | Very Good |

Further, the light-sensitive material was subjected to plate making, allowed to stand for one minute under a high-pressure mercury lamp of 300 W at a distance of 10 cm for irradiation, and passed once through an etching machine with an aqueous solution obtained by diluting twice an oil-desensitizing solution (ELP-EX) with distilled water to prepare a printing plate. As a result of printing using the resulting printing plate in the same manner in Example 21, 6,000 prints of clear image having good quality without background stains were obtained.

EXAMPLES 34 TO 39

By following the same procedure as Example 22 except for using 3 g of each of Binder Resins (GPB) shown in Table B-6 below in place of 3 g of Binder Resin (GPB-6), each of the electrophotographic light-sensitive materials shown in Table B-6 was prepared.

TABLE B-5

| Example No. | Binder Resin (GPB) | Electrostatic Characteristics (30° C., 80% RH) $V_{10}$ (−V) | DRR (%) | $E_{1/10}$ (erg/cm$^2$) | $E_{1/100}$ (erg/cm$^2$) | Image-Forming Performance (30° C., 80% RH) | Water-Retentivity of Light-Sensitive Material |
|---|---|---|---|---|---|---|---|
| 34 | GPB-4 | 555 | 85 | 28 | 58 | Very Good | Very Good (no background stains) |
| 35 | GPB-6 | 555 | 86 | 25 | 55 | " | Very Good (no background stains) |
| 36 | GPB-7 | 550 | 86 | 25 | 54 | " | Very Good (no background stains) |
| 37 | GPB-8 | 545 | 85 | 29 | 55 | " | Very Good (no background stains) |
| 38 | GPB-9 | 550 | 86 | 30 | 60 | " | Very Good (no background stains) |
| 39 | GPB-3 | 555 | 87 | 25 | 58 | " | Very Good |

TABLE B-5-continued

| Example No. | Binder Resin (GPB) | Electrostatic Characteristics (30° C., 80% RH) $V_{10}$ (−V) | DRR (%) | $E_{1/10}$ (erg/cm²) | $E_{1/100}$ (erg/cm²) | Image-Forming Performance (30° C., 80% RH) | Water-Retentivity of Light-Sensitive Material |
|---|---|---|---|---|---|---|---|
| | | | | | | | (no background stains) |

As can be seen from the results shown in Table B-6 above, the light-sensitive materials according to the present invention exhibited the excellent electrostatic characteristics even under the high temperature and high humidity conditions of 30° C. and 80% RH, as well as under the normal conditions of 20° C. and 65% RH. The image-forming performance and water retentivity of each light-sensitive material were also good. When, each of the light-sensitive material was employed as an offset master plate, 6,000 prints of clear image having good quality without background stains were obtained.

EXAMPLE 40

A mixture of 6 g of Binder Resin (GPB-12) shown below, 34 g of Binder Resin (B-9) shown below, 200 g of photoconductive zinc oxide, 0.03 g of uranine, 0.075 g of Rose Bengale, 0.045 g of bromophenol blue, 0.1 g of phthalic anhydride, and 240 g of toluene was dispersed in a ball mill for 4 hours to prepare a coating composition for a light-sensitive layer. The coating composition was coated on paper, which had been subjected to electrically conductive treatment, by a wire bar at a dry coverage of 20 g/m², and dried for 3 minutes at 100° C. Then, the coated material was allowed to stand in a dark place for 24 hours under the conditions of 20° C. and 65% RH to prepare an electrophotographic light-sensitive material.

Binder Resin (GPB-12):

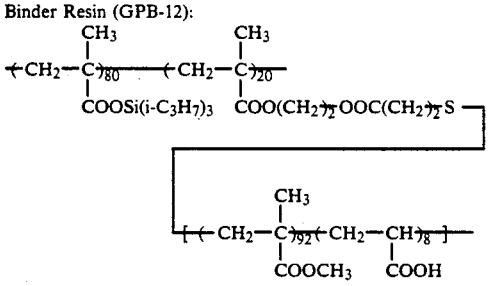

Mw: 3.5 × 10⁴

Binder Resin (B-9):

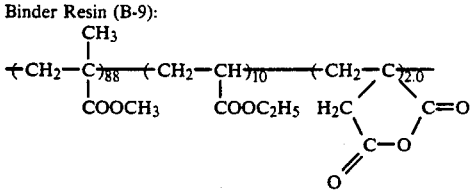

Mw: 5.8 × 10⁴

With the light-sensitive material thus-prepared, the electrostatic characteristics and image-forming performance were evaluated under the conditions of 30° C. and 80% RH in the same procedure as in Example 21. The results obtained are shown below.

| | |
|---|---|
| $V_{10}$: | −550 V |
| DRR: | 90% |
| $E_{1/10}$: | 11.3 lux · sec |
| $E_{1/100}$: | 40 lux · sec |

The duplicated images obtained were clear and free from the occurrence of background stains and cutting of fine lines even under the severe conditions of high temperature and high humidity, as well as under the normal conditions.

Further, the light-sensitive material was subjected to plate making, immersed in a 60% aqueous solution of methyl ethyl ketone containing 0.5 moles of monoethanolamine for one minute, and then passed once through an etching machine with an aqueous solution obtained by dissolving twice an oil-desensitizing solution (ELP-EX) with distilled water to conduct the oil-desensitizing treatment. As a result of printing using the resulting printing plate in the same manner as in Example 1, 6,000 prints of clear image having good quality without background stains were obtained.

EXAMPLE 41

A mixture of 2 g (solid basis, hereinafter the same) of Binder Resin (GPC-1) according to the present invention, 38 g of Binder Resin (B-1) shown below, 200 g of photoconductive zinc oxide, 0.03 g of uranine, 0.06 g of Rose Bengal, 0.02 g of tetrabromophenol blue, 0.20 g of maleic anhydride and 300 g of toluene was dispersed by a homogenizer (manufactured by Nippon Seiki K.K.) at 6×10³ r.p.m. for 10 minutes to prepare a coating composition for a light-sensitive layer. The coating composition was coated on paper, which had been subjected to electrically conductive treatment, by a wire bar at a dry coverage of 20 g/m², followed by drying at 100° C. for 3 minutes. The coated material was allowed to stand in a dark place at 20° C. and 65% RH (relative humidity) for 24 hours to prepare an electro-photographic light-sensitive material.

Binder Resin (B-1):

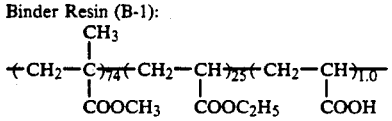

Mw: 5.3 × 10⁴ (weight ratio)

EXAMPLE 42

An electrophotographic light-sensitive material was prepared in the same manner as described in Example 41 except for using 5.7 g of Binder Resin (B-2) shown below and 32.3 g of Binder Resin (B-3) shown below in place of 38 g of Binder Resin (B-1).

Binder Resin (B-2):

-continued

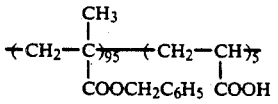

Mw: $6.0 \times 10^3$ (weight ratio)

Binder Resin (B-3):

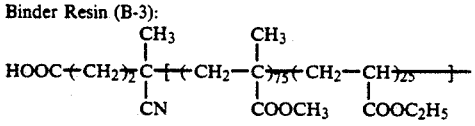

Mw: $6.5 \times 10^4$ (weight ratio)

COMPARATIVE EXAMPLE A-3

An electrophotographic light-sensitive material was prepared in the same manner as described in Example 41 except that 40 g of Binder Resin (B-1) described above was used as a binder resin in place of 2 of Binder Resin (GPC-1) and 38 9 of Binder Resin (B-1).

COMPARATIVE EXAMPLE B-3

An electrophotographic light-sensitive material was prepared in the same manner as described in Example 21 except that 2 g of Binder Resin (B-4) shown below was used in place of 2 g of Binder Resin (GPC-1).

Binder Resin (B-4):

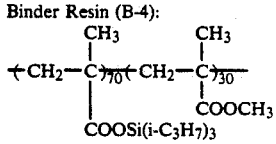

Mw: $4 \times 10^4$ (weight ratio)

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table C-2 below.

TABLE C-2

| | | Example 41 | Example 42 | Comparative Example A-3 | Comparative Example B-3 |
|---|---|---|---|---|---|
| Smoothness of Photo-*1 conductive Layer (sec/cc): | | 450 | 500 | 450 | 460 |
| Electrostatic*2 Characteristics: | | | | | |
| $V_{10}$ (−V): | Condition I | 570 | 600 | 560 | 580 |
| | Condition II | 555 | 585 | 545 | 560 |
| DRR (%): | Condition I | 86 | 94 | 87 | 85 |
| | Condition II | 80 | 90 | 79 | 79 |
| $E_{1/10}$: | Condition I | 14.8 | 11.8 | 15.3 | 15.8 |
| (lux · sec) | Condition II | 16.3 | 13.9 | 17.9 | 18.6 |
| $E_{1/100}$: | Condition I | 51 | 39 | 55 | 58 |
| (lux · sec) | Condition II | 58 | 42 | 65 | 74 |
| Image-Forming | Condition I | Good | Very Good | Good | Good |
| Performance*3: | Condition II | Good | Very Good | Good | Poor (reduced Dmax, cutting of fine lines) |
| Water-Retentivity of*4 Light-Sensitivie Material: | | Good | Good (severe back- | Very Poor (severe back-ground stains) | Very Poor ground stains) |
| Background Stains on Print*5: | | No background stains on 5,000th print | No background stains on 6,000 print | Background stains from the start of printing | Background stains from the start of printing |

The evaluations described in Table C-2 above were conducted as follows.

*1Smoothness of photoconductive Layer:
The smoothness (sec/cc) of the light-sensitive material was measured using a Beck's smoothness test machine (manufactured by Kumagaya Riko K.K.) under an air volume condition of 1 cc.

*2Electrostatic Characteristics:
The light-sensitive material was charged with a corona discharge to a voltage of −6 kV for 20 seconds in a dark room at 20° C. and 65% RH using a paper analyzed ("Paper Analyzer SP-428" manufactured by Kawaguchi Denki K.K.). Ten seconds after the corona discharge, the surface potential $V_{10}$ was measured. The sample was allowed to stand in a dark room for an additional 60 seconds, and the potential $V_{70}$ was measured. The dark decay retention rate (DRR; %), i.e., percent retention of potential after dark decay for 60 seconds, was calculated from the following equation:

$DRR (\%) = (V_{70}/V_{10}) \times 100$

Separately, the surface of the light-sensitive material was charged to −400 V with a corona discharge, then irradiated by visible light of the illuminance of 2.0 lux, and the time required for decay of the surface potential $V_{10}$ to one tenth was measured to obtain an TABLE C-2-continued exposure amount $E_{1/10}$ (lux · sec).
Further, in the same manner as described for the measurement of $E_{1/10}$, the time required for decay of the surface potential $V_{10}$ to one-hundredth was measured to obtain an exposure amount $E_{1/100}$ (lux · sec).
The measurements were conducted under conditions of 20° C. and 65% RH (Condition I) or 30° C. and 80% RH (Condition II).
*3Image-Forming Performance
The light-sensitive material and a full-automatic plate making machine (ELP-404V manufactured by Fuji Photo Film Co., Ltd.) were allowed to stand for one day under conditions of 20° C. and 65% RH (Condition I), and the light-sensitive material was subjected to plate making by the full-automatic plate making machine using a developer (ELP-T manufactured by Fuji Phote Film Co., Ltd.) under the same conditions as above to prepare duplicated images. Fog and image quality of the duplicated images thus obtained were visually evaluated.
In the same manner as above except for using high temperature and high humidity conditions of 30° C. and 80% RH (Condition II), the plate making was conducted and the duplicated images were evaluated.
*4Water Retentivity of Light-Sensitive Material
The light-sensitive material without subjecting to plate making was passed once through an etching machine with an aqueous solution obtained by diluting twice an oil-deseusitizing solution (ELP-EX manufactured by Fuji Photo Film Co., Ltd.) with distilled water, and then immersed in an aqueous solution having a pH of 11.0 adjusted using a buffer for 30 seconds. The material thus-treated was mounted an a printing machine (Hamada Star Type 800SX manufactured by Hamada Star K.K.) and printing was conducted. The extent of background stains occurred on the 50th print was visually evaluated.
*5Background Stains on Print
The light-sensitive material was subjected to plate making in the same manner as described in 8[3] above, passed once through an etching machine with ELP-EX, and then immersed in an aqueous solution having a pH of 11.0 same as used in *4 above for 30 seconds. Using the offset master thus-obtained printing was conducted by a printing machine (Hamada Star Type 800SX), and a number of prints on which background stains were first visually observed was determined.

As can be seen from the results shown in Table C-2 above, the electrostatic characteristics of the light-sensitive materials of the present invention and Comparative Example A-3 were good, and the duplicated images obtained thereon were clear and had good image quality. The light-sensitive material of Example 42 exhibited the more preferred results on the electrostatic characteristics and image-forming performance. With the light-sensitive material of Comparative Example B-3, the degradation of these properties were observed under the severe environmental conditions of 30° C. and 80% RH.

When each of the light-sensitive materials was subjected to the oil-desensitizing treatment, and the degree of hydrophilic property of the non-image areas was evaluated, the severe background stains due to adherence of printing ink were observed on the samples of Comparative Examples A-3 and B-3. These facts indicated that the hydrophilic property of the non-image areas was insufficient in these samples. Further, when each light-sensitive material was subjected to the plate making, oil-desensitizing treatment and printing, the printing plates formed from the light-sensitive materials according to the present invention provided 5,000 to 6,000 prints of clear images having good quality without the occurrence of background stains. On the contrary, the severe background stains in the non-image areas were observed from the start of printing with the samples of Comparative Examples A 3 and B 3.

From all these considerations, it is clear that only the electrophotographic lithographic printing plate precursor according to the present invention exhibits good image-forming performance even when the environmental conditions are fluctuated, forms the non-image areas having the sufficient hydrophilic property and does not cause background stains.

EXAMPLES 43 TO 51

By following the same procedure as Example 42 except that 2 g of each of Binder Resins (GPC) shown in Table C-3 below was used in place of 2 g of Binder Resin (GPC-1), each of the electrophotographic light-sensitive materials shown in Table C-3 was produced.

TABLE C-3

| Example No. | Binder Resin (GPC) |
|---|---|
| 43 | GPC-2 |
| 44 | GPC-3 |
| 45 | GPC-4 |
| 46 | GPC-5 |
| 47 | GPC-6 |
| 48 | GPC-7 |
| 49 | GPC-8 |
| 5) | GPC-9 |
| 51 | GPC-10 |

With each of these light-sensitive materials, the electrostatic characteristics and printing property were evaluated in the same procedure as in Example 42.

Each light-sensitive material exhibited almost same results on the electrostatic characteristics and image forming performance as those in Example 42.

When each light-sensitive material was subjected to the oil-desensitizing treatment and evaluated, good water-retentivity of the light-sensitive material was observed. Further, as a result of plate making and printing, 6,000 prints of good quality were obtained.

EXAMPLE 52

A mixture of 3 g of Binder Resin (GPC-5), 4.6 g of Binder Resin (B-5) shown below, 32.4 g of Binder Resin (B-6) shown below, 200 g of zinc oxide, 0.018 g of Cyanine Dye (A) shown below and 300 g of toluene was dispersed by a homogenizer at $6\times10^3$ r.p.m. for 10 minutes to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (B-5):

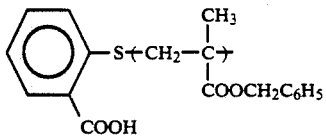

Mw: $6.5\times10^3$

Binder Resin (B-6):

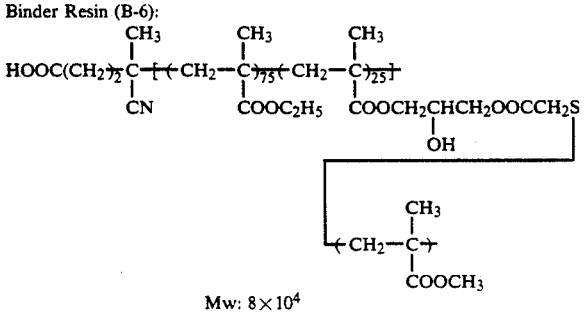

Mw: $8\times10^4$

Cyanine Dye (A):

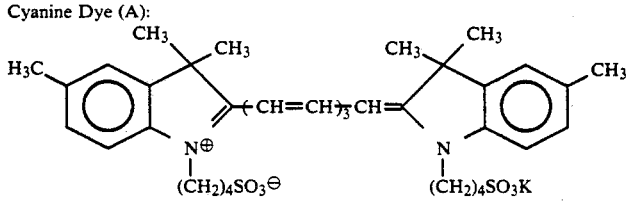

COMPARATIVE EXAMPLE C-3

An electrophotographic light-sensitive material was prepared in the same manner as described in Example 52 except for using 3 g of Binder Resin (B-4) described above in place of 3 g of Binder Resin (GPC-5).

COMPARATIVE EXAMPLE D-3

An electrophotographic light-sensitive material was prepared in the same manner as described in Example 52 except for using 24 g of Binder Resin (B-4) described above, 4.6 g of Binder Resin (B-5) described above and 11.4 g of Binder Resin (B-6) described above in place of 3 g of Binder Resin (GPC-5), 4.6 g of Binder Resin (B-5) and 32.4 g of Binder Resin (B-6).

With each of the light-sensitive materials thus prepared, film property (surface smoothness), electrostatic characteristics, image-forming performance, oil-desensitivity of a photoconductive layer (expressed in terms of contact angle of the photoconductive layer with water after oil-desensitizing treatment), and printing property were evaluated.

The results obtained are shown in Table C-4 below.

TABLE C-4

| | | Example 52 | Comparative Example C-3 | Comparative Example D-3 |
|---|---|---|---|---|
| Smoothness of Photoconductive Layer (sec/cc): | | 450 | 460 | 480 |
| Electostatic Characteristics*6: | | | | |
| $V_{10}$ (−V): | Condition I | 625 | 630 | 620 |
| | Condition II | 600 | 600 | 595 |
| DRR (%): | Condition I | 87 | 86 | 77 |
| | Condition II | 84 | 79 | 63 |
| $E_{1/10}$: | Condition I | 25 | 35 | 50 |

TABLE C-4-continued

| | | | | |
|---|---|---|---|---|
| (erg/cm$^2$) | Condition II | 31 | 46 | 59 |
| $E_{1/100}$: | Condition I | 50 | 65 | 86 |
| (erg/cm$^2$) | Condition II | 56 | 74 | 98 |
| Image-Forming | Condition I | Very Good | Good | No Good |
| Performance*7: | Condition II | Very Good | Good | Poor (background fog, cutting of letters and fine lines) |
| Water-Retentivity of Light-Sensitivie Material: | | Very Good (no background stains) | Poor (background stains) | Good |
| Background Stains on Print: | | No background stains on 6,000th print | Background stains from the start of printing | Background stains and cutting of letters and fine lines from the start of printing |

The electrostatic characteristics and image forming performance described in Table C-4 were evaluated as follows. The other evalutions were conducted in the same manner as described in Example 41.

*6Electrostatic Characteristics:

The light-sensitive material was charged with a corona discharge to a voltage of −6 KV for 20 seconds in a dark room at 20° C. and 65% RH using a paper analyzer ("Paper Analyzer SP-428" manufactured by Kawaguchi Denki K.K.). Ten seconds after the corona discharge, the surface potention $V_{10}$ was measured. The sample was allowed to stand in a dark room for an additional 180 seconds, and the potential $V_{190}$ was measured. The dark decay retention rate (DRR; %), i.e., percent retention of potential after dark decay for 180 seconds, was calculated from the following equation:

$$DRR (\%) = (V_{190}/V_{10}) \times 100$$

Separately, the surface of the light-sensitive material was charged to −400 V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$).

Further, in the same manner as described for the measurement of $E_{1/10}$, the time required for decay of the surface potential $V_{10}$ to one-hundredth was measured to obtain an exposure amount $E_{1/100}$ (erg/cm$^2$).

The measurements were conducted under conditions of 20° C. and 65% RH (Condition I) or 30° C. and 80% RH (Condition II).

*7Image-Forming Performance:

After the light-sensitive material was allowed to stand for one day under Condition I or II, each sample was charge to −5 kV and exposed to light emitted from a gallium-aluminum-arsenic semi-conductor laser (oscillation wavelength: 780 nm; output: 2.0 mW) at an exposure amount of 45 erg/cm$^2$ (on the surface of the photoconductive layer) at a pitch of 25 μm and a scanning speed of 330 m/sec. The thus formed electrostatic latent image was developed with a liquid developer (ELP-T manufactured by Fuji Photo Film Co., Ltd.), followed by fixing. The duplicated image obtained aws visually evaluated for fog and image quality.

As can be seen from the results shown in Table C-4 above, the light-sensitive material of the present invention exhibited the excellent electrostatic characteristics and image forming performance. With the light-sensitive material of Comparative Example C-3, the electrostatic characteristic of $E_{1/100}$ somewhat decreased. However, the image-forming performance was on an almost practically applicable level depending on the original (for example, the original composed of letters or the original having highly white background). On the other hand, the light-sensitive material of Comparative Example D-3 exhibited the decrease in the electrostatic characteristics, particularly under the severe conditions, and the background stains and cutting of letters and fine lines occurred in the duplicated images formed thereon.

Further, when the light-sensitive material of the present invention was subjected to the plate making, oil-desensitizing treatment and printing, 6,000 prints of good quality were obtained without adherence of printing ink owing to the sufficient hydrophilic property of the non-image areas.

On the contrary, the light-sensitive material of Comparative Example C-3 had insufficient hydrophilic property. Although the light-sensitive material of Comparative Example D-3 exhibited good water-retentivity, only unsatisfactory prints were obtained from the start of printing due to the poor duplicated images formed thereon by plate making.

EXAMPLE 53

A mixture of 4.0 g of Binder Resin (GPC-11) shown below, 6.0 g of Binder Resin (B-7) shown below, 30 g of Binder Resin (B-8) shown below, 200 g of photoconductive zinc oxide, 0.018 g of Cyanine Dye (B) shown below, and 300 g of toluene was dispersed in a ball mill for 3 hours to prepare a coating composition for a light-sensitive layer. The coating composition was coated on paper, which had been subjected to electrically conductive treatment, by a wire bar at a dry coverage of 20 g/m$^2$, followed by drying at 100° C. for 3 minutes. The coated material was then allowed to stand in a dark place at 20° C. and 65% RH for 24 hours to prepare an electrophotographic light-sensitive material.

Binder Resin (GPC-11):

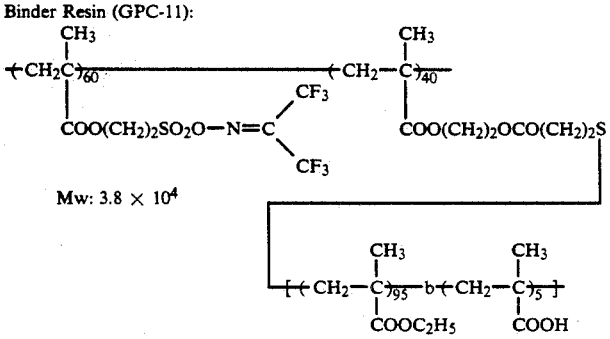

Mw: 3.8 × 10$^4$

Binder Resin (B-7)

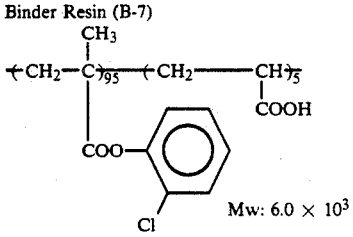

Mw: 6.0 × 10$^3$

Binder Resin (B-8):

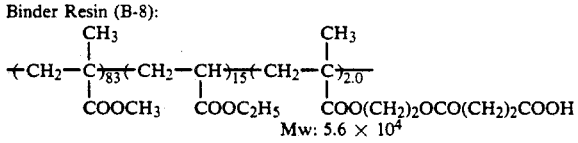

Mw: 5.6 × 10$^4$

Cyanine Dye (B):

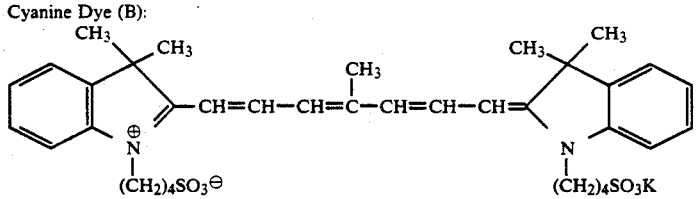

With the resulting light-sensitive material of the present invention, the electrostatic characteristics and image-forming performance were evaluated under the conditions of 30° C. and 80% RH in the same procedure as in Example 52. The results obtained are shown below.

| | |
|---|---|
| $V_{10}$: | −570 V |
| DRR: | 85% |
| $E_{1/10}$: | 28 erg/cm$^2$ |
| $E_{1/100}$: | 42 erg/cm$^2$ |

-continued

| | |
|---|---|
| Image-Forming Performance: | Very Good |

Further, the light-sensitive material was subjected to plate making, allowed to stand for one minute under a high-pressure mercury lamp of 300 W at a distance of 10 cm for irradiation, and passed once through an etching machine with an aqueous solution obtained by diluting twice an oil-desensitizing solution (ELP-EX) with distilled water to prepare a printing plate. As a result of printing using the resulting printing plate in the same manner in Example 41, 6,000 prints of clear image having good quality without background stains were obtained.

EXAMPLES 54 TO 59

By following the same procedure as Example 42 except for using 3 g of each of Binder Resins (GPC) shown in Table C-5 below in place of 3 g of Binder Resin (GPC-1), each of the electrophotographic light-sensitive materials shown in Table C-5 was prepared.

TABLE C-5

| Example No. | Binder Resin (GPC) | Electrostatic Characteristics (30° C., 80% RH) $V_{10}$ (−V) | DRR (%) | $E_{1/10}$ (erg/cm$^2$) | $E_{1/100}$ (erg/cm$^2$) | Image-Forming Performance (30° C., 80% RH) | Water-Retentivity of Light-Sensitive Material |
|---|---|---|---|---|---|---|---|
| 54 | GPC-4 | 555 | 83 | 30 | 58 | Very Good | Very Good |

TABLE C-5-continued

| Example No. | Binder Resin (GPC) | Electrostatic Characteristics (30° C., 80% RH) $V_{10}$ (−V) | DRR (%) | $E_{1/10}$ (erg/cm²) | $E_{1/100}$ (erg/cm²) | Image-Forming Performance (30° C., 80% RH) | Water-Retentivity of Light-Sensitive Material |
|---|---|---|---|---|---|---|---|
| 55 | GPC-6 | 555 | 85 | 26 | 55 | " | (no background stains) Very Good |
| 56 | GPC-7 | 550 | 86 | 26 | 57 | " | (no background stains) Very Good |
| 57 | GPC-8 | 545 | 84 | 27 | 59 | " | (no background stains) Very Good |
| 58 | GPC-9 | 550 | 84 | 31 | 60 | " | (no background stains) Very Good |
| 59 | GPC-3 | 555 | 85 | 28 | 58 | " | (no background stains) Very Good |

As can be seen from the results shown in Table C-5 above, the light-sensitive materials according to the present invention exhibited the excellent electrostatic characteristics even under the high temperature and high humidity conditions of 30° C. and 80% RH, as well as under the normal conditions of 20° C. and 65% RH. The image-forming performance and water retentivity of each light-sensitive material were also good. When, each of the light-sensitive material was employed as an offset master plate, 6,000 prints of clear image having good quality without background stains were obtained.

EXAMPLE 60

A mixture of 6 g of Binder Resin (GPC-12) shown below, 34 g of Binder Resin (B-9) shown below, 200 g of photoconductive zinc oxide, 0.03 g of uranine, 0.075 g of Rose Bengale, 0.045 g of bromophenol blue, 0.1 g of phthalic anhydride, and 240 g of toluene was dispersed by a homogenizer at $1\times10^4$ r.p.m. for 8 minutes to prepare a coating composition for a light-sensitive layer. The coating composition was coated on paper, which had been subjected to electrically conductive treatment, by a wire bar at a dry coverage of 20 g/m², and dried for 3 minutes at 100° C. Then, the coated material was allowed to stand in a dark place for 24 hours under the conditions of 20° C. and 65% RH to prepare an electrophotographic light-sensitive material.

Binder Resin (GPC-12)

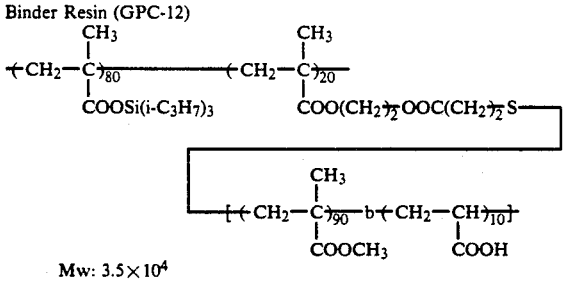

Mw: $3.5\times10^4$

Binder Resin (B-9):

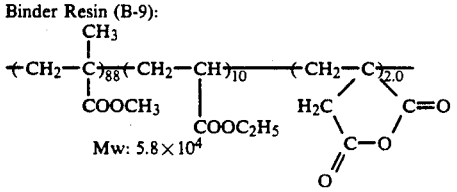

Mw: $5.8\times10^4$

With the light-sensitive material thus-prepared, the electrostatic characteristics and image-forming performance were evaluated under the conditions of 30° C. and 80% RH in the same procedure as in Example 61. The results obtained are shown below.

| | |
|---|---|
| $V_{10}$: | −560 V |
| DRR: | 88% |
| $E_{1/10}$: | 11.5 lux · sec |
| $E_{1/100}$: | 37 lux · sec |

The duplicated images obtained were clear and free from the occurrence of background stains and cutting of fine lines even under the severe conditions of high temperature and high humidity, as well as under the normal conditions.

Further, the light-sensitive material was subjected to plate making, immersed in a 60% aqueous solution of methyl ethyl ketone containing 0.5 moles of monoethanolamine for one minute, and then passed once through an etching machine with an aqueous solution obtained by dissolving twice an oil-desensitizing solution (ELP-EX) with distilled water to conduct the oil-desensitizing treatment. As a result of printing using the resulting printing plate in the same manner as in Example 1, 6,000 prints of clear image having good quality without background stains were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor which utilizes an electrophotographic light-sensitive material comprising a conductive support having provided thereon at least one photoconductive layer containing photoconductive zinc oxide and a binder resin, wherein the binder resin contains at least one graft-type copolymer comprising at least (1) a monofunctional monomer containing a functional group which has at least one atom selected from a fluorine atom and a silicon atom and is capable of forming at least one hydrophilic group selected from a sulfo group, a phosphono group, a carboxy group and a hydroxy group through decomposition, and (2) a monofunctional macromonomer which has a weight average molecular weight of from $1\times10^3$ to $2\times10^4$, and has a polymerizable double bond group represented by the general formula (I) described below bonded to only one terminal of the main chain thereof.

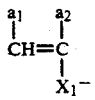

(I)

wherein $X_1$ represents —COO—, —OCO—, $\text{-}(CH_2)_n\text{OCO-}$, $\text{-}(CH_2)_m\text{COO-}$, —O—, $-SO_2-$, —CO—,

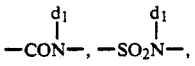

—CONHCOO—, —CONHCONH—, or

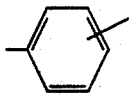

(wherein $d_1$ represents a hydrogen atom or a hydrocarbon group; and n and m each represents an integer of from 1 to 4); and $a_1$ and $a_2$, which may be the same or different, each represents a hydrogen atom, a halogen atom, a cyano group, a hydrocarbon group, $-COO-Z_1$ or $-COO-Z_1$ bonded via a hydrocarbon group (wherein $Z_1$ represents a hydrocarbon group which may be substituted).

2. An electrophotographic lithographic printing plate precursor as claimed in Claim 1, wherein the functional group capable of forming a hydrophilic group present in the monofunctional monomer is represented by the following general formula (IV), (V), (VI) or (VII):

$$-V-O-L_1 \qquad \text{(IV)}$$

wherein V represents

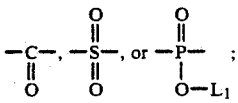

$L_1$ represents

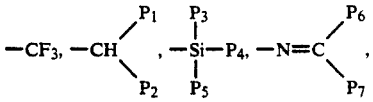

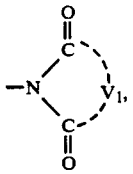

or $\text{-}(CH_2)_2)SO_2P_8$ wherein $P_1$ represents a hydrogen atom, —CN, $-CF_3$, $-COR_{11}$ or $-COOR_{11}$ (wherein $R_{11}$ represents an alkyl group having from 1 to 6 carbon atoms which may be substituted, an aralkyl group having 7 to 12 carbon atoms which may be substituted, an aromatic group, $\text{-}(CH_2)_{n1}(CF_2)_{m1}CF_2\ H$ (wherein $n_1$ represents an an integer of 1 or 2; and $m_1$ represents an integer of from 1 to 8), $\text{-}(CH_2)_{n2}C_{m2}H_{2m2+1}$ (wherein $m_2$ represents an integer of from 0 to 2; and $m_2$ represents an integer of from 1 to 8), or

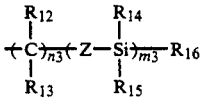

(wherein $n_3$ represents an integer of from 1 to 6; $m_3$ represents an integer of from 1 to 4; Z represents a mere band or —O—; $R_{12}$ and $R_{13}$, which may be the same or different, each represents a hydrogen atom, an alkyl group having from 1 to 4 carbon atoms; $R_{14}$, $R_{15}$ and $R_{16}$, which may be the same or different, each represents a hydrocarbon group having from 1 to 12 carbon atoms which may be substituted or $-OR_{17}$ wherein $R_{17}$ represents a hydrocarbon group having from 1 to 12 carbon atoms which may be substituted); $P_2$ represents $-CF_3$, $-COR_{11}$ or $-COOR_{11}$ (wherein $R_{11}$ has the same meaning as defined above), provided that at least one of $P_1$ and $P_2$ is selected from the fluorine atom or silicon atom-containing substituents; $P_3$, $P_4$, and $P_5$, which may be the same or different, each has the same meaning as $R_{14}$, $R_{15}$, or $R_{16}$; $P_6$ and $P_7$, which may be the same or different, each has the same meaning as $R_{11}$, provided that at least one of $P_6$ and $P_7$ is selected from the fluorine atom or silicon atom-containing substituents; $P_8$ represents $\text{-}(CH_2)_{n1}(CF_2)_{m1}CF_2H$, $\text{-}(CH_2)_{n2}C_{m2}H_{2m2+1}$ or

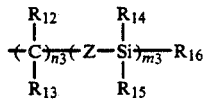

(wherein $n_1$, $m_1$, $n_2$, $m_2$, $n_3$, $m_3$, $R_{12}$, $R_{13}$, $R_{14}$, $R_{15}$ and $R_{16}$ each has the same meaning as defined above); and $V_1$ represents an organic moiety necessary to form a cyclic imido group having a substituent containing a fluorine atom and/or a silicon atom, $$-O-L_2 \qquad \text{(V)}$$

wherein $L_2$ represents

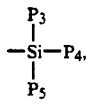

(wherein $P_3$, $P_4$ and $P_5$ each has the same meaning as defined above),

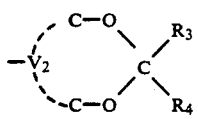

(VI)

wherein $R_3$ and $R_4$, which may be the same or different, each represents a hydrogen atom, or has the same meaning as $R_{11}$ (provided that at least one of $R_3$ and $R_4$ is selected from the fluorine or silicon atom-containing substituents); and $V_2$ represents a carbon-carbon chain in which a hetero atom may be introduced (provided that the number of atoms present between the two oxygen atoms does not exceed 5),

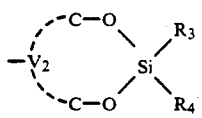

(VII)

wherein $V_2$, $R_3$ and $R_4$ each has the same meaning as defined above.

3. An electrophotographic lithographic printing plate precursor as claimed in claim 1, wherein the monofunctional monomer containing the functional group is represented by the following general formula (VIII):

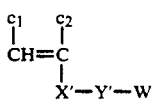

(VIII)

wherein X' is —O—, —CO—, —COO—, —OCO—,

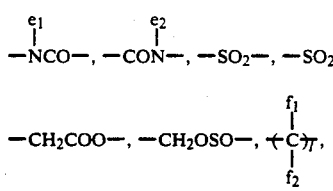

an aryl group, or a heterocyclic group (wherein $e_1$, $e_2$, $e_3$ and $e_4$ each represents a hydrogen atom, a hydrocarbon group, or —Y'—W; $f_1$ and $f_2$, which may be the same or different, each represents a hydrogen atom, a hydrocarbon group, or —Y'—W; and l is an integer of from 0 to 18); Y' represents carbon-carbon bond(s) for connecting the linkage group X' to the functional group W, between which one or more hetero atoms may be present; W represents the functional group; and $c_1$ and $c_2$, which may be the same or different, each represents a hydrogen atom, a halogen atom, a cyano group, a hydrocarbon group or $COOZ_0$ (wherein $Z_0$ represents an alkyl group containing from 1 to 18 carbon atoms, an alkenyl group, an aralkyl group, an alicyclic group or an aryl group, each of which may be substituted with a group containing the functional group W), provided that the moiety of —X'—Y'— may not be present.

4. An electrophotographic lithographic printing plate precursor as claimed in claim 1, wherein the monofunctional macromonomer comprises at least a polymerizable component corresponding to a repeating unit represented by the general formula (IIa) or (IIb):

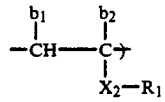

(IIa)

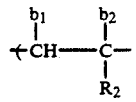

(IIb)

wherein $X_2$ has the same meaning as $X_1$ in the general formula (I); $R_1$ represents an aliphatic group having from 1 to 18 carbon atoms or an aromatic group having from 6 to 12 carbon atoms; $b_1$ and $b_2$, which may be the same or different, each has the same meaning as $a_1$ or $a_2$ in the general formula (I); and $R_2$ represents —CN, —$CONH_2$, or

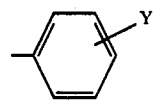

wherein Y represents a hydrogen atom, a halogen atom, a hydrocarbon group, an alkoxy group or —$COOZ_2$ (wherein $Z_2$ represents an alkyl group, an aralkyl group, or an aryl group).

5. An electrophotographic lithographic printing plate precursor as claimed in claim 4, wherein the monofunctional macromonomer further contains a polymerizable component containing at least one polar group selected from —COOH, —$PO_3H_2$, —$SO_3H$, —OH,

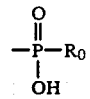

(wherein $R_0$ represents a hydrocarbon group or —$OR_0'$, wherein $R_0'$ represents a hydrocarbon group), —CHO and a cyclic acid anhydride-containing group.

6. An electrophotographic lithographic printing plate precursor as claimed in claim 5, wherein the content of the polymerizable component containing the polar group in the macromonomer is from 0.5 to 50 parts by weight per 100 parts by weight of the total polymerizable components.

7. An electrophotographic lithographic printing plate precursor as claimed in claim 1, wherein the monofunctional macromonomer is composed of an AB block copolymer composed of an A block comprising at least one polymerizable component containing at least one acidic group selected from —$PO_3H_2$, —COOH, —$SO_3H$, —OH,

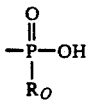

(wherein $R_0$ represents a hydrocarbon group or $—OR_0'$ (wherein $R_0'$ represents a hydrocarbon group)) and a cyclic acid anhydride-containing group, and a B block containing at least one polymerizable component represented by the general formula (IX) described below and having a polymerizable double bond group bonded to the terminal of the main chain of the B block polymer.

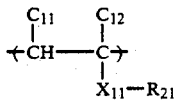

(IX)

wherein $c_{11}$ and $c_{12}$ each represents a hydrogen atom, a halogen atom, a cyano group, a hydrocarbon group, $—COOR_{24}$ or $—COOR_{24}$ bonded via a hydrocarbon group (wherein $R_{24}$ represents a hydrocarbon group); $X_{11}$ represents —COO—, —OCO—, $—(CH_2)_{l_1}OCO—$, $—(CH_2)_{l_2}COO—$, (wherein $l_1$ and $l_2$ each represents an integer of from 1 to 3), —O—, $—SO_2—$, —CO—,

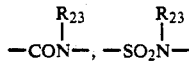

wherein $R_{23}$ represents a hydrogen atom or a hydrocarbon group), —CONHCOO—, —CONHCONH—, or

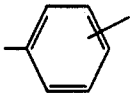

;

and $R_{21}$ represents a hydrocarbon group, provided that, when $X_{11}$ represents

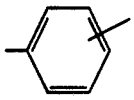

, $R_{21}$ represents a hydrogen atom or a hydrocarbon group.

8. An electrophotographic lithographic printing plate precursor as claimed in claim 7, wherein the acidic group contained in a component constituting the A block of the macromonomer is —COOH, $—SO_3H$, —OH, or

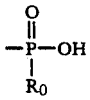

wherein $R_0$ is as defined above.

9. An electrophotographic lithographic printing plate precursor as claimed in claim 1, wherein the monofunctional macromonomer further contains from 1 to 20% by weight of a polymerizable component having a heat- and/or photo-curable functional group.

10. An electrophotographic lithographic printing plate precursor as claimed in claim 1, wherein a content of the polymerizable component corresponding to the monofunctional monomer containing the functional group is from 30 to 90% by weight based on the total polymerizable components.

11. An electrophotographic lithographic printing plate precursor as claimed in claim 1, wherein a weight average molecular weight of the graft-type copolymer is from $1\times10^3$ to $1\times10^6$.

* * * * *